US012590440B2

(12) United States Patent
Hoaby et al.

(10) Patent No.: US 12,590,440 B2
(45) Date of Patent: Mar. 31, 2026

(54) SYSTEMS AND METHODS FOR CONTROL OF EXCAVATORS AND OTHER POWER MACHINES

(71) Applicant: Doosan Bobcat North America, Inc., West Fargo, ND (US)

(72) Inventors: John Hoaby, Lisbon, ND (US); Michael Schmidt, Bismarck, ND (US); Sawyer Hanson, Fargo, ND (US); Thomas Sagaser, Mandan, ND (US); Daniel J. Krieger, Bismarck, ND (US)

(73) Assignee: Doosan Bobcat North America, Inc., West Fargo, ND (US)

( * ) Notice: Subject to any disclaimer, the term of this patent is extended or adjusted under 35 U.S.C. 154(b) by 595 days.

(21) Appl. No.: 17/852,144

(22) Filed: Jun. 28, 2022

(65) Prior Publication Data

US 2022/0412050 A1 Dec. 29, 2022

Related U.S. Application Data

(60) Provisional application No. 63/223,666, filed on Jul. 20, 2021, provisional application No. 63/215,783, filed on Jun. 28, 2021.

(51) Int. Cl.
*E02F 9/20* (2006.01)
*E02F 3/32* (2006.01)
(Continued)

(52) U.S. Cl.
CPC ..... *E02F 9/2012* (2013.01); *E02F 3/325* (2013.01); *E02F 3/435* (2013.01); *E02F 9/2025* (2013.01); *E02F 9/2285* (2013.01); *E02F 9/2292* (2013.01)

(58) Field of Classification Search
CPC . E02F 3/325; E02F 3/435; E02F 3/437; E02F 3/964; E02F 9/2012; E02F 9/2025; E02F 9/2285; E02F 9/2292
See application file for complete search history.

(56) References Cited

U.S. PATENT DOCUMENTS 5,261,234 A 11/1993 Halloway et al.
5,953,838 A * 9/1999 Steenwyk ..... E02F 9/2025 701/50
(Continued)

FOREIGN PATENT DOCUMENTS

EP 2980317 A1 2/2016
WO 2017159748 A1 9/2017
(Continued)

OTHER PUBLICATIONS

International Searching Authority, International Search Report and Written Opinion for related application PCT/US2022/035345, mailed on Apr. 28, 2023 (24 pgs.).

*Primary Examiner* — Tyler J Lee
(74) *Attorney, Agent, or Firm* — Quarles & Brady LLP

(57) ABSTRACT

A power machine can include operator input devices and a control system configured to command movement of actuators based on operator inputs received from the operator input devices. Movement of one or more of the actuators can be commanded based on input at one or more of the operator input devices and a response curve selected from a plurality of different response curves. Movement of one or more of the actuators can be based on a selected control mode for the power machine that corresponds to a selected control-function mapping of the operator input devices to the one or more actuators. A lift arm can be variously controlled to execute automatic or other operations. An excavator can be operated in a sustained-speed travel mode.

13 Claims, 26 Drawing Sheets

(51) Int. Cl.
*E02F 3/43* (2006.01)
*E02F 9/22* (2006.01)

(56) References Cited

U.S. PATENT DOCUMENTS

| | | | | |
|---|---|---|---|---|
| 6,092,454 | A | 7/2000 | Vande Kerckhove | |
| 6,305,162 | B1 * | 10/2001 | Cobo | E02F 9/2221 60/431 |
| 6,938,414 | B1 | 9/2005 | Bruun | |
| 7,273,125 | B2 | 9/2007 | Schuh | |
| 7,307,399 | B2 | 12/2007 | Furem | |
| 7,375,490 | B2 | 5/2008 | Furem | |
| 7,395,894 | B2 | 7/2008 | Jang et al. | |
| 7,472,009 | B2 | 12/2008 | Baldwin | |
| 7,490,421 | B1 | 2/2009 | Pletzer et al. | |
| 7,622,884 | B2 | 11/2009 | Furem | |
| 8,108,109 | B2 | 1/2012 | Young et al. | |
| 8,174,225 | B2 | 5/2012 | Mazumdar et al. | |
| 8,239,104 | B2 | 8/2012 | Young et al. | |
| 8,346,512 | B2 | 1/2013 | McAree | |
| 8,378,608 | B2 | 2/2013 | Robertson | |
| 8,474,254 | B2 | 7/2013 | Hughes, IV et al. | |
| 8,515,708 | B2 | 8/2013 | McAree et al. | |
| 8,536,814 | B2 | 9/2013 | Mazumdar et al. | |
| 8,698,437 | B2 | 4/2014 | Mazumdar | |
| 8,708,315 | B2 | 4/2014 | Wilcox | |
| 8,727,055 | B2 | 5/2014 | Matsumura et al. | |
| 8,768,578 | B2 | 7/2014 | Kawashima et al. | |
| 9,085,440 | B2 * | 7/2015 | Choi | E02F 9/2203 |
| 9,156,341 | B2 | 10/2015 | Matsumura et al. | |
| 9,190,852 | B2 | 11/2015 | Bienfang et al. | |
| 9,212,468 | B2 | 12/2015 | Sugiyama | |
| 9,272,677 | B2 | 3/2016 | Mazumdar | |
| 9,725,882 | B2 | 8/2017 | Lee | |
| 10,094,092 | B2 | 10/2018 | Joung et al. | |
| 10,458,095 | B2 | 10/2019 | Caillieret et al. | |
| 10,519,622 | B2 | 12/2019 | Caillieret et al. | |
| 10,633,824 | B2 | 4/2020 | Bruyere et al. | |
| 10,774,504 | B2 | 9/2020 | Storey | |
| 10,801,182 | B2 * | 10/2020 | Espinosa | E02F 9/2025 |
| 10,829,351 | B2 | 11/2020 | Wild et al. | |
| 2002/0153188 | A1 | 10/2002 | Brandt et al. | |
| 2014/0230785 | A1 * | 8/2014 | Kawaguchi | B60P 1/162 123/349 |
| 2015/0337954 | A1 | 11/2015 | Storey | |
| 2016/0340861 | A1 | 11/2016 | Takeo | |
| 2019/0010675 | A1 | 1/2019 | Ogawa et al. | |
| 2019/0127953 | A1 | 5/2019 | Wetzel et al. | |
| 2020/0123738 | A1 * | 4/2020 | Espinosa | E02F 9/221 |
| 2020/0299930 | A1 * | 9/2020 | Wuisan | E02F 9/2012 |
| 2020/0392696 | A1 * | 12/2020 | Zuo | E02F 9/2041 |
| 2020/0399863 | A1 | 12/2020 | Aizawa et al. | |
| 2021/0054599 | A1 * | 2/2021 | Schwall | E02F 9/2203 |
| 2021/0062459 | A1 | 3/2021 | Wagner et al. | |
| 2021/0129682 | A1 | 5/2021 | Kaneda et al. | |
| 2021/0172141 | A1 * | 6/2021 | Florean | E02F 3/3663 |

FOREIGN PATENT DOCUMENTS

| | | | |
|---|---|---|---|
| WO | 2019172424 | A1 | 9/2019 |
| WO | 2019200495 | A1 | 10/2019 |
| WO | 2019208304 | A1 | 10/2019 |
| WO | 2019228503 | A1 | 12/2019 |

* cited by examiner

SYSTEMS AND METHODS FOR CONTROL OF EXCAVATORS AND OTHER POWER MACHINES

CROSS-REFERENCE TO RELATED APPLICATIONS

This disclosure claims priority and incorporates by reference in their entirety U.S. provisional patent application No. 63/223,666, filed Jul. 20, 2021, and U.S. provisional patent application No. 63/215,783, filed Jun. 28, 2021.

BACKGROUND

This disclosure is directed toward power machines. More particularly, this disclosure is directed to excavators and control systems for excavators.

Power machines, for the purposes of this disclosure, include any type of machine that generates power to accomplish a particular task or a variety of tasks. One type of power machine is a work vehicle. Work vehicles are generally self-propelled vehicles that have a work device, such as a lift arm (although some work vehicles can have other work devices) that can be manipulated to perform a work function. Work vehicles include excavators, loaders, utility vehicles, tractors, and trenchers, to name a few examples.

Excavators are a known type of power machine that have an undercarriage and a house that selectively rotates on the undercarriage. A lift arm to which an implement can be attached, is operably coupled to, and moveable under power with respect to, the house. Excavators are also typically self-propelled vehicles. Typical excavators include one or more operator input devices (e.g., joysticks or pedals) that are physically moved by an operator to directly adjust hydraulic fluid flow through a particular component of the excavator (e.g., a control valve for an actuator for a lift arm) thereby adjusting the movement of the particular component (e.g., the lift arm). For example, a joystick can be physically coupled to a hydraulic valve either through mechanical cables or linkages between the joystick and the hydraulic valve or through hydraulic signals that are controlled by the joystick (i.e., the use of what is commonly known as pilot operated joysticks), so that movement of the joystick directly changes the hydraulic valve position and thereby causes movement of an actuator and a component that is coupled to the actuator.

The discussion above is merely provided for general background information and is not intended to be used as an aid in determining the scope of the claimed subject matter.

SUMMARY OF THE DISCLOSURE

Some examples of the disclosure are directed to adjusting responses for different operator input devices, based on, for example, a control mode of a power machine (e.g., an excavator), input from or for a particular operator, or other factors. This can provide a high level of customizability of power machines including to accommodate preferences and abilities of different users, and to implement a variety of tasks more effectively (e.g., digging, grading, driving, etc.).

According to some aspects of the disclosure, a power machine can include a main frame, a work element supported by the main frame, and one or more actuators. The work element can include a lift arm moveably secured to the main frame, and an implement carrier movably secured to the lift arm. The one or more actuators can be configured to move one or more components of the power machine. An operator input device can be configured to receive operator inputs to control movement of the one or more actuators.

A control system can include a control device in electronic communication with the operator input device and the one or more actuators. The control device can be configured to identify a plurality of response curves for the operator input device, each of which specifies a respective relationship between input signals from the operator input device and control signals for the one or more actuators. The control device can be configured to select a first response curve of the plurality of response curves. The control device can be configured to receive, from the operator input device, and operator input that commands movement of the one or more actuators. The control device can be configured to generate a command output, based on the received operator input and the first response curve. The control device can be configured to control the one or more actuators according to the command output.

In some examples, a power machine can be configured as an excavator and a lift arm can include a boom pivotally secured to the main frame and an arm pivotally secured to the boom.

In some examples, a first (or other) response curve can be non-linear.

In some examples, a first (or other) response curve can specify a substantially non-zero initial command output corresponding to an initial movement of an operator input device. A first (or other) response curve can specify a maximum command output corresponding to less than a maximum operator input from an operator input device.

In some examples, a control device can be configured to modify one or more characteristics of one or more response curves based on operator input.

In some examples, a control system can be configured to store a plurality of operator-customized response curves. A control device can be configured to modify one or more characteristics of one or more response curves to reduce a maximum speed of the one or more actuators.

In some examples, response curves can include a plurality of operating-mode response curves, including two or more of a trenching-mode response curve, a digging-mode response curve, a grading-mode response curve, or a drive-mode response curve.

According to some aspects of the disclosure, a power machine can include a main frame and a work element. The work element can be supported by the main frame, and can include a lift arm moveably (e.g., pivotally) secured to the main frame, and an implement carrier movably (e.g., pivotally) secured to the lift arm. A first operator input device (e.g., a first joystick) can be configured to control movement of one or more actuators of the power machine. A second operator input device (e.g., a second joystick) can be configured to control movement of one or more actuators of the power machine.

A control system can include a control device in electronic communication with the first and second operator input devices and the one or more actuators. The control device can be configured to, based on the power machine being in a first control mode, command movement of a first power machine operation based on a first type of operator input received from the first operator input device, and command a second power machine operation based on a second type of operator input received from the second operator input device. The control device can be configured to receive an operator input to place the power machine in a second control mode. The control device can be configured, based on the power machine being in the second control mode, to command a third power machine operation based on the first type of operator input, the third power machine operation being different from the first power machine operation. The control device can be configured, based on the power machine being in the second control mode, to command a fourth power machine operation based on the second type of operator input, the fourth power machine operation being different from the second power machine input.

In some examples, at least one of a first or a second type of operator input can control tractive power for the power machine in a first control mode (e.g., and not also workgroup power) and can control workgroup power for the power machine in a second control mode (e.g., and not also tractive power). In some examples, neither of a first or a second type of operator input can control tractive power in a second (or other) control mode.

In some examples, a power machine can be configured as an excavator, with a lift arm that can include a boom pivotally secured to the main frame and an arm pivotally secured to the boom. A first control mode for an excavator can be a driving mode and a second control mode for an excavator can be a digging mode. In some examples, a control-function mapping for an operator input device in one (e.g., a third) control mode can at least partly overlap with a control-function mapping for the operator input device in another control mode (e.g., a driving mode or a digging mode). For example, a particular type of operator input can be mapped to control of the same actuator(s) or the same power machine function(s) in each of multiple control modes.

According to some aspects of the disclosure, a method of operating a power machine is provided (e.g., a method implemented at least partly automatically by an electronic control device). A plurality of control modes can be stored in a control system of a power machine, corresponding to a plurality of control-function mappings between operator input devices and actuators of the power machine. Based on a user input, a first control mode of the plurality of control modes can be selected for the power machine. Operator input can be received from the operator input devices for control of the actuators of the power machine. The actuators of the power machine can be controlled based on the operator input and a control-function mapping or a response curve of the selected first control mode.

In some examples, a power machine can be an excavator, and a plurality of control modes can include one or more of: a digging mode; a driving mode; or a hybrid mode with a control-function mapping that overlaps with control-function mappings of the digging and driving modes.

In some examples, a response curve of a selected control mode can set a maximum speed for one or more of: travel of the power machine over terrain; or movement of one or more workgroup actuators or work elements. In some examples, a response curve of a selected control mode can set a maximum speed as a common maximum speed for a plurality of workgroup actuators or work elements.

In some examples, a user input can be received to modify the response curve of the selected first control mode. The response curve can be modified based on the operator input, and the actuators of the power machine can be controlled based on an operator command input and the modified response curve.

According to some aspects of the disclosure, a power machine can include a main frame and a work element supported by the main frame. The work element can include a lift arm moveably secured to the main frame, and an implement carrier movably secured to the lift arm. A hydraulic workgroup system of the power machine can include: one or more hydraulic actuators configured to move the lift arm; one or more hydraulic pumps configured to power movement of the one or more hydraulic actuators; a hydraulic reservoir; and a hydraulic valve assembly in hydraulic communication with the one or more hydraulic actuators, the one or more hydraulic pumps, and the hydraulic reservoir. An operator input device can be configured to receive operator inputs to control movement of the lift arm.

A control system can include a control device in electronic communication with the operator input device and the hydraulic valve assembly. The control device can be configured to control the hydraulic valve assembly to partially open a flow path from a base of at least one of the one or more hydraulic actuators to a hydraulic reservoir. The flow path, when partially open, can place the lift arm in a float condition, so that the lift arm is configured to move downward and upward based on externally applied forces, without requiring hydraulic power from the one or more hydraulic pumps.

In some examples, a control device can be configured to partially open a flow path from one or more hydraulic actuators to a hydraulic reservoir by different selective amounts based on operator input received at an operator input device. In some examples, a control device can be configured to selectively partially open a flow path by different amounts corresponding to different orientations of a lift arm. In some examples, a control device is configured to selectively partially open the flow path by the different amount based on one or more of: a detected pressure at at least one of the one or more hydraulic actuators; or a detected orientation of the lift arm, determined based on one or more orientation sensors associated with the lift arm.

In some examples, a lift arm can include a boom pivotally connected to the main frame, an arm pivotally connected to the lift arm opposite the main frame, and a bucket pivotally connected to the arm opposite the boom. A control device can be configured to execute one or more digging operations with the bucket while the lift arm is in a float condition. In some examples, the digging operations can include placing the lift arm in the float condition to move the lift arm into ground contact.

According to some aspects of the disclosure, a method of operating a power machine is provided (e.g., a method implemented at least partly automatically by an electronic control device). An implement of a power machine can be positioned at a first location, with a first height relative to ground. Using a control device, a hydraulic valve assembly can be electronically controlled to place a lift arm of the power machine in a float condition. In the float condition, the lift arm can be permitted to lower (e.g., lowered under gravity with hydraulic power only to resist—but not stop—the lowering movement) until the implement contacts one or more of the ground or an object supported by the ground. After the implement contacts the one or more of the ground or the object, electronically controlling the hydraulic valve assembly can be electronically controlled with the control device to one or more of: dig into the ground along a digging path or conduct a tamping operation.

In some examples, a digging path can be a flat-bottom digging path, and a float condition can be maintained during electronic control of a hydraulic valve assembly, to dig into the ground along the flat-bottom digging path. In some examples, a hydraulic valve assembly can be electronically controlled to maintain an angular orientation of an implement during electronic control of the hydraulic valve assembly to dig into the ground along the digging path.

In some examples, a digging sequence can be defined using a control device, including specifying a plurality (or one or more) of: an initial lift arm orientation, a digging depth, a dump location, a digging width, or a digging length. Using the control device, the digging sequence can be automatically executed, including permitting the lift arm, in a float condition, to lower until the implement contacts the ground. In some examples, a digging sequence can further include a cutting or scraping operation after an implement contacts the ground. In some examples, a digging sequence can include automatically shaking an implement. In some examples, during execution of a digging (or other) sequence, movement of the lift arm can be limited based on one or more predetermined virtual boundaries for the power machine.

In some examples, tamping operations can include, using a control device, electronically controlling a hydraulic valve assembly to raise an implement off of the ground. After the implement is raised off of the ground, the lift arm can be permitted, in the float condition, to lower until the implement again contacts the ground.

According to some aspects of the disclosure, a power machine can include a main frame, and a work element supported by the main frame. The work element can include a lift arm moveably secured to the main frame, and an implement carrier movably secured to the lift arm. One or more actuators can be configured to move the lift arm (e.g., can be pivotally secured to the main frame or the lift arm). An operator input device can be configured to receive operator inputs to control movement of the lift arm.

A control system can include a control device in electronic communication with the operator input device, the control device being configured to control the one or more actuators to move the lift arm based on either or both of: (a) one or more of a signal from the operator input device or a predetermined power machine operational sequence; and (b) one or more predetermined virtual boundaries for the power machine, the one or more predetermined virtual boundaries defining one or more virtual operation zones for the power machine that correspond to one or more operational parameters for the lift arm.

In some examples, one or more operational parameters can indicate one or more of: a first virtual zone for non-operation of a lift arm; or a second virtual zone for limited operation of the lift arm.

In some examples one or more predetermined virtual boundaries can specify one or more of: a maximum digging depth for the work element; an obstacle zone for the work element; a forward limit for the work element; a lateral limit for the work element; a maximum height for the work element; or a target zone for the work element.

In some examples, one or more actuators can be configured to move a lift arm. In some examples, actuators to move a lift arm can include including two or more of: a boom actuator configured to vertically pivot a boom of the lift arm relative to the main frame; an arm actuator configured to pivot an arm of the lift arm relative to the boom; an implement actuator configured to pivot the implement carrier relative to the arm; an offset actuator configured to laterally pivot the lift arm relative to the main frame; or a slew actuator configured to pivot the main frame relative to one or more tractive elements of the power machine.

In some examples, one or more sensors for (e.g., integrated with) a power machine can be configured to determine one or more of: an angle of a boom of the lift arm relative to a reference line defined by the main frame; an angle of an arm of the lift arm relative to the boom; or an angle of the implement carrier relative to the arm.

According to some aspects of the disclosure, a method of operating an excavator is provided (e.g., a method implemented at least partly automatically by an electronic control device). An operator input can be received, at a control device, to execute an operation with a lift arm of the power machine. Using the control device, a virtual zone can be determined for operation of the lift arm, based on one or more virtual boundaries for the power machine, the virtual zone corresponding to one or more operational parameters for the lift arm. Using the control device, one or more actuators can be electronically controlled to execute the operation with the lift arm, based on the operator input and the one or more operational parameters.

In some examples, the operational parameters can specify one or more of: an area of non-operation of the lift arm; an area of limited operation of the lift arm; a maximum digging depth for an implement attached to the lift arm; an obstacle zone for the implement; a forward limit for the implement; a lateral limit for the implement; a maximum height for the implement; or a target zone for the implement.

In some examples, operation with a lift arm can include one or more of: a predetermined (e.g., preprogrammed or operator-recorded) digging operation; or a predetermined (e.g., preprogrammed or operator-recorded) dumping operation.

In some examples, signals can be received from one or more sensors that indicate a current orientation of a lift arm and electronically controlling one or more actuators to execute an operation with the lift arm based on the received signals from the one or more sensors.

In some examples, one or more actuators can be electronically controlled to move a lift arm of a power machine, to position an implement that is pivotally supported by the lift arm. An oscillation of the one or more actuators to oscillate the implement relative to the lift arm can be automatically commanded using the control device.

In some examples, an operator input can be received from an operator input device to enable operation of an implement in an oscillating mode. Automatically commanding an oscillation can be based on the enabled operation of the implement in the oscillating mode.

In some examples, automatically commanding an oscillation in an oscillation mode can include repetitively: commanding a first movement of one or more actuators in a first direction for a first time interval; and subsequently commanding a second movement of the one or more actuators in a second direction for a second time interval.

In some examples, a control method can further include: determining, with a control device, a range criteria for an orientation of an implement during an oscillation of one or more actuators; and adjusting a commanded oscillation of the one or more actuators based on the range criteria.

In some examples, adjusting a commanded oscillation can include setting a first interval to be shorter than a second time interval based on a detected position or movement of the implement. In some examples, automatically commanding an oscillation of one or more actuators can be based on identifying, with the control device, one or more of: a stalled digging operation with the implement; an execution of a dumping operation with the implement; or an initiated digging operation with the implement.

In some examples, a signal can be received from an operator input device to activate an oscillating mode for an implement. Automatically commanding an oscillation of one or more actuators for the implement can be based on a control device identifying that the oscillating mode is activated.

In some examples, a lift arm can include a boom pivotally connected to a main frame of the power machine, an arm pivotally connected to the boom opposite the main frame, and an implement carrier that is configured to support an implement (e.g., a bucket) and is pivotally connected to the arm opposite the boom. One or more actuators for the lift arm can include one or more of: a boom actuator configured to pivot the boom relative to the main frame; an arm actuator configured to pivot the arm relative to the boom; or an implement actuator configured to pivot the implement carrier relative to the arm.

According to some aspects of the disclosure, a method of operating an excavator is provided (e.g., a method implemented at least partly automatically by an electronic control device). A first operator input can be received via one or more operator input devices, using a control device, to activate sustained-speed travel control. The excavator can be operated in a sustained-speed travel mode, using the control device, including: based on receiving the first operator input, commanding sustained-speed travel of the excavator at a set speed; receiving a second operator input via the one or more operator input devices to adjust the set speed; and commanding sustained-speed travel of the excavator at the adjusted set speed.

In some examples, while operating in a sustained-speed travel mode, a third operator input can be received via one or more operator input devices to change a control mode of an excavator from a first control mode to a second control mode, thereby correspondingly changing a control-function mapping of the one or more operator input devices. A commanded sustained-speed travel can be maintained in the second control mode. In some example, an operator input can be received in a second control mode to further adjust a set speed. The operator input can be received via a different input interface of one or more operator input devices than an operator input to adjust a set speed in a first control mode.

In some examples, under a first control mode, operating in the sustained-speed travel mode can include controlling steering of the excavator based on steering signals received from a first joystick. In some examples, under a first control mode, operating in the sustained-speed travel mode can include exiting the sustained-speed travel mode in response to receiving a termination signal from one or more of a joystick, a travel pedal, or a travel lever.

In some examples, under a second control mode, operating in a sustained-speed travel mode can include controlling steering of an excavator in response to movement of one or more travel pedals or levers in a first direction and exiting the sustained-speed travel mode in response to movement of the one or more travel pedals or levers in a second direction that is opposite the first direction.

In some examples, one or more operator input devices can include a joystick. Under a first control-function mapping for the sustained-speed travel mode, a first type of input at the joystick can be mapped to steering commands for drive operations, and a second type of input at the joystick is mapped to commands to interrupt operation in the sustained-speed travel mode.

In some examples, one or more operator input devices can include a joystick and a second device configured as one of a lever with a neutral position or a pedal with a neutral position. Under the first control-function mapping for the sustained-speed travel mode, a lateral input at the joystick can be mapped to steering commands for drive operations, and a movement the second device out of the neutral position can be mapped to commands to interrupt operation in the sustained-speed travel mode.

In some examples, operating in the sustained-speed travel mode includes detecting, using the control device, a speed mismatch between a first drive motor and a second drive motor, with the first drive motor exhibiting a first motor speed and the second drive motor exhibiting a second motor speed that is smaller than the first motor speed. Commanding sustained-speed travel of the excavator at the set speed can include increasing the speed of the second motor toward the first motor speed.

In some examples, operating in the sustained-speed travel mode can include, in response to receiving an operator input that commands a turning operation, commanding a reduction in speed of a first drive motor of an excavator. In some examples, operating in the sustained-speed travel mode can include, in response to receiving an operator input that commands a turning operation, commanding a maintained speed of a second drive motor of the excavator that corresponds to the set speed.

Some aspects of the disclosure can provide a power machine that includes a main frame, and a work element supported by the main frame. The work element can include a lift arm moveably secured to the main frame (e.g., a boom pivotally connected to the main frame, and an arm pivotally connected to the boom opposite the main frame), and an implement carrier movably secured to the lift arm. One or more actuators can be configured to move the lift arm relative to the main frame. A material sensor (e.g., a radar device) can be configured to monitor material relative to an implement attached to the implement carrier.

A control system can include a control device in electronic communication with the one or more actuators and the material sensor, the control device being configured to control movement of the lift arm by controlling the one or more actuators based on signals from the material sensor.

In some examples, an implement can be a bucket pivotally connected to a boom by an implement carrier. A control device can be configured to control an attitude of the bucket during a digging operation based on the signals from a material sensor. In some examples, a linkage assembly can be secured to the lift arm to pivot a material sensor relative to a lift arm based on movement of an implement relative to the main frame. A material sensor can be pivotally secured to one of the boom or the arm and a linkage assembly can include a link that extends from a pivotal connection at the other of the boom or the arm so that the linkage assembly pivots the material sensor to maintain an alignment of the material sensor with the implement carrier.

According to some aspects of the disclosure, a method of operating an excavator is provided (e.g., a method implemented at least partly automatically by an electronic control device). Using a control device, an attitude of a bucket of the power machine (or other implement) can be controlled during a digging operation based on the signals from a material sensor. In some examples, the power machine can be an excavator or the material sensor can be a radar device.

This Summary and the Abstract are provided to introduce a selection of concepts in a simplified form that are further described below in the Detailed Description. The Summary and the Abstract are not intended to identify key features or essential features of the claimed subject matter, nor are they intended to be used as an aid in determining the scope of the claimed subject matter.

BRIEF DESCRIPTION OF THE DRAWINGS

The following drawings are provided to help illustrate various features of non-limiting examples of the disclosure and are not intended to limit the scope of the disclosure or exclude alternative implementations.

DETAILED DESCRIPTION OF THE PRESENT DISCLOSURE

Figure 1:
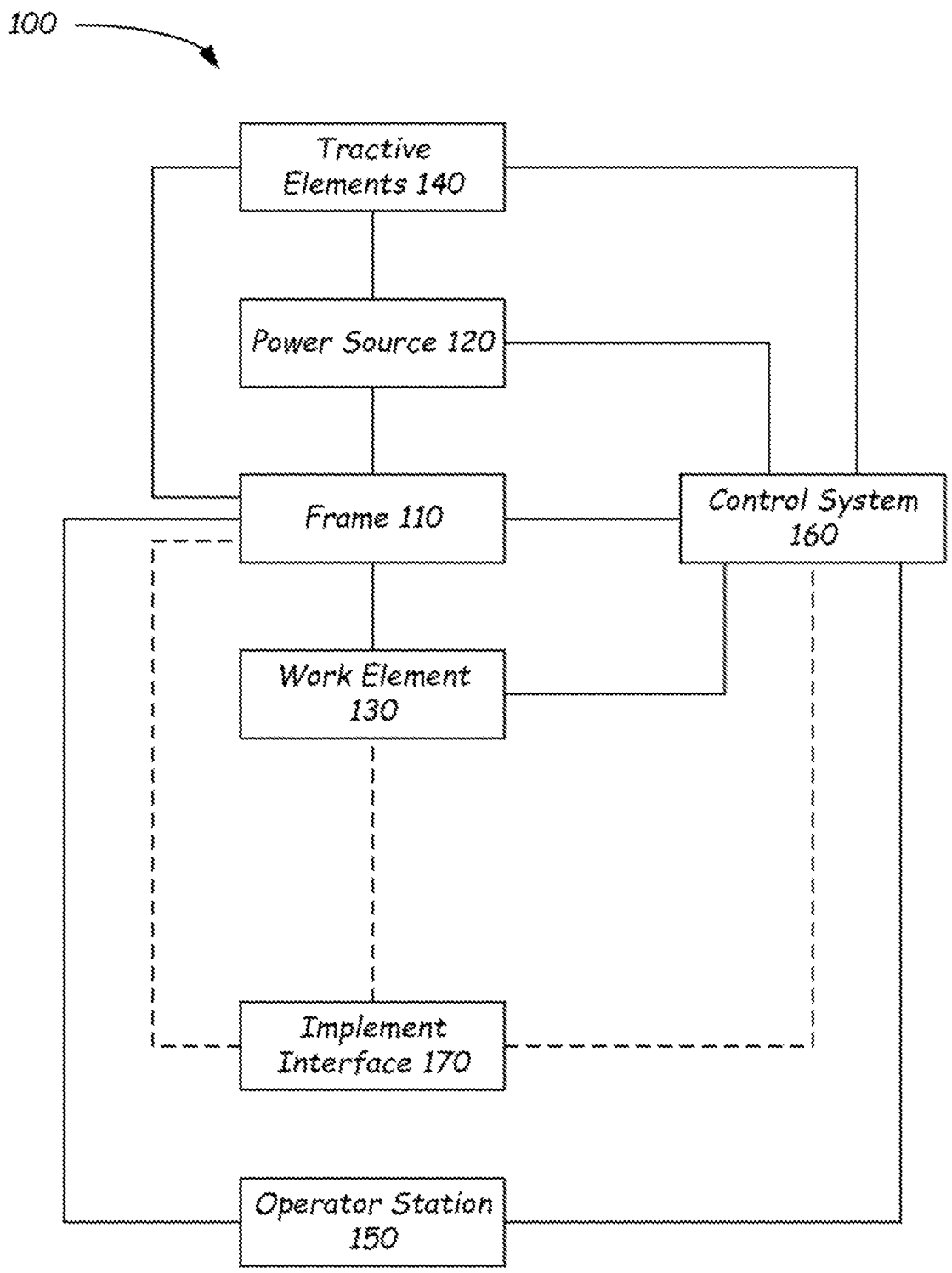
FIG. 1 is a block diagram illustrating functional systems of a representative power machine on which embodiments of the present disclosure can be practiced.

The concepts disclosed in this discussion are described and illustrated by referring to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

Also as used herein, unless otherwise expressly limited or defined, the term "automatic operations" (and the like) refers to operations that are at least partly dependent on electronic application of computer algorithms for decision-making without human intervention. In this regard, unless otherwise expressly limited or defined, "automatic travel" refers to travel of a power machine or other vehicle in which at least some decisions regarding steering, speed, distance, or other travel parameters are made without intervention by a human operator. Relatedly, the term "automated operations" (and the like), unless otherwise expressly limited or defined, refers to a subset of automatic operations for which no intervention by a human operator is required. For example, automated travel can refer to automatic travel of a power machine or other vehicle during which steering, speed, distance, or other travel parameters are determined in real time without operator input. In this regard, however, operator input may sometimes be received to start, stop, interrupt, or define parameters (e.g., top speed) for automated travel or other automated operations.

As described above, typical excavators (and other power machines) can include one or more operator input devices that are physically coupled (e.g., mechanically or hydraulically coupled) to the hydraulic system of the excavator. For example, each of several operator input devices can be physically coupled to one or more hydraulic valves for controlling operation of one or more actuators (e.g., a boom cylinder, an arm cylinder, a bucket cylinder, an auxiliary cylinder, a tractive assembly, etc.). Thus, physical movement of the operator input device can directly adjust the position of the one or more hydraulic valves to result in a movement (e.g., extension, retraction, etc.) of the one or more actuators.

While this conventional configuration can offer some advantages in operation of power machines, having physically coupled inputs the operator input devices can also introduce disadvantages. For example, because movement of each actuator of the excavator is driven directly by physical movements by an operator (e.g., actuation of the operator input device changes a position of a hydraulic valve through a mechanical or hydraulic coupling), system response to operator commands may be difficult to change. In other words, a particular operator input may correspond only to a particular command for an actuator, and this correspondence may not be easily customized or otherwise changed. Thus, conventional systems can exhibit relatively little adaptability to accommodate the preferences or abilities of specific operators, the needs of particular modes of operation (e.g., a driving operation or a digging operation).

Some embodiments according to this disclosure can address these issues (and others) by improving the customizability of excavators (and other power machines) to specific operators, to specific modes of operation or power machine functions, or to other specific control requirements. For example, some embodiments of the disclosure provide a control system that can include one or more operator input devices, a hydraulic control system including one or more actuators configured to operate tractive or work elements of the power machine, and a control device (e.g., one or more general or special purpose computers). The one or more operators input devices can be physically decoupled from the hydraulic control system, and thus, movement of an operator input device may not directly cause the one or more actuators to move. Rather, input at the one or more input devices can be electronically detected (e.g., a movement sensed by one or more orientation sensors), and result in electronic signals that can be received by the control device in the form of electronic operator input commands. The control device can then electronically command movement of particular actuators based on the received operator input commands (e.g., by electronically controlling various valves to regulate hydraulic flow to various actuators). For the purposes of this discussion, an electronic control of actuators is considered to be distinct from what is described above as a physical coupling of user inputs to actuators.

Further, as appropriate, the control device can modify the operator input command, to generate a modified operator command, which can then be transmitted by the control device to command movement of the one or more actuators. Depending on the parameters of a particular control mode, for example, different modifications of operator commands can be implemented. Accordingly, different types of operator inputs to command actuator movement (e.g., from a particular actuated button, from a particular movement of a particular joystick relative to a neutral position (e.g., forward movement of a left joystick toward a maximum position, etc.), from a particular movement of lever, etc.) can be caused to result in different types of actual actuator responses, depending on the parameters of the currently-implemented control mode.

In this regard, therefore, via a physical decoupling of operator input devices from the associated actuators, a considerable amount of adaptability for control of a power machine can be advantageously introduced, with corresponding improvements in operator experience, power machine capabilities, and overall power machine performance. In some embodiments, as further discussed below, operator input commands can be modified based on one or more selectable response curves, which can result in a particular movement of an operator input device being translated to different movements of an actuator, based on the particular response curve that was selected. Similarly, particular operator input devices can be mapped to different actuators or actuator movements, according to selectable control modes (e.g., each with a particular control-function mapping). For example, a control-function mapping can map buttons, switches, and movements of a joystick for an excavator to a first set of actuators (e.g., workgroup actuators) or functions during a digging mode, and to a different set of actuators (e.g., actuators for tractive elements) or functions during a driving mode. Thus, for example, an operator can use a set of movements of an operator input device to control a lift arm under a digging control mode and can use the same set of movements to control travel of the excavator over terrain under a driving control mode. A wide variety of other control-function mappings are also possible in other embodiments, including as discussed below.

Also as further discussed below, some embodiments can provide other benefits. For example, some embodiments can allow customizable adjustment of the speed of operation of particular actuators (or work elements) or the speed of travel over terrain, including to selectively reduce maximum permitted speeds for certain actuators, power machine systems (e.g., workgroup), or functions. As another example, some embodiments can allow customizable control of actuators through the use of response curves that relate operator input to actuator response, including alone or as part of other settings of a control mode (e.g., particular control-function mappings of operator input devices to particular actuators), or other beneficial adjustments to power machine control.

Figure 2:
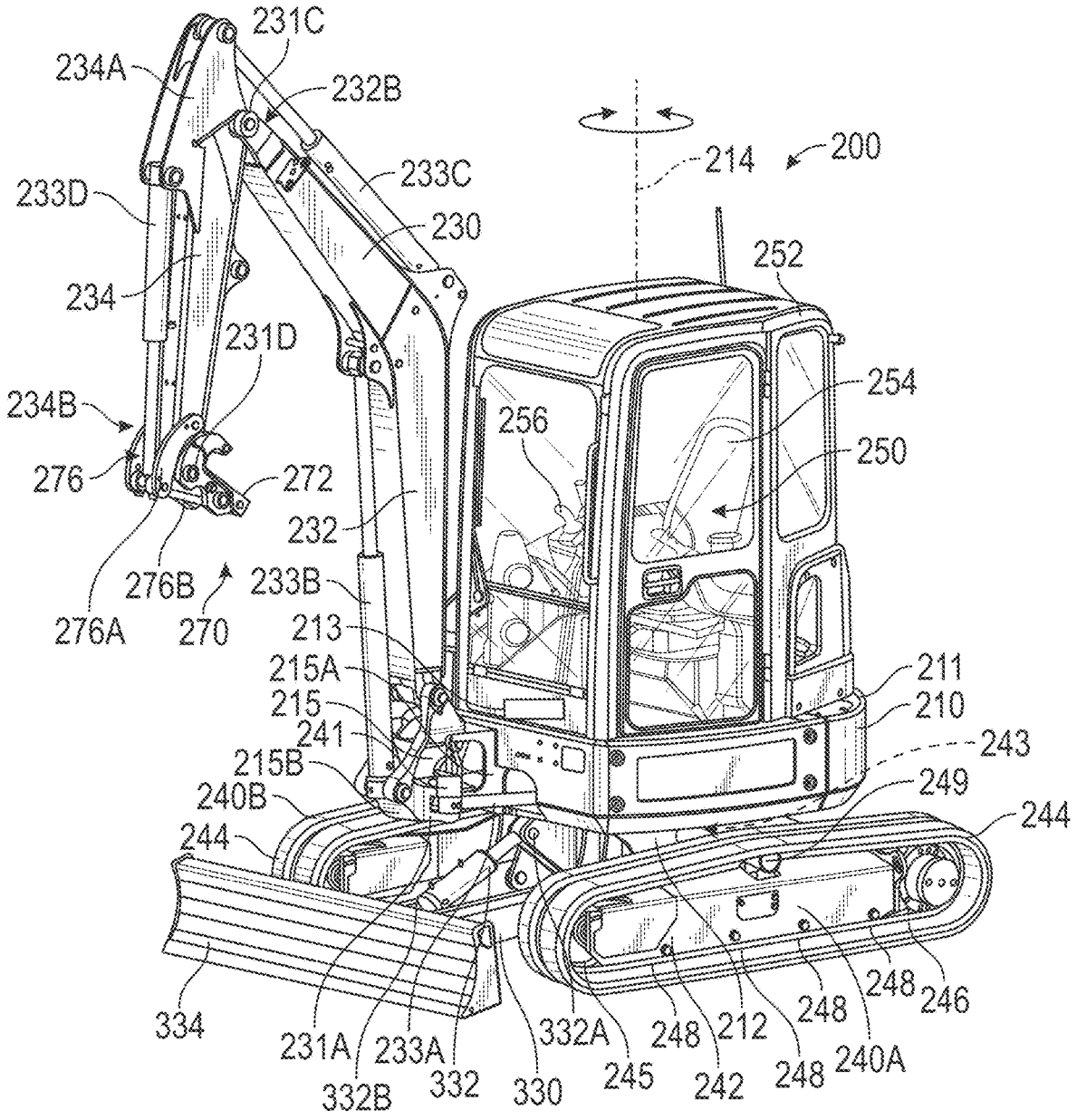
FIG. 2 is a front left perspective view of a representative power machine in the form of an excavator on which the disclosed embodiments can be practiced.
Figure 3:
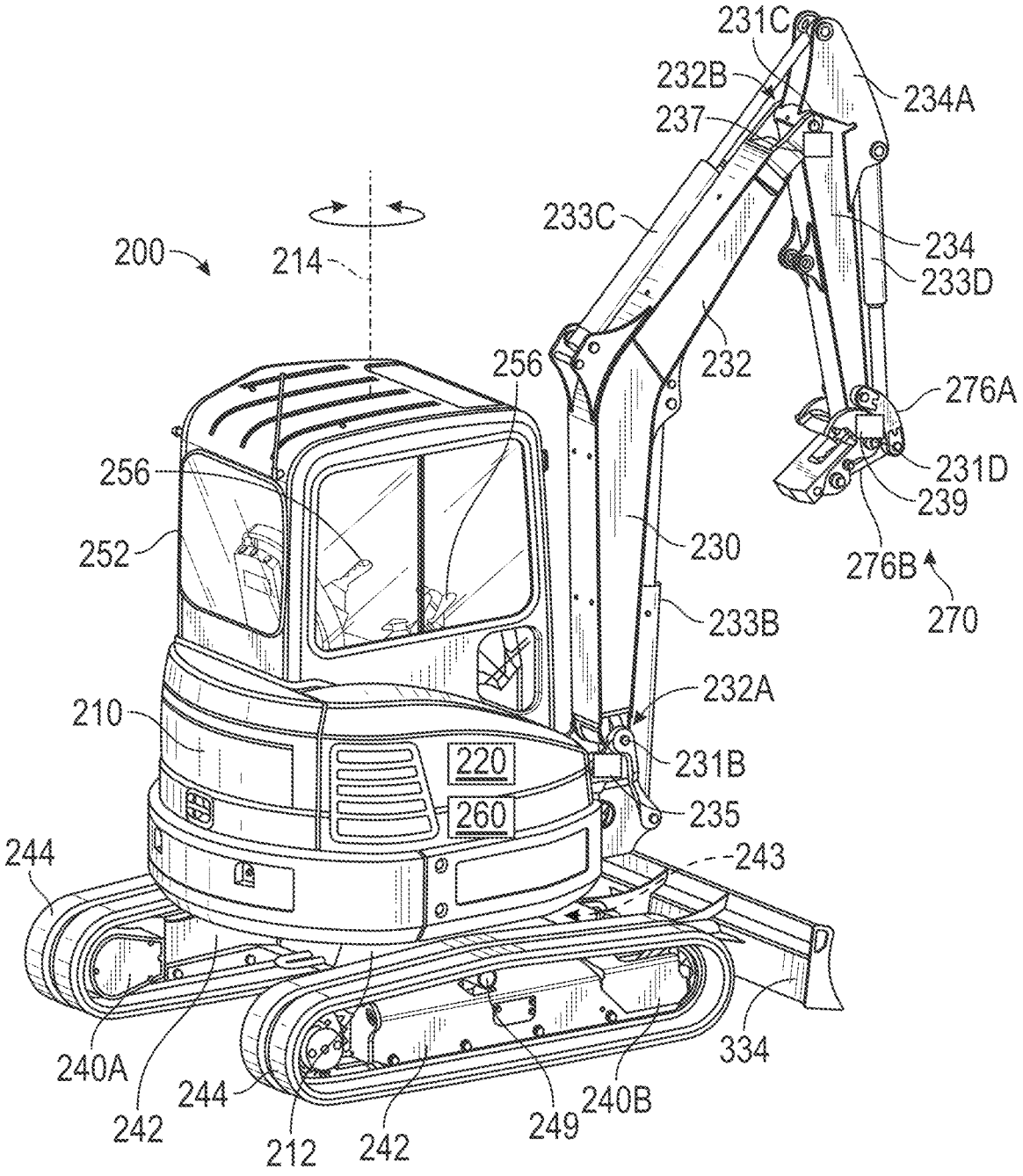
FIG. 3 is a rear right perspective view of the excavator of FIG. 2.

These concepts can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is discussed. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, work element, and a power source that can provide power to the work element. At least one of the work elements is a motive system for moving the power machine under power.

Referring now to FIG. 1, a block diagram illustrates the basic systems of a power machine 100 upon which the embodiments discussed below can be advantageously incorporated and can be any of several distinct types of power machines. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that can perform a dedicated task. For example, some work vehicles have a lift arm to which an implement such as a bucket is attached such as by a pinning arrangement. The work element, e.g., the lift arm, can be manipulated to position the implement for performing the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of several implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work elements with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that can move with respect to another portion of the frame. For example, excavators can have an upper frame portion that rotates about a swivel with respect to a lower frame portion. Other work vehicles have articulated frames such that one portion of the frame pivots with respect to another portion for accomplishing steering functions. In exemplary embodiments, at least a portion of the power source is located in the upper frame or machine portion that rotates relative to the lower frame portion or undercarriage. The power source provides power to components of the undercarriage portion through the swivel.

Frame 110 supports the power source 120, which can provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that are capable of using it to perform a work function. Power sources for power machines typically include an engine such as an internal combustion engine and a power conversion system such as a mechanical transmission or a hydraulic system that can convert the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, wheels attached to an axle, track assemblies, and the like. Tractive elements can be rigidly mounted to the frame such that movement of the tractive element is limited to rotation about an axle or steerably mounted to the frame to accomplish steering by pivoting the tractive element with respect to the frame. In contrast to tractive elements and actuators, workgroup actuators and elements are configured to provide powered movement of one or more components of a power machine for work operations (i.e., other than for travel of the power machine over terrain). Correspondingly, "workgroup function" refers to one or more functions that relate to movement of one or more components of a power machine other than for travel of the power machine over terrain.

Power machine 100 includes an operator station 150, which provides a position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether they have operator compartments or operator positions, may be capable of being operated remotely (i.e. from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e. remote from both of the power machine and any implement to which is it coupled) that can control at least some of the operator-controlled functions on the power machine.

FIGS. 2-3 illustrate an excavator 200, which is one particular example of a power machine of the type illustrated in FIG. 1, on which the disclosed embodiments can be employed. Unless specifically noted otherwise, embodiments disclosed below can be practiced on a variety of power machines, with the excavator 200 being only one of those power machines. Excavator 200 is described below for illustrative purposes. Not every excavator or power machine on which the illustrative embodiments can be practiced need have all the features or be limited to the features that excavator 200 has. Excavator 200 has a frame 210 that supports and encloses a power system 220 (represented in FIGS. 2-3 as a block, as the actual power system is enclosed within the frame 210). The power system 220 includes an engine that provides a power output to a hydraulic system. The hydraulic system acts as a power conversion system that includes one or more hydraulic pumps for selectively providing pressurized hydraulic fluid to actuators that are operably coupled to work elements in response to signals provided by operator input devices. The hydraulic system also includes a control valve system that selectively provides pressurized hydraulic fluid to actuators in response to signals provided by operator input devices. The excavator 200 includes a plurality of work elements in the form of a first lift arm structure 230 and a second lift arm structure 330 (not all excavators have a second lift arm structure). In addition, excavator 200, being a work vehicle, includes a pair of tractive elements in the form of left and right track assemblies 240A and 240B, which are disposed on opposing sides of the frame 210.

An operator compartment 250 is defined in part by a cab 252, which is mounted on the frame 210. The cab 252 shown on excavator 200 is an enclosed structure, but other operator compartments need not be enclosed. For example, some excavators have a canopy that provides a roof but is not enclosed A control system, shown as block 260 is provided for controlling the various work elements. Control system 260 includes operator input devices, which interact with the power system 220 to selectively provide power signals to actuators to control work functions on the excavator 200. In some embodiments, the operator input devices include at least two two-axis operator input devices to which operator functions can be mapped.

Frame 210 includes an upper frame portion or house 211 that is pivotally mounted on a lower frame portion or undercarriage 212 via a swivel joint. The swivel joint includes a bearing, a ring gear, and a slew motor with a pinion gear (not pictured) that engages the ring gear to swivel the machine. The slew motor receives a power signal from the control system 260 to rotate the house 211 with respect to the undercarriage 212. House 211 is capable of unlimited rotation about a swivel axis 214 under power with respect to the undercarriage 212 in response to manipulation of an input device by an operator. Hydraulic conduits are fed through the swivel joint via a hydraulic swivel to provide pressurized hydraulic fluid to the tractive elements and one or more work elements such as lift arm 330 that are operably coupled to the undercarriage 212.

The first lift arm structure 230 is mounted to the house 211 via a swing mount 215. (Some excavators do not have a swing mount of the type described here.) The first lift arm structure 230 is a boom-arm lift arm of the type that is generally employed on excavators although certain features of this lift arm structure may be unique to the lift arm illustrated in FIGS. 2-3. The swing mount 215 includes a frame portion 215A and a lift arm portion 215B that is rotationally mounted to the frame portion 215A at a mounting frame pivot 231A. A swing actuator 233A is coupled to the house 211 and the lift arm portion 215B of the mount. Actuation of the swing actuator 233A causes the lift arm structure 230 to pivot or swing about an axis that extends longitudinally through the mounting frame pivot 231A.

The first lift arm structure 230 includes a first portion 232, known generally as a boom, and a second portion 234, known as an arm or a dipper. The boom 232 is pivotally attached on a first end 232A to mount 215 at boom pivot mount 231B. A boom actuator 233B is attached to the mount 215 and the boom 232. Actuation of the boom actuator 233B causes the boom 232 to pivot about the boom pivot mount 231B, which effectively causes a second end 232B of the boom to be raised and lowered with respect to the house 211. A first end 234A of the arm 234 is pivotally attached to the second end 232B of the boom 232 at an arm mount pivot 231C. An arm actuator 233C is attached to the boom 232 and the arm 234. Actuation of the arm actuator 233C causes the arm to pivot about the arm mount pivot 231C. Each of the swing actuator 233A, the boom actuator 233B, and the arm actuator 233C can be independently controlled in response to control signals from operator input devices.

An exemplary implement interface 270 is provided at a second end 234B of the arm 234. The implement interface 270 includes an implement carrier 272 that can accept and securing a variety of different implements to the lift arm 230. Such implements have a machine interface that is configured to be engaged with the implement carrier 272. The implement carrier 272 is pivotally mounted to the second end 234B of the arm 234. An implement carrier actuator 233D is operably coupled to the arm 234 and a linkage assembly 276. The linkage assembly includes a first link 276A and a second link 276B. The first link 276A is pivotally mounted to the arm 234 and the implement carrier actuator 233D. The second link 276B is pivotally mounted to the implement carrier 272 and the first link 276A. The linkage assembly 276 is provided to allow the implement carrier 272 to pivot about the arm 234 when the implement carrier actuator 233D is actuated.

The implement interface 270 also includes an implement power source (not shown in FIGS. 2-3) available for connection to an implement on the lift arm structure 230. The implement power source includes pressurized hydraulic fluid port to which an implement can be coupled. The pressurized hydraulic fluid port selectively provides pressurized hydraulic fluid for powering one or more functions or actuators on an implement. The implement power source can also include an electrical power source for powering electrical actuators and/or an electronic controller on an implement. The electrical power source can also include electrical conduits that are in communication with a data bus on the excavator 200 to allow communication between a controller on an implement and electronic devices on the excavator 200. It should be noted that the specific implement power source on excavator 200 does not include an electrical power source. However, in some configurations, the specific implement power source or other power sources of an excavator or other power machine can include an electrically powered actuator, for example, when the excavator is an electrically powered work vehicle that includes an electrical power storage device (e.g., a battery). Correspondingly, control of actuators in some cases may not necessarily require control of hydraulic flow (e.g., may be accomplished via electronic control of an electronic actuator by a control device).

The lower frame 212 supports and has attached to it a pair of tractive elements 240, identified in FIGS. 2-3 as left track drive assembly 240A and right track drive assembly 240B. Each of the tractive elements 240 has a track frame 242 that is coupled to the lower frame 212. The track frame 242 supports and is surrounded by an endless track 244, which rotates under power to propel the excavator 200 over a support surface. Various elements are coupled to or otherwise supported by the track 242 for engaging and supporting the track 244 and cause it to rotate about the track frame. For example, a sprocket 246 is supported by the track frame 242 and engages the endless track 244 to cause the endless track to rotate about the track frame. An idler 245 is held against the track 244 by a tensioner (not shown) to maintain proper tension on the track. The track frame 242 also supports a plurality of rollers 248, which engage the track and, through the track, the support surface to support and distribute the weight of the excavator 200. An upper track guide 249 is provided for providing tension on track 244 and preventing the track from rubbing on track frame 242.

A second, or lower, lift arm 330 is pivotally attached to the lower frame 212. A lower lift arm actuator 332 is pivotally coupled to the lower frame 212 at a first end 332A and to the lower lift arm 330 at a second end 332B. The lower lift arm 330 is configured to carry a lower implement 334, which in one embodiment is a blade as is shown in FIGS. 2-3. The lower implement 334 can be rigidly fixed to the lower lift arm 330 such that it is integral to the lift arm. Alternatively, the lower implement can be pivotally attached to the lower lift arm via an implement interface, which in some embodiments can include an implement carrier of the type described above. Lower lift arms with implement interfaces can accept and secure various different types of implements thereto. Actuation of the lower lift arm actuator 332, in response to operator input, causes the lower lift arm 330 to pivot with respect to the lower frame 212, thereby raising and lowering the lower implement 334.

Upper frame portion 211 supports cab 252, which defines, at least in part, operator compartment or station 250. A seat 254 is provided within cab 252 in which an operator can be seated while operating the excavator. While sitting in the seat 254, an operator will have access to a plurality of operator input devices 256 that the operator can manipulate to control various work functions, such as manipulating the lift arm 230, the lower lift arm 330, the traction system 240, pivoting the house 211, the tractive elements 240, and so forth.

Excavator 200 provides a variety of different operator input devices 256 to control various functions. For example, hydraulic joysticks are provided to control the lift arm 230 and swiveling of the house 211 of the excavator. Foot pedals with attached levers (e.g., as represented by box 213 in FIG. 2 are provided for controlling travel and lift arm swing. Electrical switches are located on the joysticks for controlling the providing of power to an implement attached to the implement carrier 272. Other types of operator inputs that can be used in excavator 200 and other excavators and power machines include, but are not limited to, switches, buttons, knobs, levers, variable sliders, and the like. The specific control examples provided above are exemplary in nature and not intended to describe the input devices for all excavators and what they control.

Display devices are provided in the cab to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided.

The description of power machine 100 and excavator 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on an excavator such as excavator 200, unless otherwise noted, the concepts discussed below are not intended to be limited in their application to the environments specifically described above.

In some embodiments, sensors of other known types can be arranged to measure parameters relating to a current orientation of a workgroup or other system of a power machine, including to measure angular orientations of various components of a lift arm. For example, as shown in FIG. 3, the excavator 200 can include angle sensors 235, 237, 239 each of which can determine the relative orientation of specific components of the work group of the excavator 200. For example, the angle sensor 235 can be coupled to the swing mount 215 at the boom pivot mount 231B and can sense the angle between the swing mount 215 and the boom 232 (e.g., relative to a line parallel to the end 232A of the boom 232). As another example, the angle sensor 237 can be coupled to the boom 232 at the arm mount pivot 231C and can sense the angle between the boom 232 (e.g., relative to a line parallel to the end 232B of the boom 232) and the arm 234 (e.g., relative to a line parallel to the end 234A of the arm 234). As yet another example, the angle sensor 239 can be coupled to the arm 234 at an implement interface pivot mount 231D and can sense the angle between the arm 234 (e.g., relative to a line parallel to the end 234B of the arm 234) and the implement carrier 272 (e.g., relative to a line parallel to a cutting angle of a bucket (not shown) secured to the implement carrier 272).

Referring also to FIG. 2, the excavator 200 can also include angle sensors 241, 243. The angle sensor 241 can be coupled to the swing mount 215 at the mounting frame pivot 231A and can sense the angle between the frame portion 215A and the swing mount 215 to sense a boom offset angle for the excavator 200 (i.e., to indicate rotation of the lift arm 230 about an offset axis that is parallel to the axis 214 relative to the house 211). The angle sensor 243, which is obstructed from view in FIGS. 2 and 3, can be coupled to the undercarriage 212 (or the house 211) and can sense the angle between the house 211 and the undercarriage 212. In some cases, this angle can be considered the slew angle for the excavator 200 (i.e., the rotational position of the excavator about axis 214, relative to a neutral location).

As further discussed below, signals from the angle sensors 235, 237, 239, 241, 243 can be processed in known ways to determine a current orientation of the implement carrier 272 or other components relative to a reference frame (e.g., a fixed frame defined by undercarriage 212. In some cases, orientation of a particular component can be determined from the perspective of the excavator 272 in isolation. In some cases, orientation of a particular component can be determined relative to a surrounding environment. For example, based on a known position of the excavator 272 in an environment, and known dimensions of the undercarriage 212, the track drive assemblies 240A, 240B, and other excavator components, signals from the angle sensors 235, 237, 239, 241, 243 can be analyzed to specify a position of any part of the lift arm 230 relative to the environment.

In different embodiments, the angle sensors 235, 237, 239, 241, 243 can be implemented in different ways. For example, each angle sensor 235, 237, 239, 241, 243, can be a hall-effect sensor, a torque sensor, an accelerometer, a rotary encoder, etc. Further, in some cases, non-rotational sensors can be used. For example, data from linear displacement or other position sensors (not shown) on various actuators for the lift arm 230 can be used in combination with known dimensions of the excavator 200 to specify relevant triangular identities for the lift arm 230 and thereby also indicate the angular orientation of particular components and the relative (or absolute) orientation of any particular part of the lift arm 230. Regardless of the specific sensor configuration, however, various known kinematic approaches can be used to determine a current orientation of any particular lift arm (or other) component based on measurements from the angle sensors 235, 237, 239, 241, 243 (or others, including sensors (not shown) for the lower lift arm 330) and known geometries of relevant one or more relevant components (e.g., the boom 232, the arm 234, the implement interface 272, an implement coupled to the implement interface 272, the frame portion 215A, the house 211, a distance between the sensors 241, 243, etc.).

Figure 4:
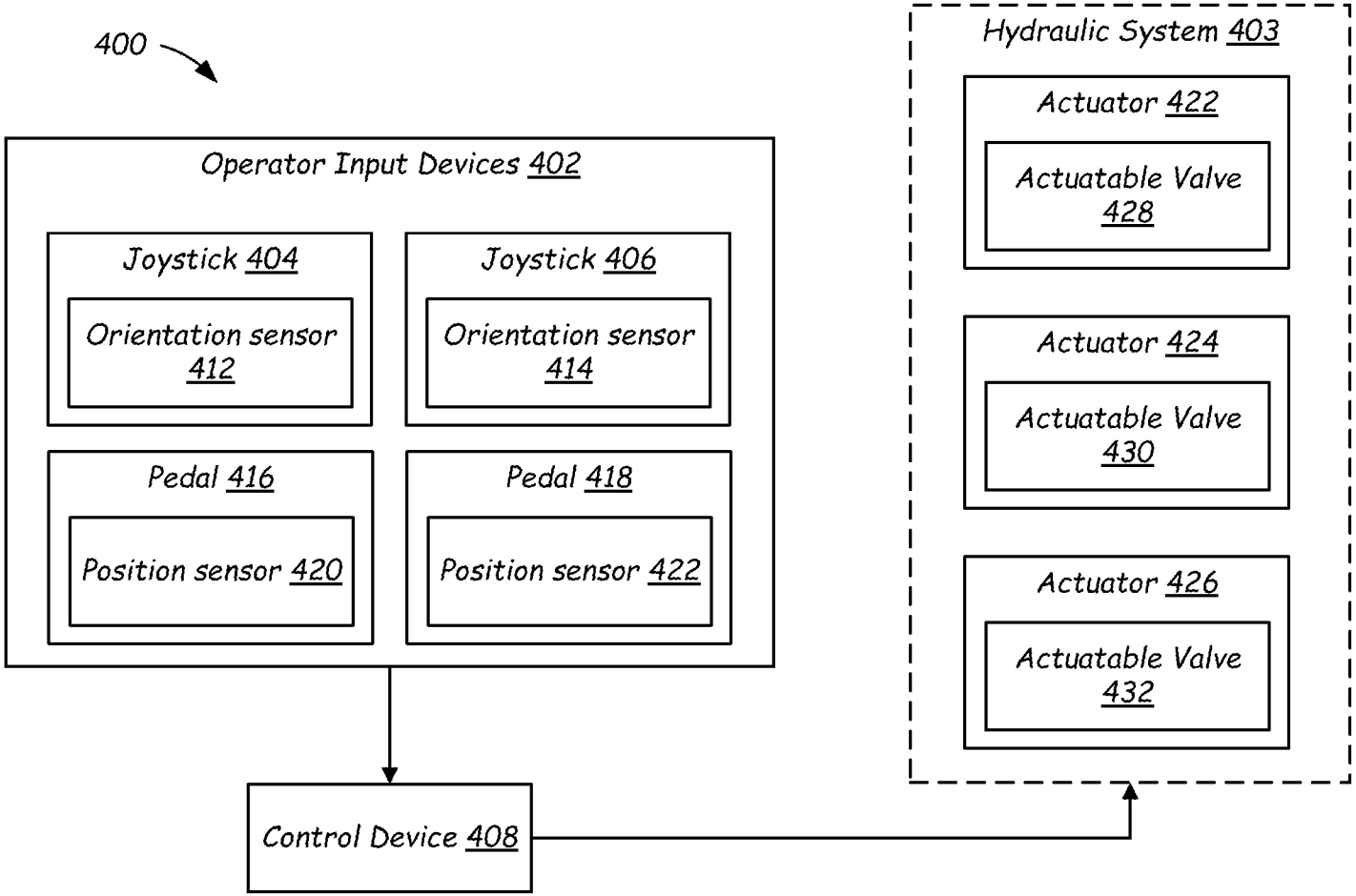
FIG. 4 is a schematic illustration of a control system for a power machine.

FIG. 4 shows a schematic illustration of a control system 400 for an excavator (or other power machine), as can be implemented as a specific example of the control system 160 (see FIG. 1), or a portion thereof. The control system 400 can include one or more operator input devices 402, a hydraulic (or other actuation) system 403, and a control device 408. The operator input devices 402 can be implemented in different ways, including as one or more joysticks, one or more pedals, or other known types of devices for receiving input from operators for control of components of a power machine.

In one embodiment, as shown in FIG. 4, the operator input devices 402 can include joysticks 404, 406. Each joystick 404, 406 can be located within a cab of the excavator (e.g., the cab 252 of FIG. 3), and each can be pivoted about at least two axes to adjust a current respective position of the joystick 404, 406. Each joystick 404, 406 can include a respective orientation sensor 412, 416, 418, 420, which can sense the current orientation of each joystick 404, 406 relative to a pivot point of the respective joystick 404, 406. For example, the orientation sensor 412 can sense the orientation of the joystick 404 relative to a neutral position (or pivot point) of the joystick 404, while the orientation sensor 416 can sense the orientation of the joystick relative to a neutral position (or pivot point) of the joystick 406. The orientation sensors 412, 414 can each be in communication with the control device 408 and can each be implemented in a variety of known ways. For accelerometer, a magnetometer (e.g., one or more Hall-effect sensors), an inertial measurement unit ("IMU"), etc. Thus, regardless of the configuration, the control device 408 can be configured to receive a signal from each orientation sensor 412, 414 (or the joysticks 404, 406, generally), to indicate a current orientation of each joystick 404, 406.

As further detailed below, the orientation of the joysticks 404, 406 can generally correspond to operator inputs for particular power machine operations, which can then be converted to commands for actuators by the control device 408. For example, in some embodiments, the spatial orientation of either of the joysticks 404, 406 can correspond to a particular type and intensity of commanded movement. For example, a region of all possible positions for a two-axis joystick can be segmented into one or more regions (e.g., four quadrants arranged around an origin), which can correspond to a particular task for the excavator. In particular, when the control device receives, from the corresponding orientation sensor, that the joystick is within a particular region, then the control device can implement the task associated with the particular region (e.g., driving forward). In addition, movement of the joystick towards or away a neutral position of the joystick while the joystick is positioned within the particular region can adjust a property related to the task associated with the particular region. For example, further movement of the joystick away from the neutral position can correspond to a commanded increase in speed of a relevant movement, while further movement of the joystick towards the neutral position can correspond to a commanded decrease in speed, including when the task associated with the particular region is driving forward. As further detailed below, in some cases, the control system 400 can allow customization of which particular operation is associated with which orientation(s) of the joysticks 404, 406 or other operator input device(s), as well as the characteristics (e.g., speed, maximum or minimum values, etc.) of the commanded operation.

In some embodiments, operator input devices 402 can include one or more actuatable buttons or other operator input devices that can have one or more corresponding positions. Some of these operator input devices can be integrated into handles for joysticks 404, 406. For example, an actuatable button can be a single pole switch (e.g., a trigger, a rocker switch, etc.) that has two corresponding positions, with a first position indicating the trigger being off, and with a second position indicating the trigger being on. As another example, an actuatable button can be a double pole double throw switch having two actuated positions. As yet another example, an actuatable button can be a push-button having two positions (e.g., on—actuated, and off—not actuated). As another example, an actuatable button can be a double push button. In some cases, an operator input device can include other operator input devices including a roller sensor, a toggle sensor, a joystick, etc., each of which can have more than three positions, including a plurality of intermediate positions. Thus, generally, an operator input device can provide commands for power machine operations via bulk movement of the operator input device (e.g., movement of the joysticks 404, 406) or via actuation of buttons on any of the operator input devices 402 (e.g., movement of switches, push-buttons, rollers, etc.). (As used herein, "button" is intended also to include virtual icons or other virtual interfaces that can receive input similar to mechanical buttons).

Regardless of the configuration, the actuatable buttons (or other input mechanisms) integrated into the handle of either joystick 404, 406 can be in communication with the control device 408. In this way, the control device 408 can receive an indication that a particular actuatable button (or other mechanism) has been, or has not been, actuated. Similar to the orientation of the joysticks 404, 406, some or all of the actuatable buttons can be mapped to corresponding actuators or functions of the excavator. In some cases, as also generally noted above, buttons on the joysticks 404, 406 can correspond to operation of particular actuators. In some cases, buttons on the joysticks 404, 406 can correspond to adjustments to the control system 400 itself. For example, in some cases, actuatable buttons integrated into the handle associated with the joystick 404 can adjust an operational mode or control mode of a power machine, including to specifically indicate particular control modes, cycle through a sequence of control modes, or adjust parameters of a particular control mode. In some cases, as described in more detail below, a particular control mode can correspond to a particular control-function mapping of the operator input devices 402, or components thereof, to particular commands (e.g., commands for particular actuators, commands to adjust system response or other operational parameters, etc.). In some cases, each control mode for the control system 400 can correspond to a different mapping of functionality to the one or more input devices 402, so that the one or more input devices 402 can control a power machine differently, depending on the currently selected mode.

In some embodiments, the operator input devices 402 can include pedals 416, 418 each having a respective position sensor 420, 422 that can sense the direction of movement of the corresponding pedal (e.g., forwards or backwards) and the amount of movement of the pedal from a neutral position. In some cases, the position sensors 420, 422 can be implemented in a similar manner as the previously described orientation sensors. For example, each position sensor 420, 422 can be a hall-effect sensor, an optical sensor, etc. In some embodiments, and similarly to the joysticks 404, 406, the pedals 416, 418 can be programmable and assigned different functions for each direction. For example, the pedal 416 moving forwards from a neutral orientation can be assigned with a first function, while the pedal 416 moving backwards from the neutral orientation can be assigned with a second function different from the first function. Further, as with other input devices discussed herein different control-function mapping for the pedals 416, 418 can be assigned for different control modes.

As shown in FIG. 4, the operator input devices 402 are physically decoupled from the hydraulic system 403. Thus, adjustment of the orientation (or actuation of a mechanical button of an operator input device) of the operator input devices 402 does not directly adjust the operation of the hydraulic system 403 or of the actuators of the hydraulic system 403. Rather, operator inputs are received by the control device 408, modified as appropriate, and then transmitted to the hydraulic system 403 to control movement of an actuator. In this regard, for example, the hydraulic system 403 can include actuators 422, 424, 426 that have respective actuatable valves 428, 430, 432 to control operation of the actuators 422, 424, 426. Each of the valves 428, 430, 432 can be in communication with the control device 408 and can be in fluid communication with the respective actuator 422, 424, 426. Thus, the control device 408 can adjust a position of each actuatable valve 428, 430, 432 (e.g., by providing electrical signals to each actuatable valve 428, 430, 432), and thereby control hydraulic flow to the respective actuators 422, 424, 426 to control movement of the actuators 422, 424, 426 (e.g., to extend the actuator, to retract the actuator, to rotate the actuator, etc.). In other embodiments, however, other known devices can be used to control operation of other known actuators, based on signals from the control device 408 that are, in turn, based on signals from the operator input devices 402. In some embodiments, the actuatable valves 428, 430, 432 are control valves that control a spool valve, which in turn provides hydraulic flow to the respective actuators 422, 424, 426. While three actuators are shown for illustrative purposes, in various embodiments the total number of actuators may be more than three actuators.

As generally discussed above, in different embodiments, power machine actuators can be implemented in different ways. For example, one or more of the actuators 422, 424, 426 can be a swing actuator (e.g., similar to the swing actuator 233A of FIG. 2), a boom actuator (e.g., similar to the boom actuator 233B of FIG. 2), an arm actuator (e.g., similar to the arm actuator 233C of FIG. 2), an implement carrier actuator (e.g., the similar to implement carrier actuator 233D), an auxiliary actuator (e.g., an actuator for a lifting clamp), a slew motor (or in other words a slew actuator) for a swivel joint (e.g., the slew motor that rotates upper frame portion 211 relative to the undercarriage 212), a drive assembly for a tractive element (e.g., the track drive assembly 240A), or otherwise. Thus, generally, each of the actuators 422, 424, 426 can be a linear actuator (e.g., that extends and retracts), a rotational actuator, or other actuators of known types.

The actuatable valves 428, 430, 432 can also be implemented in different ways. For example, each actuatable valve 428, 430, 432 can be an electrically controlled valve including a solenoid valve, a pilot solenoid valve, etc. In this way, when a control device 408 electrically powers the electrically controlled valve (e.g., according to a command output value), the valve position changes to adjust the flow of hydraulic fluid through the electrically controlled valve thereby adjusting the hydraulic flow to a respective actuator. In other implementations, however, other known valve types or other known mechanisms for control of actuators can be used.

While three actuators 422, 424, 426 are illustrated in FIG. 4, in other configurations the control system 400 can have other numbers of actuators (e.g., one, two, four, five, etc.). In addition, while each of the actuators 422, 424, 426 are illustrated as having, or being in fluid communication with, a respective actuatable valve 428, 430, 432 other configurations are possible. For example, one actuatable valve can be in fluid communication with multiple actuators, or multiple actuatable valves can be in fluid communication with one actuator. In this way, adjusting the valve position of one actuatable valve can sometimes control movement of the multiple actuators, and adjusting the valve position of multiple actuatable valves can sometimes control movement of a single actuator.

Generally, the control device 408 can be implemented in a variety of different ways. For example, the control device 408 can be implemented as known types of processor devices, (e.g., microcontrollers, field-programmable gate arrays, programmable logic controllers, logic gates, etc.), including as general or special purpose computers. In addition, the control device 408 can also include other computing components, such as memory, inputs, other output devices, etc. (not shown). In this regard, the control device 408 can be configured to implement some or all of the steps of the processes described herein, as appropriate, which can be retrieved from memory. In some embodiments, the control device 408 can include multiple control devices (or modules) that can be integrated into a single component or arranged as multiple separate components. In some embodiments, the control device 408 can be part of a larger control system (e.g., the control system 160 of FIG. 1) and can accordingly include or be in electronic communication with a variety of control modules, including hub controllers, engine controllers, drive controllers, and so on.

Figure 5:
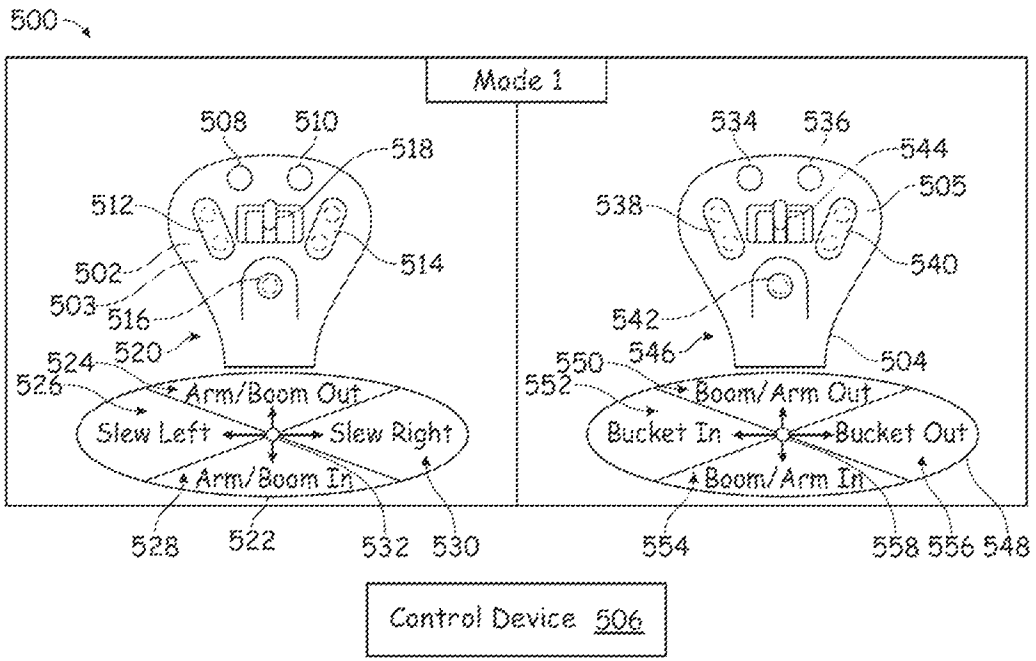
FIG. 5 is a schematic illustration of a control-function mapping for one or more joysticks of a power machine configured as an excavator, under a first control mode.

As generally noted above, different implementations can use different mappings to associate buttons or movements of an operator input device to commanded movements of actuators. In this regard, FIG. 5 shows one configuration of a control-function mapping 500 for handles of one or more joysticks of an excavator (or other power machine), which provides a first mapping of different types of input commands to different operational movements according to a first control mode. In some cases, the illustrated control mode can be a digging mode, although other configurations are possible. As shown in FIG. 5, an excavator can include joysticks 502, 504 (e.g., similar to the previously described joysticks 404, 406) and a control device 506 in communication with the joysticks 502, 504 (including the respective orientation sensors and the respective actuatable buttons, other operator input devices, etc.). Similar to the joysticks 404, 406, each joystick 502, 504 can include a respective orientation sensor (not shown) that can sense the orientation of the corresponding joystick. Each joystick 502, 504 can also include a respective handle 503, 505 with a plurality of actuatable buttons that, along with the joysticks, can be mapped to different functions according to a particular mode of operation. For example, the joystick handle 503 can include actuatable buttons 508, 510, 512, 514, 516, and movable switches 518, 520 (e.g., hidden within or behind a profile of the handle 503 as in the illustrated example of the switch 520).

The actuatable buttons 508, 510 can each be implemented in a similar manner (e.g., both can be a single pole switch), including being implemented as a push button that is biased (e.g., with a spring) towards a non-contact position (e.g., the switch being closed). In some cases, the actuatable buttons 508, 510 can be mapped to (e.g., can implement) a similar function. For example, the actuatable buttons 508, 510 can both control the movement of a lower arm actuator that is coupled to a blade (e.g., the blade 334 of FIG. 2). In the illustrated example control mode, actuation of the actuatable button 508 can command (via the control device 506) extension of the lower arm actuator to move the blade down, and actuation of the actuatable button 510 can command retraction of the lower arm actuator to move the blade up. In some cases, continual actuation of either actuatable button 508, 510 can continually move the lower arm actuator at a constant speed in the corresponding direction (e.g., the button 508 moving the blade downwardly, the button 510 moving the blade upwardly).

The actuatable buttons 512, 514 can each be implemented in a similar manner (e.g., both can be a double pole switch), but with each actuatable button 512, 514 being mapped to a different function of the excavator. For example, each actuatable button 512, 514 can be a push button that has three positions. In particular, a first position can close a first switch, a second position can close a second switch (different from the first switch), and a third position can be a neutral position that is a non-contact position (e.g., toward which the push button can be biased). In the illustrated example control mode, the actuatable button 512 can be used to control an adjustment to a work mode (in this case is a digging mode), which can include adjusting the responsiveness of the one or more actuators of the excavator. For example, as also generally discussed below, actuating the actuatable button 512 to the first position can increase a parameter of an operator response curve for digging operations (e.g., increasing a slope of the curve to increase the speed for the work mode, upwardly shifting a y-intercept of the response curve to increase an impulse movement for the work mode, increasing an endpoint for the response curve, toggle between curves, etc.). As another example, actuating the actuatable button 512 to the second position can decrease a parameter of an operator response curve for digging operations (e.g., decreasing a slope of the curve to decrease the speed for the work mode, downwardly shifting a y-intercept of the response curve to decrease an impulse movement for the work mode, decreasing an endpoint for the response curve, toggling between curves, etc.), including relative to response curves discussed relative to FIG. 11 (below). As still another example, actuating the actuatable button 512 can decrease or increase a maximum allowed speed for a particular operation or actuator (e.g., a tractive actuator), including by a predetermined increment (e.g., a set percentage for each button press).

In some embodiments, an actuatable button on a joystick can be used to control tractive operations (i.e., command movement of tractive actuators to move an excavator) during a control mode that may be primarily focused on non-tractive operations (e.g., the digging mode, as illustrated). For example, in the illustrated digging mode, the actuatable button 514 can be used to control the movement of a left traction element (e.g., the left traction element 240 of the excavator 200), including to command particular speed/power or to adjust a sustained-speed travel setting of the left traction element. Similarly, as also discussed below, actuating an actuatable button 538 on the joystick 504 to a first position can command movement of the right traction element in a first direction (e.g., forward) with a particular speed, while actuating the actuatable button 538 to a second position can command movement the right traction element in a second direction (e.g., reverse) with a particular speed.

As another example, when sustained-speed travel has been initiated, actuating the actuatable button 514 to the first position can increase the set sustained-speed travel control speed of the left traction element by a particular amount (e.g., increasing the count of the left traction element), whereas actuating the actuatable button 514 to a second position can decrease the set sustained-speed travel control speed of the left traction element by a particular amount (e.g., decreasing the count of the left traction element). Similarly, actuating the actuatable button 538 to the first position can increase the set control speed of the right traction element by a particular amount (e.g., increasing the count of the right traction element), while actuating the actuatable button 538 to a second position can decrease the set control speed of the right traction element by a particular amount (e.g., decreasing the count of the left traction element).

The actuatable button 516 can be a single pole actuatable button, which can control enabling (or disabling) operation of the relevant control system (e.g., control system 400) in a particular control mode (e.g., a digging mode, as illustrated). For example, engaging the actuatable button 516 can trigger a particular mapping of operator input devices of the control system to power machine functionality (e.g., as illustrated in FIG. 5, or according to a different selected mode), whereas disengaging the actuatable button 516 can trigger a different mapping of the operator input devices to power machine functionality (e.g., as further discussed below).

The switch 518 can be configured as a single axis joystick and can be integrated with the multi-axis joystick 502 similar to the other actuatable buttons described above. In particular, the switch 518 can have a neutral position and a plurality of other positions aside from the neutral position (e.g., implemented via a potentiometer device). In the illustrated example control mode, the switch 518 can control an offset of a lift arm (e.g., the lift arm structure 230). In other words, the switch 518 can control the angle at which the lift arm extends from the house 211, relative to the forward direction. Thus, the switch 518 can cause a swing actuator (e.g., the swing actuator 233A) to pivot a lift arm in a first rotational direction, or a second rotational direction, depending on the orientation of the switch 518. For example, when the switch 518 is in the neutral position, the swing actuator does not move and thus the lift arm does not pivot. However, if the switch 518 is pivoted to the left (e.g., with respect to the view of FIG. 5) of the neutral position, then the swing actuator pivots the lift arm in a first rotational direction relative to the house of the excavator by a particular amount. Conversely, if the switch 518 is pivoted to the right (e.g., with respect to the view of FIG. 5) of the neutral position, then the swing actuator pivots the lift arm in a second rotational direction opposite the first rotational direction by a particular amount.

The button 520 can be implemented as a trigger in some cases, or in a similar manner as the switch 518 in other cases, and is positioned on a rear side of the joystick 502. In the illustrated example control mode, the button 520 can control the slew of a house of an excavator (e.g., rotation of house 211 relative to the undercarriage 212 in either rotational direction about the swivel axis 214). In some embodiments, however, the button 520 can be configured to alternately control different machine functionality (e.g., as toggled with the button 516). For example, in a second configuration for the illustrated digging mode, the button 520 can control the dumping of a bucket. In other embodiments or modes of operation, the button 520 may not control any of the machine functions.

In some embodiments, because the joystick 502 has an orientation sensor, the control device 506 can control certain power machine functionality based on a spatial-function map 522 with regions 524, 526, 528, 530, each of which defines a particular function for the excavator when the current orientation of the joystick 502 is located within the particular region. For example, when the joystick is positioned in the region 524, the control device 506 causes the arm (or boom) to pivot outwardly away from the house of the excavator. Conversely, when the joystick is positioned in the region 528, which is opposite the region 524, the control device 506 causes the arm (or boom) to extend in towards the house. As another example, when the joystick 502 is positioned in the region 526, the control device 506 causes the excavator to slew left (e.g., rotate in a counterclockwise direction relative to the axis 214). Conversely, when the joystick 502 is positioned in the region 530, which is opposite to the region 528, the control device 506 can cause the excavator to slew right (e.g., rotate in a clockwise direction relative to the axis 214).

Generally, the speed of the commanded movement may correspond to the distance of the joystick 502 from neutral, within any particular one of the regions, as also discussed below. For example, in some embodiments, the farther the joystick 502 is pivoted within a region (or corresponding direction), the greater the operator input command value for that particular function assigned to the region (and vice versa). For example, when the joystick 502 is positioned within the region 524, the farther the joystick 502 is pivoted from the neutral orientation 532, the greater the operator command for extending the lift arm, which translates into the control device 506 extending the lift arm more quickly (and vice versa). Further, some operator inputs may correspond to combination commands (e.g., slew right and arm in, or slew left and arm out).

As shown in FIG. 5, the joystick 504 can be structured in a similar manner as the joystick 502. For example, the joystick handle 505 also can include actuatable buttons 534, 536, 538, 540, 542, and switches 544, 546. The actuatable buttons 534, 536, 538, 540, 542, can be implemented in a similar structural manner as the actuatable buttons 508, 510, 512, 514, 516, 520, while the switches 544, 546 can be implemented in a similar structural manner as the switches 518, 520 (e.g., hidden within or behind a profile of the handle 503 as in the illustrated example of the switch 546). However, the actuatable buttons 534, 536, 538, 540, 542 can have different mapped functions than the actuatable buttons 508, 510, 512, 514, 516, 520, while the switches 544, 546 can have different mapped functions than the switches 518, 520.

For example, in the illustrated digging mode, actuation of either of the buttons 534, 536 causes the control device 506 to change the current mode for the function layout of the joysticks 502, 504 (and other operator input devices). For example, actuation of the button 534 can toggle from the current control mode in a first sequential direction (e.g., from a first mode to a second mode), while actuation of the button 536 can toggle from the current mode in a second sequential direction (e.g., from a second mode to a first mode). In some cases, actuation of the buttons 534, 536 can thus allow an operator to scroll through different control modes.

As another example, as also noted above, the button 538 can function in a similar manner to the button 514, except the button 538 can control the right traction element. For example, when the excavator is not in sustained-speed travel mode, and when the button 538 is actuated, the control device 506 can command movement of the right traction element either forwards or rearwards, depending on the actuation position of the button 538. However, when the excavator is in sustained-speed travel mode, and when the button 538 is actuated, the control device 506 can cause the excavator to increase (or decrease) the set control speed of the right traction element by a particular amount, depending on the actuation position of the button 538.

In some embodiments, operator input devices can be configured to enable partly or fully automated sequences. For example, in the illustrated digging mode, depending on the actuation position of the button 540, actuation of the button 540 can cause the control device 506 to enable (or disable) a first preprogrammed dig sequence or a second preprogrammed dig sequence (e.g., flat-bottom digging). As still another example, when the button 542 is actuated, the control device 506 can cause the lift arm to float (i.e., to move under its own weight, rather than as actively driven by hydraulic actuators) or can cause the lift arm to stop floating (e.g., resume active driving or holding of the relevant actuators by pressurized hydraulic fluid).

Similar to the switches 518, 520, the switches 544, 546 can each be mapped to a different function. For example, when the switch 544 moves, the control device 506 can cause the auxiliary actuator to extend (e.g., release) or retract (e.g., clamp) depending on the movement direction of the switch 544. The switch 546, which is positioned on a rear side of the joystick 504, can control return/dig functionality, can turn on auxiliary hydraulics, or can lock a thumb device for an implement (not shown) depending on a mode of operation.

Similar to the joystick 502, the joystick 504 also has an orientation sensor, and thus the control device 506 can control certain power machine functionality based on a spatial-function map 548 with regions 550, 552, 554, 556, each of which defines a particular function for the excavator when the current orientation of the joystick 504 is located within the particular region. For example, when the joystick 504 is positioned within the region 550, the control device 506 can cause the boom (or arm) to extend outwardly, while when the joystick 504 is positioned within the region 554, the control device 506 can cause the boom (or arm) to retract rearwardly. As another example, when the joystick 504 is positioned within the region 552, the control device 506 can cause the implement (e.g., the bucket) to pivot towards the house, while when the joystick 504 is positioned within the region 556, the control device 506 can cause the implement to pivot away from the house. In some cases, and similar to the spatial-function map 522, the farther the joystick 504 is pivoted from a neutral position 558 into a particular region, the greater the command value that will be provided for the particular function assigned to the particular region. For example, with the joystick 504 positioned within the region 550, the farther the joystick 504 is pivoted away from the neutral position 558, the greater the operator input command for extending the lift arm outwardly (e.g., thereby extending the lift arm at a faster rate) and vice versa. As also discussed below, however, not all control modes may provide commanded movement over an entire range of motion of an operator input device.

As generally noted above, a variety of control-function mappings for operator input devices can be used, to allow operators to efficiently execute a variety of power machine tasks. In some cases, the control-function mapping illustrated for the digging mode of FIG. 5 can be particularly beneficial for digging operations with an excavator, including because tractive power can be commanded to adjust overall position of the excavator using the same operator input devices (i.e., the joysticks 502, 504) as can also control workgroup operations for digging. However, a similar mapping can also be implemented for differently configured power machines, and other mappings can also be useful for excavators (or other power machines).

Figure 6:
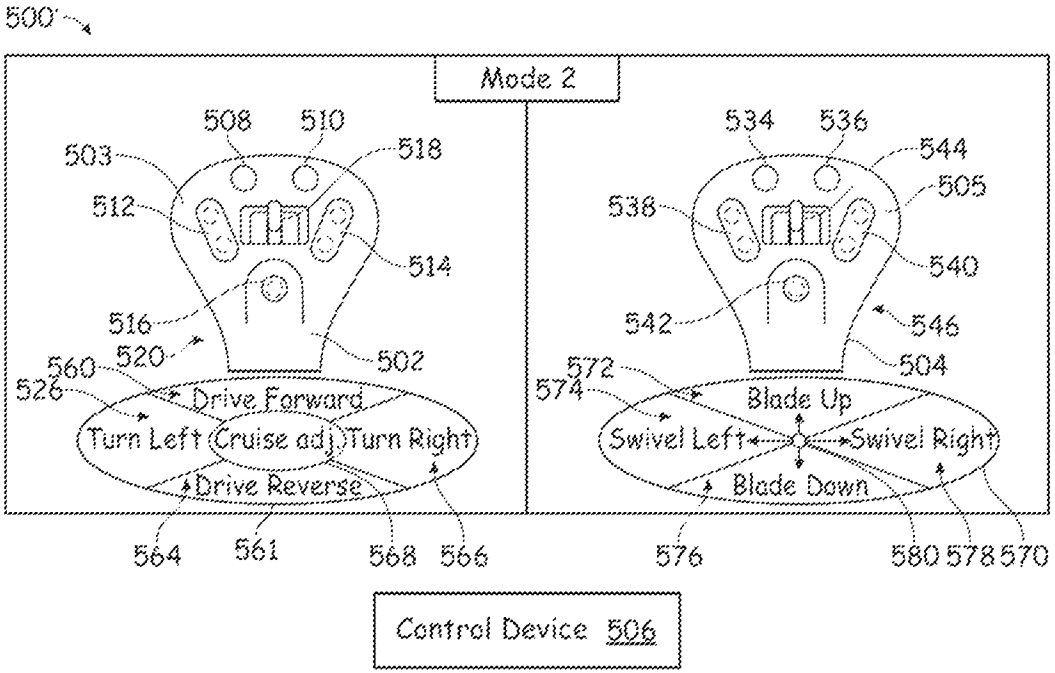
FIG. 6 is a schematic illustration of a configuration of another control-function mapping for the one or more joysticks of FIG. 5, under a second control mode.

In this regard, for example, FIG. 6 shows a configuration of a control-function mapping 500' for the one or more joysticks of an excavator (or other power machine) that provides a second mapping of input commands to operational movements according to a second control mode. In some cases, the illustrated control mode can be a driving control mode, although other configurations are possible. The control-function mapping 500' (and the illustrated control mode) can be implemented using the same joysticks 502, 504 as the control-function mapping 500", and the control device 506 as previously described. Generally, the control device 506 can operate electronically (e.g., as commanded by an operator) to change the mode of operation to the illustrated second control mode, as needed, and can similarly change to a different control mode (e.g., as in FIGS. 5 and 7) thereafter.

Generally, the mechanical operation of the joysticks 502, 504, including the associated buttons, can proceed similarly in any variety of control modes, with changes only to the mapping of particular movements or buttons to particular operational commands. As such, the following discussion with reference to FIG. 6 will assume continued mechanical operability of the joysticks 502, 504 and the associated buttons as similarly described relative to FIG. 5. In some cases, however, tactile or other responses of the joysticks 502, 504 themselves to operator inputs can vary between control modes.

Still referring to the control mode provided by the control-function mapping 500', the buttons 508, 510, for example, can control the offset of the lift arm. For example, when the button 508 is actuated, the control device 506 can cause the lift arm to rotate relative to the house in a first rotational direction (e.g., a counterclockwise direction) by a particular amount. Conversely, when the button 510 is actuated, the control device 506 can cause the lift arm to rotate relative to the house in a second rotational direction (e.g., a clockwise direction) by a particular amount. Continuing, the button 512 can provide two-speed creep adjustment. For example, when the button 512 is actuated to a first position, the control device 506 can command in incremental increase in excavator speed (e.g., relative to a predetermined high- or low-speed setting), whereas when the button 512 is actuated to a second position, the control device 506 can command an incremental decrease in excavator speed.

In the illustrated driving control mode, the button 516 can control the enabling (and disabling) of the drive speed management. For example, when the button 516 is actuated, the control device 506 can cause the joystick 502 to operate according to a specific operator response curve (e.g., that can include only allowing the excavator to reach a speed lower than a maximum allowable speed, while the joystick 502 is commanding a maximum speed). Button 512 is used in this case to increment the drive speed upwards or downwards. The switch 518 can adjust the slew of the house, generally similarly as is controlled by bulk lateral movement of the joystick 502 in the control mode of FIG. 5. In some examples, the button 520 can control activation or deactivation of sustained-speed travel (i.e., semi-automated travel with a set target speed).

In some examples, other devices can be used to stop operation in sustained-speed travel mode. For example, some configurations can include control-function mapping that maps forward (or other) movement of foot levers or pedals to steering commands and that maps rearward (or other) movement of the foot levers or pedals to stop operation in sustained-speed travel mode. Thus, for example, joysticks or other manual input devices can sometimes be used to control workgroup operations (e.g., according to known control-mappings or those presented herein) while foot levers or pedals can be used to control steering and cessation of sustained-speed travel in a sustained-speed travel mode. In different implementations, different operations can be included as part of cessation of sustained-speed travel, including immediate cessation of power delivery to drive motors and gradual cessation of power delivery to drive motors (e.g., to stop the power machine with a target deceleration, within a target stopping distance, within a target stopping time, etc.)

As shown in FIG. 6, when operating in the illustrated control mode, the control device 506 can control certain power machine functionality based on a spatial-function map 561 with regions 560, 562, 564, 566, each of which defines a particular function for the excavator when the current orientation of the joystick 502 is located within the particular region. For example, when the joystick 502 is positioned in neutral position 568, the control device 506 can enable an adjustment in the sustained-speed travel set speed based on small movements of the joystick 502 (e.g., after sustained-speed travel is enabled by the button 520). Further, as similarly described relative to FIG. 5, when the joystick 502 is positioned within the region 560 the control device 506 causes the excavator to drive forward, while when the joystick 502 is positioned within the region 564, the control device 506 causes the excavator to drive in reverse. When the joystick 502 is positioned within the region 562, the control device 506 causes the excavator to turn left, while when the joystick 502 is positioned within the region 566, the control device 506 causes the excavator to turn right. Similar to the first mode of operation, the farther the joystick 502 is away from the neutral position 568, the larger the operator input command for the function associated with the region within which the joystick 502 is located.

Continuing, inputs at the joystick 504 can also be mapped to particular power machine functions according to the illustrated control mode of FIG. 6. For example, when operating in the second mode, the buttons 534, 536 on the joystick 504 can control mode adjustment in a similar manner to operation in the first mode (see FIG. 5). The button 542 can activate or deactivate float functionality for a blade (e.g., as similarly described above relative to a lift arm). For example, when the button 542 is actuated, the control device 506 can cause a blade of an excavator to float, and when the button 542 is actuated again, the control device 506 can stop the floating of the blade. The switch 544 can control auxiliary hydraulics or a thumb for a bucket in a similar manner as the switch 544 operating in the first mode.

Similarly, the switch 546 can also control the auxiliary detent in a similar manner as the switch 546 operating in the first mode.

As shown in FIG. 6, when operating in the second mode, the control device 506 can also command power machine functionality based on a spatial-function map 570 with regions 572, 574, 576, 578, each of which defines a particular function for the excavator when the current orientation of the joystick 504 is located within the particular region. For example, when the joystick 504 is positioned within the region 572 the control device 506 causes the blade to be raised, while when the joystick 504 is positioned within the region 574, the control device 506 can cause the blade to be lowered. When the joystick 504 is positioned within the region 574, the control device 506 can cause the blade to swivel left (e.g., rotate in a counterclockwise direction), while when the joystick is positioned within the region 576 the control device 506 can cause the blade to swivel right (e.g., rotate in a clockwise direction). Similar to the first mode of operation, the farther the joystick 504 is away from a neutral position 580, the larger the operator input command for the function associated with the region that joystick 504 is located in.

Figure 7:
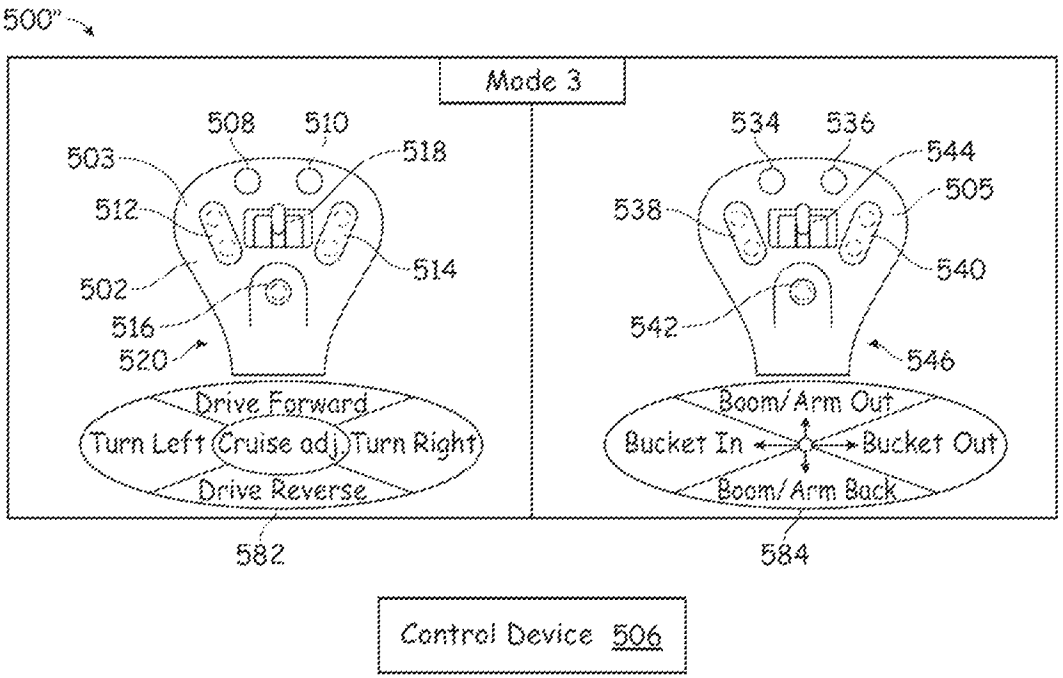
FIG. 7 is a schematic illustration of a configuration of yet another control-function mapping for the one or more joysticks of FIG. 5, under a third control mode.

Continuing, other control modes are also possible, including effectively any variety of mapping of movements and other actuations of an operator input device to any variety of power machine functionality, including the mapping excavator functionality discussed above, other mappings of excavator functionality, or other mappings of power machine functionality generally. In this regard, FIG. 7 shows a configuration of a control-function mapping 500" for the one or more joysticks of the excavator (or other power machine) in a third control mode that corresponds to a hybrid mode of operation (i.e., a combination of driving and digging modes). The control-function mapping 500" can be implemented using the joysticks 502, 504, and the control device 506 previously described, or, as with control modes generally, can be implemented with other operator input devices and control devices.

In the third (e.g., hybrid) control mode, the buttons 508, 510, 512, 516 can function in a similar manner as the buttons 508, 510, 512, 516 operating in the second mode (see FIG. 6). Further, the button 514 can control extension or retraction of an arm (or boom), and the switch 518 can control the slew in a similar manner as the switch 518 operating in the second mode of operation (see FIG. 6). As shown in FIG. 7, when operating in the third mode, the control device 506 can also command functionality based a spatial-function map 582 for the joystick 502, which can be similar to the spatial-function map 561 described above (see FIG. 6).

Referring also to the joystick 504, in the third control mode, the buttons 534, 536 can function in a similar manner as the buttons 534, 536 operating in the second mode (see FIG. 6), and the button 540 can function in a similar manner as the button 540 operating in the first mode (see FIG. 5), although auto-dig functionality may not be available in some cases. Similarly, the button 538 can control raising or lowering of the blade. Similarly, the switch 544 can control an auxiliary system or thumb in a similar manner as the switch 544 operating in the second mode of operation (FIG. 7). As shown in FIG. 7, when operating in the third mode, the control device 506 can also command functionality based on a spatial-function map 584, which can be similar to the spatial-function map 548 described above (see FIG. 5).

While only three modes of operation have been described, any number of control-function mappings (e.g., five mappings or more) can be determined and stored for the joysticks 502, 504 or for other operator input devices. In this regard, for example, any variety of movements of a joystick, actuation of binary or analog buttons, or other operator input can be mapped to variety of one or more particular power machine functions for one particular control mode, and can be mapped to any variety of one or more different (or similar) power machine functions for a different control mode. Thus, for example, operators can selectively control a power machine according to different mappings between input devices and output commands (i.e., in different control modes) as desired for a particular work operations and can readily switch between control modes as desired. In some embodiments, as also discussed above with regard to FIGS. 5-7, it may be particularly useful for operator to retain some tractive control during other operations (and vice versa), even though a typical operator input for tractive control (e.g., a joystick movement) has been mapped, under a current control mode, to a non-drive function (and vice versa). However, some non-drive control modes may not necessarily include tractive control, and some drive control modes may not necessarily include non-tractive control.

In some implementations, particular combinations of control-function mappings can provide particular benefits for operational efficiency. For example, in a first control mode, a first control-function mapping can map a first input type for the first joystick (e.g., forward and backward movement as shown in FIG. 6) to drive commands for travel of the excavator over terrain. Also in that first control mode, a second control-function mapping can map a second input type for a second joystick (e.g., forward and backward movement as shown in FIG. 6) to blade commands to move the blade of the excavator relative to the main frame of the excavator. Further, in some cases, the first control-function mapping can map a third input type for the first joystick (e.g., input at the input interface 520) to slew commands to slew a house of the excavator relative to the main frame. In contrast, the second control-function mapping can map a fourth input type for the second joystick (e.g., inputs received at the switch 544) to boom commands to raise and lower the boom of the excavator relative to the main frame or to otherwise actuate part or all of a lift arm. In some cases, under the first control mode discussed immediately above, neither of the first or second control-function mappings maps any input type of either of the first or second joysticks to commands to one or more of: move the arm of the excavator relative to the boom, or move the implement of the excavator relative to the arm. In some cases, in such a control mode, operator input at traditional input devices for tractive commands (e.g., foot pedals or levers) can be ignored, at least relative to drive operations of the power machine.

Figure 8:
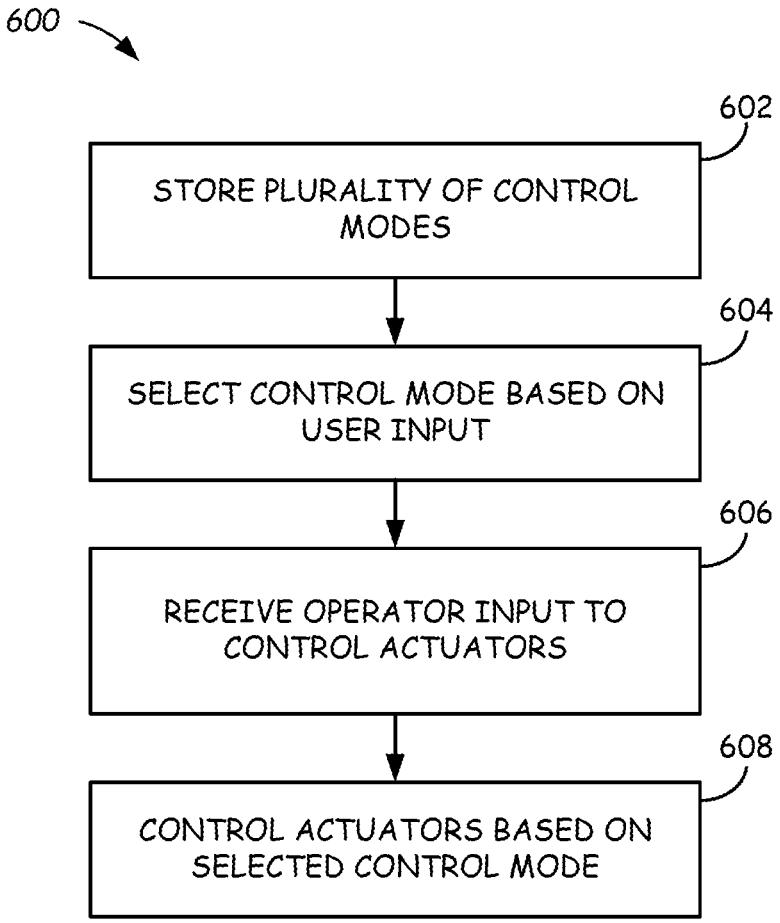
FIGS. 8 through 10 are flowcharts of processes for operating a power machine using different control modes.

As generally discussed above, some embodiments can include systems or methods for selectively switching between particular control modes. As illustrated in FIG. 8, for example, a computer-implemented process 600 can include storing 602 a plurality of control modes for a power machine. For example, a memory of a power machine can store a plurality of mappings of operator inputs (e.g., joystick movements, button actuations, etc.) to a corresponding plurality of power machine functionality (e.g., tractive and workgroup functionality). In some cases, an operator may be able to customize a particular control mode (e.g., customize a particular control-function mapping), and the customized control mode can be stored 602. In some cases, control modes can be pre-stored 602 and may not necessarily be subject to modification by operators.

Before a power machine is operated to execute a particular task, one of the stored 602 control modes can be selected (604. For example, a power machine may automatically implement a default control mode or may automatically implement a particular control mode based on current operating conditions or other factors, or an operator may select a particular control mode that is desired for a particular time or task (e.g., using a default or other control-function mapping, as generally discussed above). Once a control mode has been selected 604, operation of particular actuators can be controlled 608 based on received 606 operator commands, according to the selected 604 control mode. For example, as discussed relative to FIGS. 5-7 above, a control system can command particular actuators based on a particular mapping of joystick inputs that corresponds to the selected 606 control mode. As desired, part or all of the process 600 can then be repeated, including to switch between control modes, as desired.

In some embodiments, as also generally discussed above, operator input commands can be modified relative to the degree of commanded movement as well as the nature of the commanded movement. Regarding the nature of the commanded movement, for example, different types of control inputs can sometimes be mapped to different types of power machine functions according to different control modes, including as discussed relative to FIGS. 5-7. Accordingly, for example, a particular type of operator input can be mapped to different types of actuator control (e.g., control of different actuators) in different control modes. As also discussed above, example types of operator inputs can include movement of a joystick along a particular movement axis (e.g., front-to-back, or laterally side-to-side) or in a particular direction (e.g., forward or laterally to the left), actuation of a particular button or other interface (e.g., with on/off or more variable input), movement of another type of input interface in a particular way (e.g., forward or backward movement of known designs of levers or foot pedals), etc. Relatedly, regarding the degree of commanded movement, some control systems can be configured to provide a variety of different responses (or command outputs) based on the same operator input, depending on a particular system response that is to be implemented at the relevant time. For example, based on operator-requested modifications to a control mode, system response for certain components or functions may be reduced in magnitude (e.g., by a predetermined percentage), but not changed in nature, for a given operator input.

Figure 9:
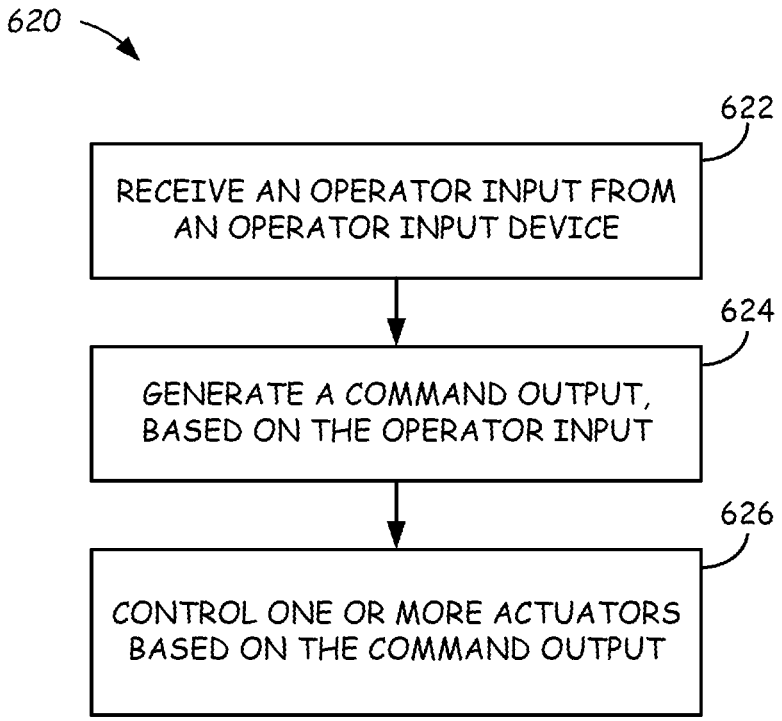

In this regard, FIG. 9 illustrates a computer-implemented process 620 for operating an excavator (or other power machine), which can allow for a particular operator input to be translated into a variety of command outputs for actuator movement (or other functionality). For example, the process 600 can include a computing device receiving 622 an operator input from an operator input device (e.g., of an excavator). In some cases, the operator input can include an orientation (e.g., from a joystick), an indication of actuation of an actuatable button, etc. Continuing, a computing device can then generate 624 a command output, based on the received 622 operator input. In some cases, the operator input can simply be passed directly (i.e., without modification) to a relevant actuator or other component of a power machine. In some cases, the received 622 operator input can be modified (e.g., scaled) based on a response curve, to generate a corresponding command output. The generated 624 command output can then be transmitted using appropriate communication channels, to control 626 one or more actuators (e.g., of an excavator) based on the command output.

Figure 10:
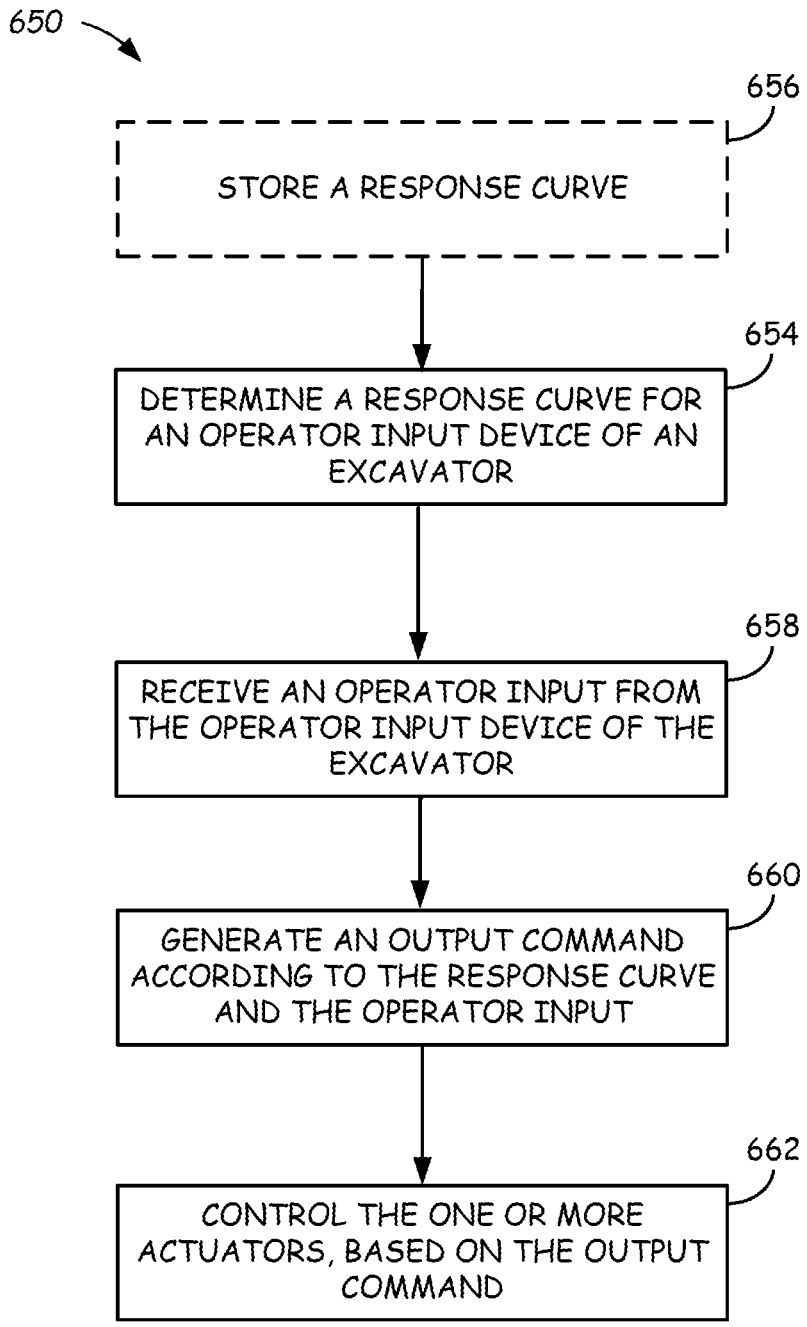

More specifically, referring to a computer-implemented process 650 of FIG. 10, a computing device can sometimes implement operator commands by first determining 654 a response curve for an operator input device of a power machine. For example, a computing device can identify a current control mode (e.g., a digging mode), which may already be associated with an associated response curve for relevant operator input devices. As another example, a computing device can include receiving an operator selection of a response curve (e.g., for a particular operator input device). In some cases, a computing device can determine 654 a response curve for a region of a spatial-function map for a joystick (e.g., the region 560 of the spatial-function map 561 for the joystick 502), so that commands indicated by movement of the joystick can be modified accordingly.

In some embodiments, a computing device can determine a response curve for an operator input device or other control mode parameter based on previous operator input data or based on preferences or other settings for a particular operator or operation. For example, a control device may sometimes identify an operator based on login credentials or codes and then determine 654 a corresponding response curve (or set of possible response curves) accordingly.

In some embodiments, the process 650 can permit an operator to customize a response curve, including as discussed below. Correspondingly, the process 650 can sometimes include storing 656 a particular response curve for a particular user (or operational mode). In some cases, the response curve can be stored in the computing device's memory to be easily retrievable at a later time. In some cases, as also discussed below, an operator may modify (e.g., customize) a particular response curve and the modified response curve can be stored 656 accordingly (e.g., along with multiple other modified response curves, or multiple control modes generally).

Once a response curve has been determined 654, the process 650 can include a computing device receiving 658 an operator input from the operator input device of a power machine. As generally discussed above, the operator input device can be a joystick, an actuatable button, a switch, or other components. Further, a determined 654 response curve can be implemented in some cases relative to multiple input devices, or multiple response curves can be determined 654 for multiple input devices.

Continuing, a computing device can then generate 660 an output command according to the determined 654 response curve and the received 658 operator input. For example, a computing device can input the operator input into a function (or relationship) that characterizes the response curve to generate 660 a corresponding output command, or can compare a value of a received 658 operator input to a lookup table that corresponds to a determined 654 response curve (and interpolate accordingly, as needed). In some cases, a single operator input can yield a single generated 660 output command for a single actuator or can yield multiple generated 660 output commands for different actuator.

Finally, the process 650 can include controlling 662 the one or more relevant actuators, based on the generated 660 output command. In some cases, this can include a computing device directly commanding movement of one or more actuators, indirectly commanding movement of the one or more actuators via control of an intervening component, or otherwise employing known approaches to electronically control one or more actuators including extending (or retracting) the one or more actuators. For example, when an actuator is a rotational actuator (e.g., including a motor), a computing device can provide a current signal to cause the rotational actuator to rotate in a particular rotational direction. In some cases, a computing device can adjust a position of an actuatable valve thereby adjusting hydraulic flow through the corresponding actuator, according to the output command (e.g., the output command corresponding to the position of the actuatable valve) to move the actuator.

Figure 11:
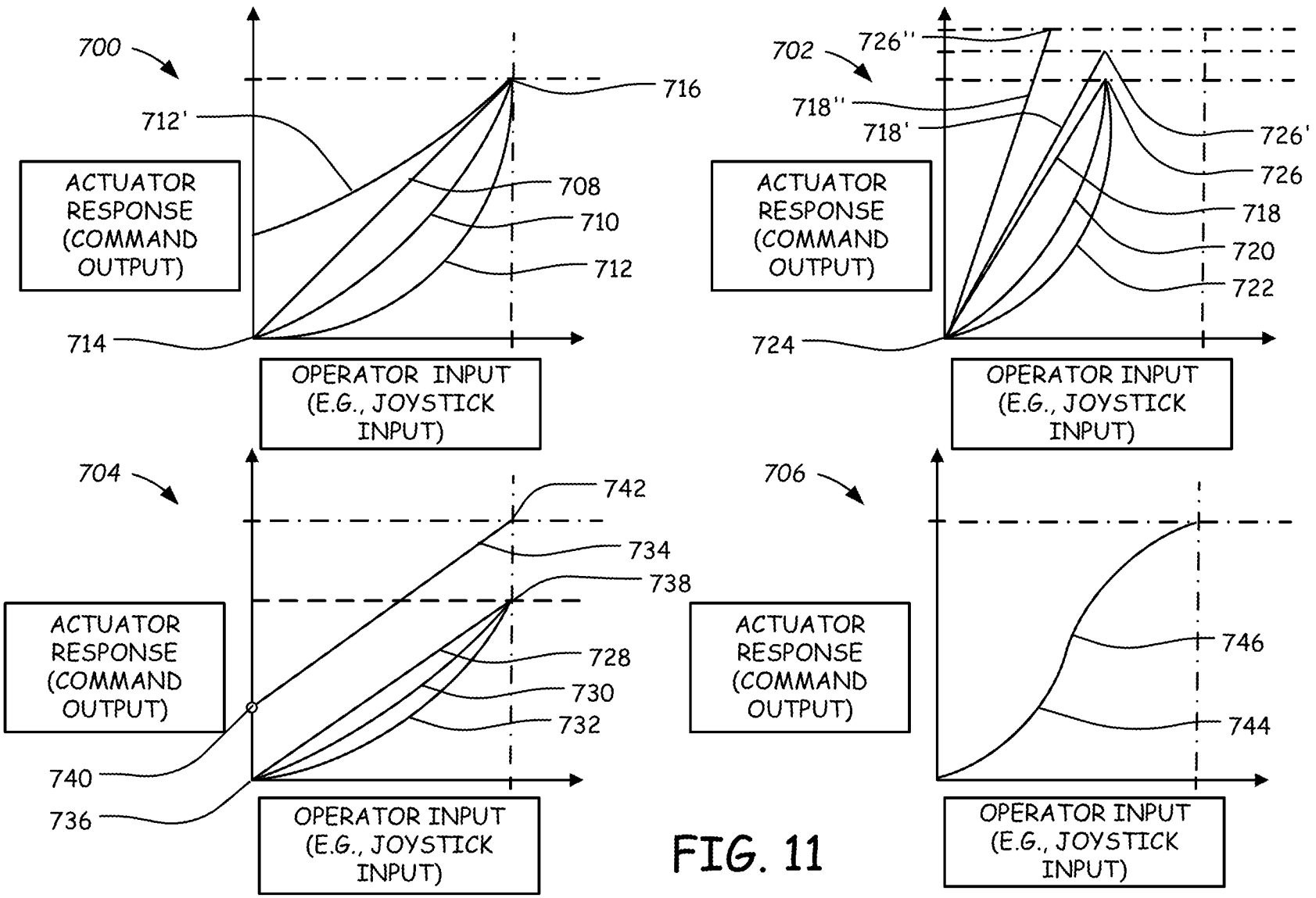
FIG. 11 shows four graphs of response curves for an operator input device of a power machine.

In different embodiments, as also noted above, a response curve for a particular operation, actuator, or operator, can be adjusted in order to provide improved performance of a power machine. In this regard, for example, FIG. 11 shows four graphs 700, 702, 704, 706 of response curves for control of an actuator based on operator commands at an operator input device (e.g., the joystick 502). Each of the graphs 700, 702, 704, 706 shows a set of example command outputs (y-axis) verses operator input (x-axis) in normalized values. In one example, the command outputs can correspond to control of one or more actuators for a lift arm (e.g., boom, arm, or other cylinders of an excavator) or of one or more tractive elements (e.g., actuators to drive left or right tracks of an excavator). However, the principles illustrated and discussed herein can be implemented relative to any variety of actuators, commanded operations, and power machines.

Generally, the illustrated outputs and inputs correspond to electronic signals with, for example, the value of the output/input on the graph corresponding to a magnitude (or relative magnitude) of the electrical current or voltage of the relevant signal. However, those of skill in the art will recognize that signals for operator input and command output can be transmitted and received in various ways.

The graph 700 shows three different response curves 708, 710, 712 that each share a common minimum point 714 and a common maximum point 716. The minimum point 714 corresponds to the command output for no operator input (e.g., an operator input value of "0"), which in this case is also no command output (e.g., a command output value of "0"). The maximum point 716 corresponds to the command output for a maximum operator input value, which in this case is the maximum for the operator input device and the output command (as illustrated by the dash-dot lines extending from both axes). However, the path between the minimum and maximum points 714, 716 varies among the illustrated response curves 708, 710, 712. Accordingly, the same progression of operator inputs can produce a different progression of actuator response, depending on which of the response curves 708, 710, 712 is used (e.g., depending on the particular operator, or particular control mode being implemented).

In particular, the curve 708 is linear, and so the command output is proportional for each operator input value. Thus, every particular amount of movement (or other actuation) of the operator input device, can cause each commanded actuator to move a proportional amount (e.g., due to the command output value being proportional, and the actuator being moved by application of the command output value to the actuator). However, the response curves 710, 712 are not linear, but rather are exponential curves, with the curve 712 being situated below and having a larger curvature vector than the curve 710. Stated another way, the slope of each curve 710, 712 increases to greater and greater values the greater the operator input value (e.g., the farther the joystick is moved away from a neutral position). Thus, for each curve 710, 712 a given change in operator input value does not translate into a proportional change command output value, but rather varying changes as the command output value increases or decreases (e.g., depending on the current orientation of the joystick). In other words, as the operator input value increases (e.g., the joystick is moved away from a neutral position), additional unit increases in operator command value cause greater and greater corresponding increases in the command output value.

Correspondingly, for operation based on the response curves 710, 712, as compared to the response curve 708, the relevant operator input device can effectively become more sensitive the farther the operator input device is moved toward a maximum range of travel. Thus, for example, an operator may be able to initially move a joystick by a substantial distance, with only slight increase in actuator response, as may help operators, for example, to ease into particular commanded movements or to execute fine control with relatively small input movements. However, the operators may still be able to obtain maximum actuator response at maximum operator input, so that overall ranges of motion or speed of certain power machine operations may not be constrained, and commanded movements may still be possible for the entire range of movement of an input actuator. Further, although the curves illustrated in graph 700 may be optimal in some cases, other response curves sharing the points 714, 716 can be used in some cases, including those with reversed curvature (i.e., steeper initial increases in actuator response and less steep approaches to maximum) or more complex shapes (e.g., as discussed relative to graph 706).

In some cases, the linear curve 708 can serve as a default-mode response curve to define the default correspondence between operator inputs and commanded movements of actuators. However, in other examples, other default curves are possible, including default curves that can be customized by operators or based on other inputs. Correspondingly, modifications of default curves to provide particular operating modes (e.g., as discussed above and below) can vary from the particular modifications expressly presented in the examples of FIG. 11 (e.g., may differ in scale, offset, curvature and profile details of any included nonlinearities, etc.).

As also shown in FIG. 11, the graph 702 also has response curves 718, 720, 722 that share a common minimum point 724, and a common maximum point 726. Similar to the graph 700, the curve 718 is linear, while the curves 720, 722 are exponential curves, with the curve 722 situated below the curve 720. The minimum point 724 is situated at the origin, similar to the minimum point 714 of graph 700, so that zero operator input value corresponds to zero command output. However, the maximum point 726 corresponds to maximum allowable command output at an operator input value of less than the maximum allowable operator input value (as shown by dash-dot lines). Accordingly, when control of a power machine function proceeds according to one of the response curves 718, 720, 722, the operator input device does not have to be moved to a maximum orientation (or otherwise maximally actuated) to elicit the maximum actuator response. This may be useful, for example, in order to allow operators to exploit the full range of actuator response with relatively small inputs at an operator input device (e.g., relatively small movements of a joystick).

As another example, the graph 704 includes response curves 728, 730, 732, 734. Each curve 728, 734 is linear, while each curve 730, 732 is an exponential (or parabolic, etc.) curve. Each of the curves 728, 730, 732 share a common minimum point 736 and a common maximum point 738. The minimum point 736 is similar to the previous graphs 700, 702. However, the maximum point 738, corresponding to a maximum allowable operator input value, also corresponds to a command output value that is less than the maximum allowable command output value. For example, in some cases, the command output value can be about 50% (i.e., 50%±5%) of the maximum allowable command output value. In this way, when a control system operates according to one of the response curves 728, 730, 732, the operator input device can effectively operate with more sensitivity, corresponding to generally smaller increases in actuator commands for a given increase in operator input. Accordingly, although maximum operator input may result in less than maximum command output, an operator may be able to implement relatively finely controlled movements.

In some cases, a control system can be configured to selectively apply a reduction in an effective maximum command output, as can correspond to a reduction in maximum speed (or other metric) for select actuators. For example, the response curves 728, 730, 732 may sometimes be implemented based on an operator input that commands a reduction in effective maximum command output (see point 738) to be below the maximum allowable command output (see horizontal dot-dash line). In some cases, for example, an operator may provide an input specifying that maximum travel speed should be reduced (e.g., by a select percentage). As a result, a response curve can be automatically modified (e.g., from the curve 708 to the curve 728) so that maximum operator input commands for tractive actuators correspond to a correspondingly reduced actuator response relative to the maximum allowable actuator response (i.e., a correspondingly lower effective maximum actuator response). In some cases, a commanded reduction in effective maximum command output can correspond to a commanded reduction for a set of multiple actuators, including all workgroup actuators, all tractive actuators, or all ancillary actuators. In some cases, a commanded reduction in effective maximum command output can correspond to a commanded reduction for a set of actuators associated with a particular operation or power machine subsystem. In some cases, a commanded reduction in effective maximum command output can correspond to a commanded reduction for only a single actuator.

In some cases, an original or modified response curve can exhibit a vertical offset, so that an incremental initial non-zero operator input effectively corresponds to a step increase in actuator response. As one example, the curve 734 has a maximum point 742 that is similar to the maximum point 716 of the graph 700 (i.e., corresponds to maximum operator input and maximum allowable actuator response), but a minimum point 740 has been shifted upwardly along the command output axis, so that a lower range of command output values effectively do not correspond to any operator input values. (However, the minimum point of the curve 734 may still effectively correspond to the point 736, so that when no operator input is received (e.g., a joystick is in a neutral position), no command output value is generated.) Thus, with the minimum point 740 shifted upwardly, a substantially non-zero operator input value (i.e., a value greater than 5% of a maximum) will cause a corresponding step-like impulse in a command output value, as effectively defined by the intercept of the response curve with the command output axis. In this way, a rapid increase in commanded actuator movement can be completed for tasks that do not require fine movements at beginning portions of the movement sequence.

As illustrated on the graph 704, a shifted-intercept response curve (e.g., the curve 734) can sometimes result in greater effective maximum actuator response than other response curves. However, other results are possible. For example, as shown on the graph 700, an intercept-adjustment modification of the curve 712 to the curve 712' (e.g., based on operator input) may provide both a step increase in actuator response and a maximum value that corresponds to maximum allowable actuator response. The curve 712', for example, may provide a flatter and therefore finer-controlled response similar to the curve 732 of the graph 704, while also supporting higher actuator speeds, up to and including maximum allowable speed. However, other intercept-adjusted curves can provide other characteristic responses.

As also generally noted above, some response curves can exhibit complex curvature, including as may include one or more inflection points. Still referring to FIG. 11, for example, the graph 706 includes a response curve 744 that has at least one inflection point 746. As illustrated, the inflection point 746 can allow for particular changes in actuator response, depending on the current operator input value (e.g., the current orientation of the joystick). For example, below the inflection point 746 greater changes in actuator response are provided for a given change in operator input (e.g., a given amount of movement of a joystick), as may allow for relatively fine control with relatively small movements. In contrast, above the inflection point 746, lesser changes in actuator response are provided for a given change in operator input (e.g., a given amount of movement of a joystick), as may allow for quicker increases toward maximum allowable actuator response. In this way, for example, end portions of tasks can be completed more quickly, with the beginning portions of tasks allowing for finer movements (and vice versa, in the case of an inverted version of the response curve 744).

In some cases, part or all of a response curve can be represented as a polynomial with a number of degrees greater than or equal to three. For example, as illustrated in FIG. 11, the response curve 744 is a third order polynomial having the inflection point 746 that is situated roughly midway between the maximum and minimum allowable operator input values. In some cases, as also noted above, part or all of a response curve can be represented as a linear or an exponential function. In some cases, a single continuous function may not necessarily describe an entire response curve, and some response curves can be stored (and referenced) simply as discrete numerical values in a lookup table, between which interpolation may be required.

While each of the response curves of the graphs 700, 702, 704, 706 are generally grouped and described above relative to a single characteristic (e.g., intercept offset, shifted maximum value(s), curve shape), in other configurations a response curve can be generated that includes any combination of these characteristics. For example, a response curve can have a maximum point that is less than the maximum allowable command output value, a maximum point that is less than the maximum allowable operator input value, an intercept with the command output axis that is greater than zero, any number of inflection points (e.g., zero), etc.

In some embodiments, a respective response curve can be provided (e.g., generated) for each of multiple operator input devices (e.g., each joystick and each pedal). In some embodiments, a single response curve can be provided that for multiple operator input devices (e.g., as may correspond to all input devices used to command a particular tractive or workgroup function). In some embodiments, different response curves can be provided for different functions of an operator input device. Thus, for example, each region of a spatial-function map of a joystick can have its own response curve, each joystick can have its own response curve, each actuatable button of a joystick can have its own response curve, a single input device (e.g., joystick) may be operated under different response curves for different respective functions, etc.

As a more specific example, regarding a joystick with multiple regions of a spatial-function map that correspond to different functions, a separate response curve can sometimes be set for each region or function. In this way, for example, the response curve for movement of a joystick along a first axis (e.g., to control slew as shown in FIG. 5) may be different from the response curve for movement of the joystick along a second axis (e.g., to control arm (or boom) movement as shown in FIG. 5). Similarly, in some cases, modifications to a response curve can sometimes be applied relative to all or part of a control-function map. For example, a modification to a response curve to reduce effective maximum command output can be applied to certain regions of a spatial-function map (e.g., regions 560, 564 in FIG. 6, for forward and reverse travel) but not to other regions of the spatial-function map (e.g., regions 562, 566 in FIG. 6, for turning commands).

In some embodiments, a particular response curve or set of response curves can be identified as corresponding to a particular control mode or operating mode. For example, response curves that provide relatively precise and smooth control (e.g., as in the graph 704) may be associated with a grading mode, whereas response curves that provide a faster but potentially less precise response (e.g., as in the graph 702) may be associated with a digging mode. In some cases, response curves that are relatively more balanced between precision and speed (e.g., as in the graph 700) can be associated with a trenching mode. Further, other response curves (e.g., as in the graph 706) can be associated with a driving mode or other modes, as desired.

In some cases, particular operating-mode response curves can provide particular types of mappings of operator input signals to actuator command signals, including as can be usefully tuned for particular types of power machine operations. For example, relative to a default response curve (e.g., a linear curve, or a curve with no offsets), a trenching-mode response curve can exhibit increased maximum workgroup speed or reduced workgroup response. In other words, under a trenching mode a larger maximum speed can be permitted for one or more workgroup actuators (e.g., boom or arm actuators, etc.) or a smaller-magnitude input can be required from an operator (e.g., a smaller displacement of a joystick or switch from neutral) to command any particular actuator speed (e.g., so that a smaller-magnitude maximum operator input is required to command the maximum actuator speed). In this regard, referring again to FIG. 11 and treating the curve 708 as an example default-mode response curve, the curves 718, 720, 722 can provide examples of trenching-mode response curves with reduced workgroup response but not increased maximum workgroup speed, and the curve 718' can provide an example of a trenching-mode response curve with reduced workgroup response and increased maximum workgroup speed (i.e., to maximum speed 726').

In some examples, a trenching mode can generally correspond to a digging mode (e.g., can be one type, or an only type, of a digging mode). In some examples, a particular digging-mode response curve can be provided that is distinct from a particular trenching-mode response curve. In some examples, a digging mode can provide still further increased maximum workgroup speed or still further reduced workgroup response as compared to default and trenching modes. For example, continuing the example immediately above, the curve 718" can provide a digging mode with still further increased maximum speed (i.e., to maximum speed 726") and still further decreased response as compared to the trenching modes represented by curves 718, 720, 722, 718'.

As another example, relative to a default response curve (e.g., a linear curve, or a curve with no offsets), a grading-mode response curve can exhibit decreased maximum workgroup speed and increased workgroup response. In other words, under a grading mode a smaller maximum speed can be permitted for one or more workgroup actuators (e.g., tilt or lift actuators, etc.) or a larger-magnitude input can be required from an operator (e.g., a larger displacement of a joystick or switch from neutral) to command any particular actuator speed (e.g., so that a larger-magnitude maximum operator input is required to command the maximum actuator speed). In this regard, treating the curve 708 as an example default-mode response curve, the curve 728 can provide an example of a grading-mode response curve with a reduced maximum speed but not reduced workgroup response, and the curves 730, 732 can provide examples of a grading-mode response curve with reduced workgroup response, at least near the origin, and reduced maximum speed (i.e., to maximum speed point 738).

Thus, a control system can operate not only based on a large number of different control-function mappings for operator input devices (e.g., as discussed relative to FIGS. 5-8), but also based on a large number of different response curves, as may appropriately support a particular operator, power machine configuration, tractive operation, workgroup operation, or other requirement. In some cases, as also generally discussed above, particularly optimal combinations of control-function mappings, response curves, or both can be assigned to different control modes, as may effectively support a variety of different operation modes (e.g., for particular tasks including digging, grading, driving, mowing, etc.).

Figure 12:
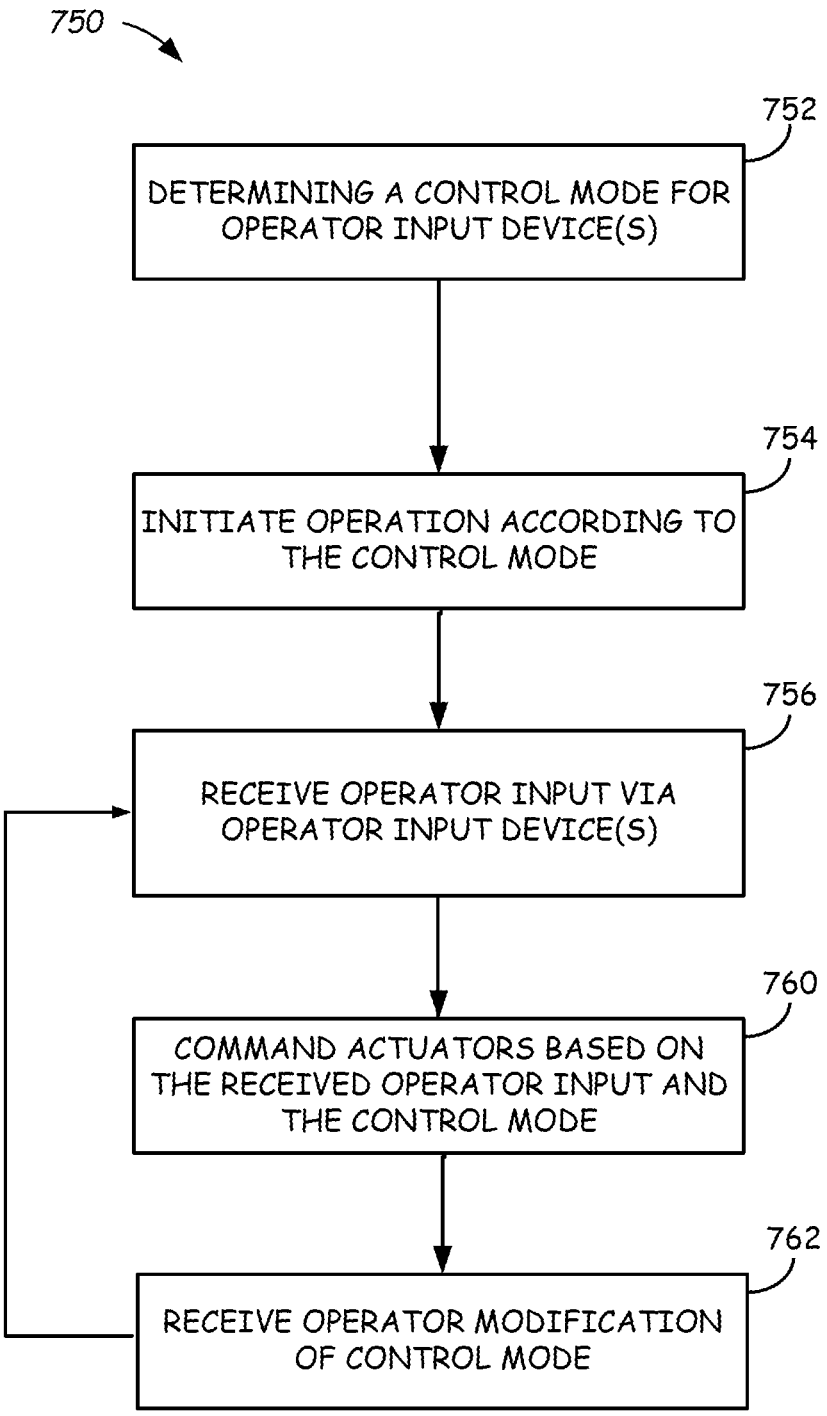
FIG. 12 is a flowchart illustrating a process for operating a power machine under modifiable control modes.

Further in this regard, FIG. 12 shows a flowchart of a process 750 for operating an excavator (or other power machine), which can be implemented using one or more computing devices (e.g., either of the control device 408, 506 of FIGS. 4-7) and one or more operator input devices of various known configurations. In some embodiments, the process 750 can include a computing device determining 752 a control mode for operation of one or more operator input devices (e.g., joysticks) of an excavator or other power machine. In some cases, this can include a computing device receiving an operator input from an actuatable button (e.g., the buttons 534, 536 of FIG. 5). In other cases, this can include a computing device receiving an operator input from another operator input device (e.g., a touchscreen display of an excavator, a smartphone, etc.). In some cases, determining 752 a control mode can include receiving a modification or selection of a response curve, or can include automatically determining a response curve based on other factors (e.g., an operational profile, an operation mode of the power machine, etc.). In some cases, determining 752 a control mode can include applying a particular mapping of operator inputs to corresponding operations (e.g., as discussed relative to FIGS. 5-8).

Continuing, the process 750 can include a computing device initiating 754 operation (e.g., of the one or more operator input devices) according to the determined 752 control mode. In some cases, initiating 754 operation according to a control mode can include a computing device retrieving (e.g., from local memory) one or more corresponding control-function mappings for relevant operator input device(s), including mapping of particular functions to input regions, to actuatable buttons, etc. according to the control mode. In some cases, initiating 754 operation according to a control mode can include identification of response curves for particular input devices or actuators (e.g., for each function, for each actuator, for groups of functions or actuators, etc.).

To allow operator control of actuators, the process 750 can also include a computing device receiving 756 an operator input corresponding to a commanded movement of an actuator. For example, a computing device can receive an indication of a joystick command to move a lift arm, travel over terrain, executed automated or semi-automated tasks, etc. The process 750 can then include a computing device commanding 760 movement of actuators based on the received 756 operator input and the determined 752 control mode. For example, as discussed above, particular response curves and control-function mappings can result in a control system implementing particular electronic actuator commands in response to particular operator inputs in a first control mode, and different actuator commands in response to the same (or different) operator inputs in a second control mode.

In some cases, as also discussed above, various modification of response curves or other aspects of a control mode can be implemented, including to provide improved operator efficiency or comfort, or to better accommodate the needs of particular work (or travel) operations. Correspondingly, the process 750 can further include receiving 762 operator (or other) modifications to a control mode. In some cases, as also discussed above, received 762 modifications can include adjustments to response curves (see, e.g., FIG. 11), changes to control-function mapping for one or more operator input devices, or combinations of these or other changes. In some cases, as also noted above, received 762 modifications can include percent reductions in allowed speeds of workgroup components or functions, or percent reductions in allowed travel speeds. In some cases, modifications can be received 762 based on operation of sliders, toggles, knobs, or other input interfaces by an operator, including to thereby modify a particular response curve. In some cases, modifications can be received 762 based on selection by an operator from among one or more predetermined options.

After receiving 762 an appropriate modification to a control mode, the process 750 can thus include further receiving 756 operator input and then commanding 760 actuator movement based on the received 756 input and the received 762 modification of the control mode. In some cases, although not expressly shown in FIG. 12, certain systems or processes may sometimes need to be initiated 754 (e.g., as described above relative to control-function mapping and response curves), or re-initiated 754, after a control mode modification is received 762.

Figure 13:
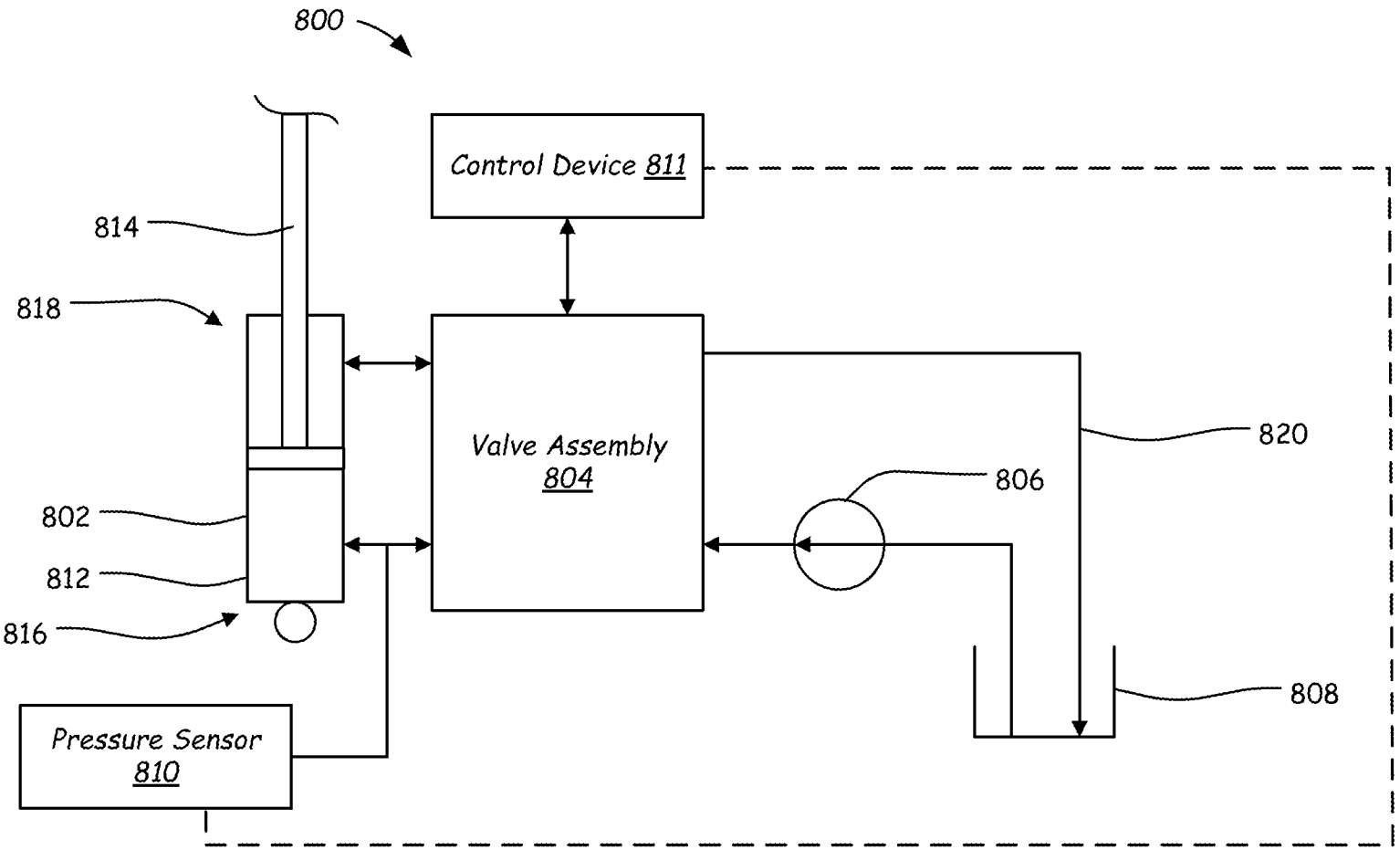
FIG. 13 is a schematic illustration of a control system for a power machine actuator.

FIG. 13 shows a schematic illustration of aspects of control system 800 for an excavator (or other power machine), including electronic control components that can be implemented as a specific example of the control system 160 (see FIG. 1), the control system 400 (see FIG. 4) or a portion thereof, and hydraulic components that can be implemented as part of the hydraulic system 403 (see FIG. 4) or as part of other hydraulic systems. The control system 800 can include an actuator 802, a valve assembly 804, a pump 806, a reservoir 808, a pressure sensor 810, and a control device 811.

The actuator 802 can be implemented in different ways, including as any one or more of the previously described actuators (e.g., one or more of the actuators 422, 424, 426 of FIG. 4). For example, the actuator 802 can be a boom actuator, a lift actuator, an implement carrier actuator, etc. The actuator 802 an include a cylinder 812, and piston 814 moveable within the cylinder 812 by movement of hydraulic fluid into or out of the cylinder 812 at the base end 816 and the rod end 818 of the cylinder 812.

The valve assembly 804 can be in hydraulic communication with the actuator 802, the pump 806, and the reservoir 808, and can exhibit any variety of known configurations for selective control of hydraulic flow relative to an actuator (e.g., a linear actuator as shown in FIG. 13). Thus, for example, the valve assembly 804 can include one or more valves that can be electrically (or otherwise) actuated by the control device 811 to adjust the routing of hydraulic fluid into or out of the base end 816 and rod end 818 of the actuator 802. For example, depending on the current positions of one or more valves of the valve assembly 804, pressurized flow from the pump 806 can be directed by the valve assembly 804 into the base end 816 of the cylinder 812 and out of the rod end 818 of the cylinder 812 to extend the piston 814, or into the rod end 818 of the cylinder 812 and out of the base end 816 of the cylinder 812 to retract the piston 814. Additionally, control of the valve assembly 804 can sometimes impose a selected pressure drop on flow between an actuator (e.g., the actuator 802) and the reservoir 808, including through electronic actuation of proportional control valves or other known approaches. Thus, in some cases, the control device 811 can actively change a valve position of one or more valves of the valve assembly 804 to guide hydraulic flow into or out of either end 816, 818 of the cylinder 812 to maintain a selected hydraulic pressure (or pressure profile over time) for the cylinder 812.

In some embodiments, the control device 811 can adjust the one or more valves of the valve assembly 804 to controllably route (e.g., drain) fluid back to the reservoir 808. For example, when one or more valves of the valve assembly 804 are positioned accordingly (e.g., opened by a particular amount) by the control device 811, hydraulic fluid located within the cylinder 812 at the base end 816 can flow along a flow path through the valve assembly 804 back to the reservoir 808 (e.g., via a flow path 820). In this way, when the piston 814 is commanded to retract, the piston 814 retracts according to the loading force on the piston 814 and the hydraulic pressure of the hydraulic fluid within the cylinder 812 at the base end 816. Similarly, when one or more valves of the valve assembly 804 are positioned accordingly (e.g., opened by a particular amount) by the control device 811, hydraulic fluid located within the cylinder 812 at the rod end 818 can flow along a flow path through the valve assembly 804 back to the reservoir 808 (e.g., along the flow path 820). In this way, when the piston 814 is commanded to extend, the piston 814 extends according to the loading force on the piston 814 and the hydraulic pressure of the hydraulic fluid within the cylinder 812 at the rod end 818.

In some embodiments, the ability to controllably route hydraulic fluid from the base end 816 of the actuator 802 and to the reservoir 808 can be particularly advantageous. This is accomplished by providing a path of flow from the base end of the cylinder to a low pressure reservoir (as well as the rod end). For example, and as described in more detail below, when the actuator 802 is a boom actuator of a lift arm, the retractive loading of the piston 814 from the weight of the work group (e.g., including a bucket attached to the lift arm) can drive the lowering of a lift arm without necessarily requiring active pressurization of the rod end 818 of the cylinder 812 by the control system 800. In other words, the weight of the lift arm can force hydraulic fluid out of the cylinder 812 at the base end 816 and into the reservoir 808. Generally, operation of a lift arm to move based primarily on external forces on the lift arm (i.e., so that an upward or downward external force causes upward or downward movement of the lift arm, respectively) can be referred to as float operation.

In some cases, the flow rate of the hydraulic fluid out of the cylinder 812 at the base end 816, as controlled by the valve assembly 804, can dictate the hydraulic pressure of hydraulic fluid at the base end 816 of the cylinder 812. In this way, for example, the lowering speed of the lift arm can be actively controlled by controlling the valve assembly 804 to impose a particular pressure drop between the base end 816 of the cylinder 812 and the reservoir 808 and thereby actively control pressure at the base end 816.

In some embodiments, pressure within the cylinder 812 can be actively monitored to inform control of the valve assembly 804 for float (or other) operations. In some embodiments, the pressure sensor 810 can be in fluid communication with the base end 816 of the cylinder 812 to sense the hydraulic pressure of hydraulic fluid within the cylinder 812 at the base end 816. For example, as shown in FIG. 13, the pressure sensor 810 is in fluid communication with a port that receives hydraulic fluid from (or emits hydraulic fluid into) the valve assembly 804 and the base end 816. Further, the pressure sensor 810 can be in communication with the control device 811 so that the control device 811 can receive signals corresponding to pressure measurements from the pressure sensor 810. Generally, the pressure sensor 810 can have any variety of known configurations, including with the pressure sensor 810 configured as a capacitive pressure sensor, a piezoelectric pressure sensor, etc.

While only a single actuator 802 has been described with reference to the control system 800, it is appreciated that the control system 800 can include other actuators that are similarly constructed as the actuator 802. In some cases, the control system 800 can include multiple actuators, each configured as a different actuator of an excavator (or other power machine), and each controlled by the valve assembly 804 (e.g., in a similar manner as the actuator 802).

Figure 14:
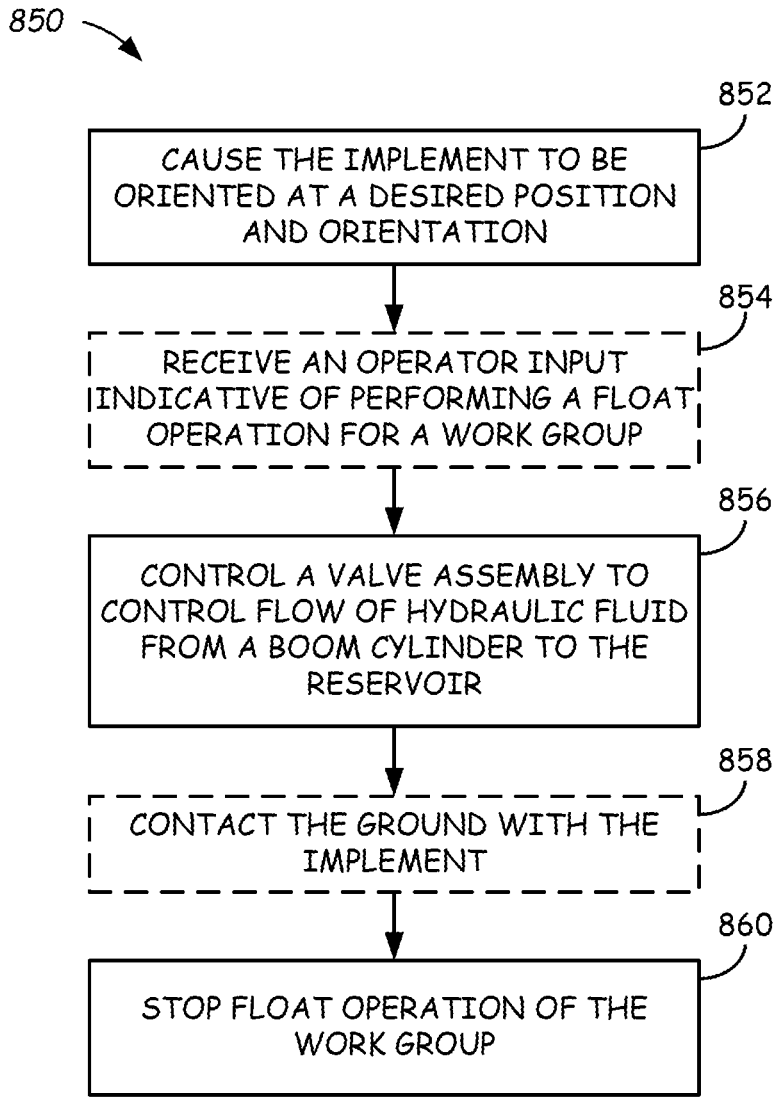
FIG. 14 is a flowchart of a process for performing float operations for a work group of a power machine.

FIG. 14 shows a flowchart of a process 850 for performing a float operation for a work group of an excavator (or other power machine), which can be implemented using one or more computing devices (e.g., either of the control devices 408, 811). Although certain operations of the process 850 are discussed below relative to control of hydraulic flow to and from a boom actuator, similar operations can also be applied relative to other actuators.

At block 852, the process 850 can include a computing device causing an implement (e.g., a bucket) to be oriented at a desired position (e.g., by extending or retracting the implement carrier actuator). In some cases, block 852 can include receiving input from an operator to command a particular position of an implement. In some cases, block 852 can include orienting the bucket so that the teeth of the bucket are oriented with a vertical component relative to the ground (e.g., so that the teeth can dig downwardly into the ground upon contact). In other words, the bucket can be oriented so that the teeth are not substantially parallel to the ground. In other cases, however, other orientations may also be appropriate.

At block 854, the process 850 can include a computing device receiving an operator input (e.g., from an operator input device) indicative of performing a float operation for a work group (e.g., causing the boom actuator to float). In some cases, this can include receiving a signal corresponding to an operator actuating a button, trigger, etc., on a joystick of the excavator (e.g., the joysticks 502, 504 of FIG. 5) or a signal corresponding to actuation of a touchscreen input device. In some cases, the block 854 may not be required, including, example, when the relevant float operation is part of a larger automatic (e.g., automated) sequence. In other words, in some cases, an operator may not need to directly actuate a button (or other operator input device) to implement float functionality.

At block 856, the process 850 can include a computing device controlling a valve assembly to control flow of hydraulic fluid from a boom (or other) actuator to the reservoir. For example, a computing device can cause one or more electronically actuatable valves of a valve assembly (e.g., of the valve assembly 804) to open by a particular amount to direct hydraulic fluid back to the reservoir from one end (e.g., the base end) of the boom actuator. As a more specific example, a computing device can command an actuatable valve to open by a particular amount to direct hydraulic fluid along a flow path from the base of a boom actuator and to the reservoir. Further, as generally discussed above, a valve assembly (e.g., the valve assembly 804) may sometimes be simultaneously controlled so as not to provide pressurized flow to another end (e.g., the rod end) of the boom actuator to power movement of the actuator. In this way, for example, the weight of the workgroup (e.g., including a bucket) or other external forces, rather than pressurized flow from the relevant pump, actually drives movement (e.g., retraction) of the boom actuator and corresponding movement of the workgroup.

In some cases, the base end of the boom actuator can be maintained at a non-zero hydraulic pressure, relative to a relevant reservoir, by way of control of the amount by which one or more relevant valves are opened (or closed). For example, during a float operation under the process 850, an actuatable valve may sometimes be opened by less than a maximum amount, to impose a particular pressure drop on flow from an actuator to a reservoir and thereby to help maintain a particular pressure (or pressure range) at a relevant end of the actuator. In this way, for example, the work group may not simply lower according to its full weight, which could result in relatively strong contact between the work group and the ground. Rather, because the actuatable valve(s) may be only partially opened, a non-zero hydraulic pressure at the relevant (e.g., base) end of the boom actuator can resist retraction of the piston of the boom actuator, in opposition to the weight of the workgroup or other external forces. In this way, by controlling hydraulic pressure at an actuator, even without actively powering movement of the actuator, a lower effective force (e.g., relatively small net retractive force) may be applied to the actuator and the lift arm may thereby move at a relatively slow speed.

For example, floating movement of a lift arm toward ground may be dictated by the difference in force between the retractive loading from the weight of the work group and the resistive loading provided by active control of hydraulic pressure at the base of the boom actuator.

In some embodiments, and as also described above, the position and orientation of a work group (e.g., a lift arm) can be periodically determined, including through the use of angle sensors for various lift arm components. The position, orientation, and weight characteristics (e.g., unloaded weight) of the components can be used to estimate the relevant load that may be applied by the weight of the lift arm (e.g., torque at a pivot point of a boom (e.g., the boom pivot mount 231B)) and thereby also to estimate the retractive loading force applied to a boom actuator by the lift arm. This estimated load/force can then be used to determine an appropriate hydraulic pressure to be maintained at a base end of the boom actuator to appropriately resist movement of the lift arm (e.g., to maintain a desired force differential on the piston of the boom actuator and thus a desired lowering speed of the work group). Alternatively, the hydraulic pressure can be maintained at a level that can stop the lowering action completely or even begin to cause the lift arm to be raised. Further, in some cases, other approaches can similarly provide relevant information regarding loading of a relevant actuator. For example, a pressure sensor (e.g., the sensor 810) can be used to monitor a pressure at a base end of a boom cylinder and a control device can control a valve assembly (e.g., the valve assembly 804) accordingly to provide a target pressure at the base end of the boom cylinder.

Thus, determined position and orientation of a work group (e.g., a lift arm), or other determined parameters, can be used to determine an appropriate value for hydraulic pressure at a base of a boom actuator, and block 856 can include appropriate operations for corresponding control of a valve assembly (e.g., for controlled actuation of a valve assembly to provide a restricted flow path from the boom actuator to the reservoir). In some cases, such control can be based on a maximum-reach or other predetermined orientation of a work group, including a predetermined orientation for an operation or initiation of an automatic operation (e.g., digging sequence). In some cases, such control can be based on a sensed, or otherwise determined, current orientation of a work group. For example, a computing device can periodically (e.g., regularly) determine a current orientation of a work group based on angular, pressure, or other sensor data, or based on dead reckoning relating to a starting orientation and subsequent movement commands, and can then periodically (e.g., regularly) adjust hydraulic pressure at a boom actuator accordingly (e.g., to maintain a uniform lowering speed during float operations for a lift arm).

In some embodiments, a computing device can adjust the hydraulic pressure at the base of the boom actuator (e.g., by receiving an operator input) differently for different tasks of an excavator or other power machine. For example, relatively lower base hydraulic pressures of the boom actuator can correspond to larger downward velocities for an implement, which can be useful for tasks that require higher impact forces (e.g., a tamping sequence to flatten terrain or drive a post or other object into the ground), for digging sequences relating to denser dirt or obstructions (e.g., tree stumps or roots to be split), etc. As another example, relatively higher base hydraulic pressure of the boom actuator can correspond to lower downward velocities for an implement, which can be useful for tasks that require lower impact forces, including, for example, a digging sequence for less dense dirt, a flat bottom dig sequence (e.g., as further discussed below), etc.

At block 858, the process 850 can include contacting the ground or another reference object with the implement. For example, in some digging or tamping operations, it may be useful to allow an implement to lower into contact with the ground using a float mode (e.g., as described above), and then to implement other (e.g., non-floating) operations. In some cases, a float operation can be implemented for a predetermined period of time (e.g., three seconds), at which point it may be assumed that a workgroup has been appropriately located (e.g., has floated to contact ground) and the process 850 can continue (e.g., the process 850 can proceed to block 860 and float operation can cease). In other cases, a float operation can be implemented until sensor input indicates contact with ground or other relevant condition. For example, a computing device can identify a pressure spike or other pressure signal from a pressure sensor in pressure communication with a boom actuator (e.g., at a base end thereof), and based on the pressure signal can determine that the implement has contacted the ground. In this regard, for example, a computing device can determine that a pressure spike at a boom actuator has exceeded a threshold pressure, or that a pressure signal for the boom actuator has been appropriately uniform (e.g., substantially constant for more than a particular time threshold), can correspondingly determine that an implement has contacted the ground, and then control a valve assembly accordingly relative to float operation (e.g., can stop float operation at block 860).

In some embodiments, float operation according to the process 850 can form part of a larger dig sequence (or other operational sequence) and the process 850 can thus be executed continuously or successively as long as the larger sequence is in progress. In some cases, float operation according to the process 850 can continue for a specific duration of time. For example, after the duration is exceeded, a computing device can stop the float operation for the work group. In some cases, float operation according to the process 850 can continue only while an operator input device is actuated, or only so long as operator input continues to activate (e.g., has not actively deactivated) float operations.

Figure 15:
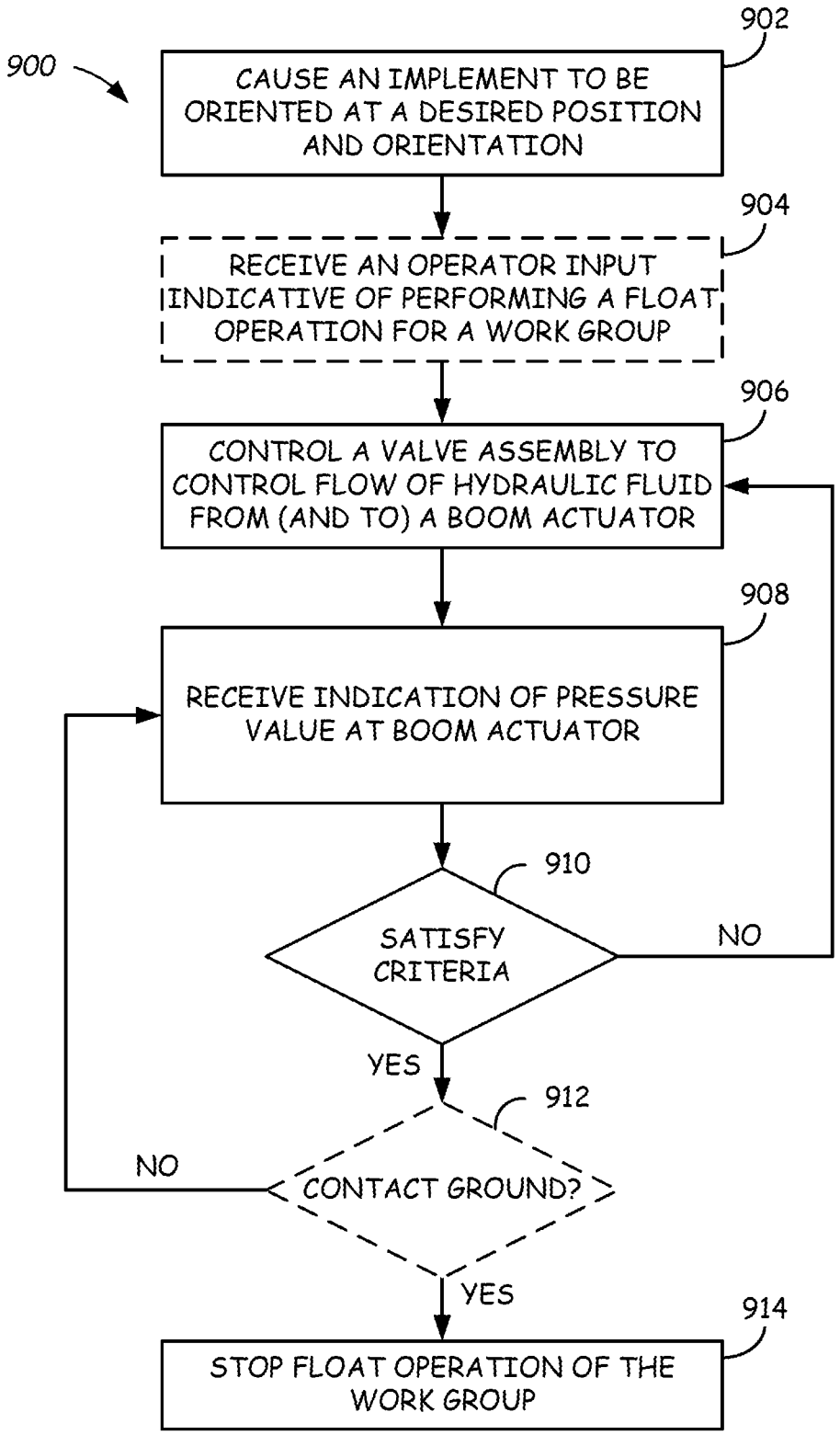
FIG. 15 is a flowchart of a process for performing a dynamic float operation for a work group of a power machine.

As noted above, in some cases, float operations can be implemented based on pressure feedback from one or more pressure sensors for a lift arm or other relevant work group. In this regard, for example, FIG. 15 shows a flowchart of a process 900 for performing a dynamic float operation for a work group of an excavator (or other power machine), which can be implemented using one or more computing devices (e.g., the control device 811). Generally, the process 900 can be implemented as part of the process 850 of FIG. 14 (or vice versa), or as part of one or more other operational processes, including those otherwise discussed herein.

At 902, the process 900 can include a computing device causing the implement to be orientated at a desired position and orientation, which can in some cases be similar to operations at block 852 of the process 850. For example, at block 902, an electronic control device can operate, automatically or based on manual control from operator input, to extend or retract one or more actuators of an excavator and thereby orient an implement as desired.

At 904, the process 900 can include a computing device receiving an operator input indicative of performing a float operation for a work group. Operations at block 904 may be generally similar to operations at block 854 of the process 850, and corresponding discussion above thus also applies relative to the process 900.

At 906, the process 900 can include a computing device controlling a valve assembly to control flow of hydraulic fluid from (and to) a boom cylinder. For example, operations at block 906 can include causing an actuatable valve (e.g., of the valve assembly 804) to open by a particular amount to direct hydraulic fluid back to the reservoir from the base of the boom actuator, including as similarly described relative to the block 856 of the process 850.

At 908, the process 900 can include a computing device receiving a signal that indicates a pressure value at a relevant actuator. For example, a pressure signal can be received from the pressure sensor 810 (see FIG. 13) or other pressure sensor in communication with a relevant actuator to provide a pressure value for a base (or other) end of a boom actuator, as may correspond to a current loading of the actuator by the floating weight of a lift arm. In some cases, other sensor data can also be received to this end, including signals corresponding to angular measurements for various lift arm components, as also discussed above, which measurements may be related to cylinder pressure based on known dimensions and weights of relevant power machine components and known principles of kinematic analysis.

At 910, the process 900 can include a computing device determining whether or not the relevant pressure value satisfies a relevant criteria, as may correspond to one or more desired characteristics of a float operation (e.g., criteria corresponding to a desired net retractive force on an actuator, or a desired lowering speed for an implement). For example, the block 910 may include determining whether a sensed pressure at a base end of a boom cylinder exceeds a pressure threshold, e.g., a hydraulic pressure needed to maintain a desired lowering speed for the work group, as described above with respect to process 850.

If at the block 910, a computing device determines that the pressure value has satisfied the relevant criteria (e.g., is within an acceptable range around a target threshold), the computing device can maintain the current control of the valve assembly for the boom actuator (e.g., in some cases, proceeding to block 912). If, however, at the block 910, a computing device determines that the relevant criteria/on is not satisfied (e.g., the pressure value is sufficiently below a pressure threshold), the process 900 can return to the block 906, and can correspondingly modify the control of the valve assembly (e.g., to increase base-end pressure and thereby slow downward movement of a lift arm). For example, if the pressure value is lower than desired according to the relevant control criteria, a computing device can control the valve assembly to further restrict flow from the boom actuator and thereby increase hydraulic pressure at the base of the boom actuator. As another example, if the pressure value is higher than desired according to the relevant control criteria, a computing device can control the valve assembly to reduce restriction of flow from the boom actuator and thereby decrease hydraulic pressure at the base of the boom actuator.

In some embodiments, as similarly discussed relative to the process 850, block 912 of the process 900 can include a computing device determining whether or not an implement has contacted the ground (e.g., as described with reference to the block 858 of the process 850). In some cases, if a computing device determines at the block 912 that the implement has contacted the ground, the process 900 can proceed to the block 914, at which the computing device can stop the (dynamic) float operation of the work group. If, however, at the block 912, a computing device determines that the implement has not contacted the ground, the process 900 can proceed with float operations (e.g., return to block 908, as shown) as appropriate.

In some embodiments, the block 912 can be omitted or may not necessarily direct the process 900 to cessation of float operations (e.g., at block 914), including, for example, if the dynamic float operation is to remain active even after the ground has been contacted. As further discussed below, for example, float operations can be usefully maintained after ground contact during some digging operations, including for flat bottom digging sequences (or digging sequences intended to follow a specific angle. In these cases, for example, a computing device can be configured to stop the float operation of the work group only after a relevant task associated with a float operation has been completed (e.g., only after completion of a digging sequence). In some cases, a computing device can be configured stop float operations when a command to raise an implement is received (e.g., based on input at an operator input device).

Figure 16:
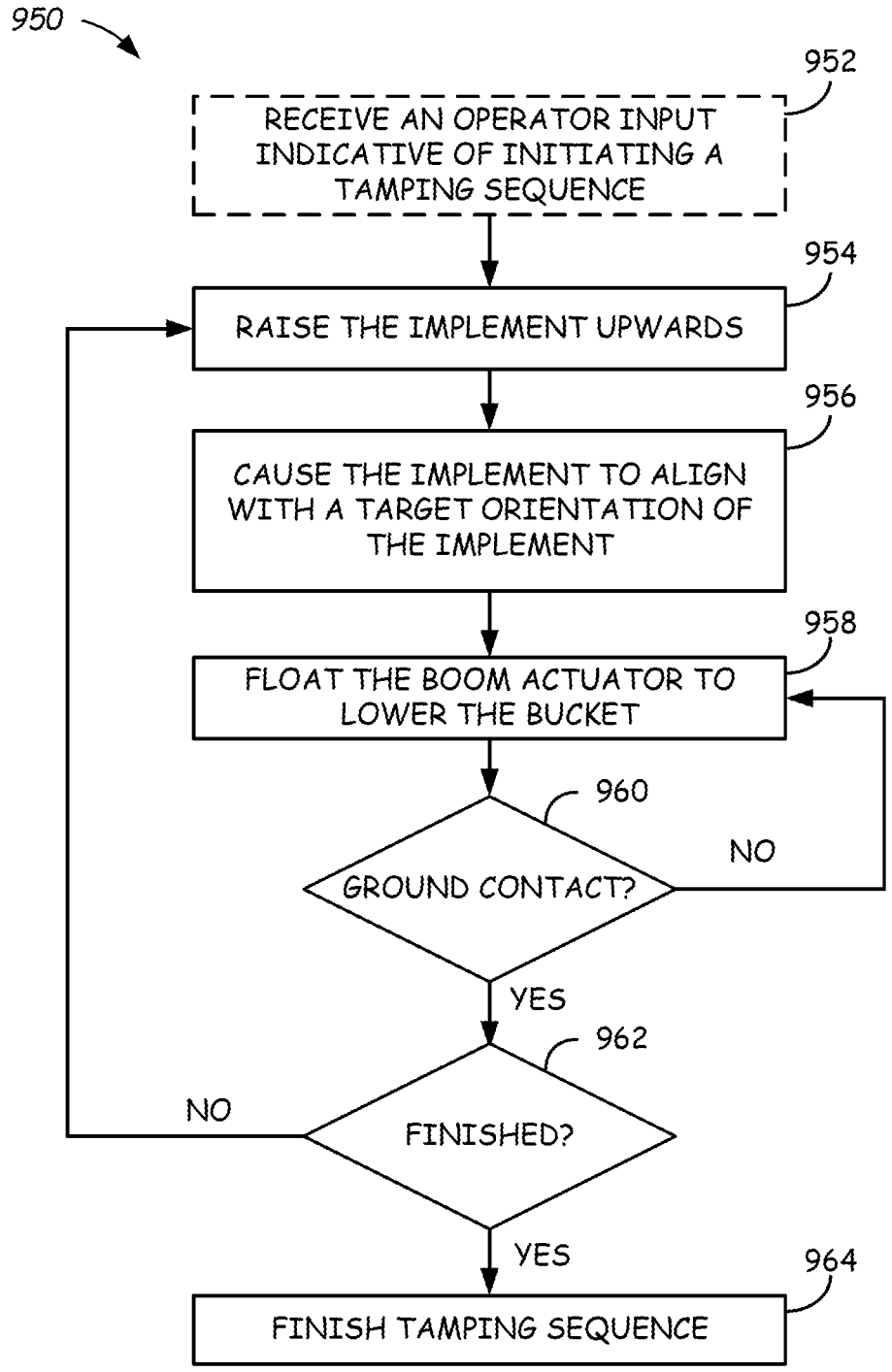
FIG. 16 is a flowchart of a process for performing a tamping sequence for a power machine.

FIG. 16 shows a flowchart of a process 950 for performing a tamping sequence for an excavator (or other power machine), which can be implemented using one or more computing devices (e.g., the control device 811). At 952, the process 950 can include a computing device receiving an operator input indicative of initiating a tamping sequence, which can be generally similar to the blocks 854, 904 described above. For example, after a bucket has been positioned appropriately (e.g., in contact with the ground or post), an operator can actuate an operator input device (e.g., an actuatable button on a joystick) to initiate the tamping sequence. In some cases, this block 952 can be omitted if, for example, initiation of a tamping sequence is automated.

In some embodiments, the process 950 can include a computing device receiving a location indicative of where to begin the tamping sequence. For example, an operator input or automatic process can indicate a particular location of an implement for the start of a tamping operation. In some cases, as described below, a location to begin a tamping (or other) sequence can correspond to a virtual reference location.

At 954, the process 950 can include a computing device raising an implement upwards. For example, block 954 can include a computing device causing one or more actuators of the excavator to extend or retract to raise and move a bucket upwards by a predetermined (or other) distance. As more specific example, block 954 can include a computing device controlling a valve assembly to drive hydraulic fluid to a boom actuator to extend the boom actuator by a particular amount, thereby raising a bucket above the ground (or object) to be tamped, or a computing device implementing float operations to allow a bucket to lower by a particular amount. Alternatively, the process can simply determine that the height of the implement when the operator indicates (at block 952) that the routine should be initiated is the beginning height and the operations at block 954 are not performed.

At 956, the process 950 can include a computing device causing an implement to align with a target orientation. For example, it may be desirable for some operations to provide a particular angular orientation of a cutting edge of a bucket relative to horizontal. In some cases, a target orientation may correspond to teeth of a bucket extending substantially parallel to the ground. In this way, for example, when a lift arm is lowered, a flat (or other) surface of a bucket can contact the ground before other portions of the bucket contact the ground.

At 958, the process 950 can include a computing device implementing float operation for the boom actuator to lower the relevant implement (e.g., bucket), which can be similar to the processes 850, 900 described above. For example, a computing device can control a valve assembly to control flow of hydraulic fluid out of the base of a boom actuator to a reservoir as also discussed above. In some cases, as also generally noted above, float operations can be controlled to provide a particular speed (or other characteristic) of floating movement, and different speeds (or other characteristics) can be implemented depending on the needs of a particular operation.

In some cases, operations at the block 958 may include controlling a valve assembly so that hydraulic pressure at a base end of a boom cylinder is different than in non-tamping operations. For example, a target hydraulic pressure at base end of the boom cylinder for tamping operations under the process 950 can be lower than a target hydraulic pressure for flat bottom dig operations (e.g., as further described below). Accordingly, in some cases, a floating contact between an implement and the ground (or an object) can be implemented with a higher speed for tamping operations than for other operations. In this way, for example, due to a larger force differential on a piston of a boom actuator, a larger impact force can be provided to tamp the relevant area or object. In some embodiments, a target tamping speed (or force) can be adjusted automatically, or can based primarily on operator input, to provide appropriate tamping force for different operations (e.g., to provide a stronger tamping force, via a heavier float operation, for harder dirt or to drive a post into the ground).

In some embodiments, floating a boom actuator to lower an implement under the process 950 can include little to no movement of other actuators of the excavator. For example, an arm actuator and implement carrier actuator can be substantially stationary during raising and lowering of a lift arm under the process 950. In some cases, during a float of the boom actuator, the boom actuator can be the only actuator for a lift arm that retracts (or extends) substantially. In some cases, however, other actuators can be controllably moved, as needed, to maintain or adjust a target alignment or float-path of an implement or other component. For example, arm or implement actuators can be activated in some cases to maintain a desired angular orientation or path (e.g., vertical path) for an implement.

At 960, the process 950 can include a computing device determining whether or not an implement has contacted the ground (or a relevant object), which can be similar to the blocks 858, 912. In some cases, if a computing device determines at the block 960 that the implement has contacted the ground (this can be sensed by any of a number sensing strategies, including sensing whether a boom position sensor is indicating no further movement or a pressure sensor indicates either a shock or a load indicative of contact with the ground), the process 950 can proceed to the block 962. If, however, at the block 960, a computing device determines that the implement has not contacted the ground, the process 950 can proceed back to the block 958 to continue floating the boom actuator to lower the bucket.

At 962, the process 950 can include a computing device determining whether or not the tamping sequence has been finished. For example, if each desired spatial area has been appropriately tamped according to a predetermined tamping sequence, then the computing device can determine that the tamping sequence has been completed and the process 950 can proceed to the block 964, in which tamping operations can be ceased. If, however, at the block 962, the process 950 determines that the tamping sequence has not finished (e.g., there are spatial locations that are yet to be tamped), then the process 950 can proceed back to the block 954 to raise (and move) the bucket to the next location according to the tamping sequence (e.g., another location that has yet to be tamped). In some cases, a return to block 954 can include automatically raising a lift arm to a particular orientation, as may be specified by manual input from an operator or automatically determined based on a particular tamping sequence. In some cases, as also generally discussed above, float operations may be temporarily ceased in order to again raise an implement at the block 954, then may be again implemented at the block 958 as the process 950 continues.

In some embodiments, one or more virtual boundaries can be specified for operation of a power machine, and movement of a lift arm or other components of the power machine can then be controlled based on parameters associated with the one or more virtual boundaries. For example, one or more virtual boundaries can be specified beyond which operation of an implement may not be permitted (or may be otherwise restricted) and control of one or more lift arm actuators can be modulated accordingly, including as discussed above relative to different control modes and as further discussed in the examples below. Accordingly, in some cases, movement of a lift arm can be automatically controlled, based on one or more virtual boundaries, so that relevant obstacles can be relevantly avoided, relevant operations (e.g., slewing and dumping) can be repeatably implemented, or an implement can otherwise be automatically controlled for improved overall functionality.

Figure 17:
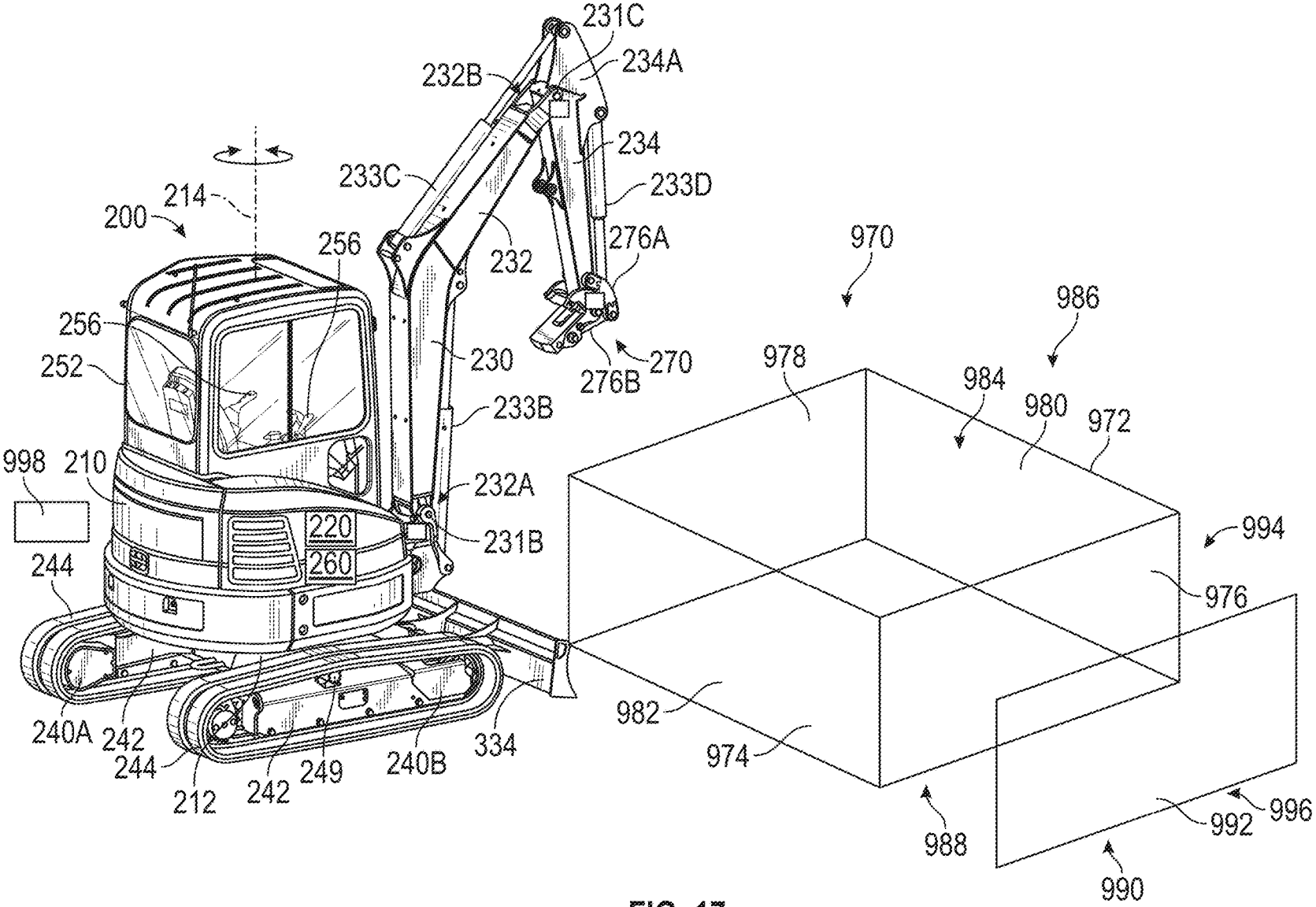
FIG. 17 is a schematic illustration of a power machine configured to operate relative to a virtual boundary.

In this regard, for example, FIG. 17 shows a schematic illustration of the excavator 200 operating according to a predetermined virtual boundary configuration 970. In some embodiments, the virtual boundary configuration 970 can be a preset configuration, as may correspond to a predetermined operational sequence (e.g., a digging sequence, a tamping sequence, etc.), or to a particular mode of operation (e.g., a driving mode, a digging mode, a hybrid mode), etc. In some embodiments, an operator can manually indicate one or more boundaries of the virtual boundary configuration 970. For example, an operator can position and orient the implement (e.g., the bucket) to a desired location, and can actuate an operator input device (e.g., on a display, an actuatable button of a joystick, etc.) when the implement is at the desired position and orientation. A computing device can then receive the operator input, indicative of the desired position and orientation of the implement and can generate a virtual boundary (or boundary parameter) corresponding to the location of the implement. In some cases, an operator input can correspond to a particular vertex of edge of a boundary plane (or other virtual boundary surface). In some cases, an operator input can correspond to a particular limit for a boundary configuration (e.g., a lateral limit to the right or left of an excavator, or a forward limit, for operation of an implement). In some cases, an external object or feature (e.g., dump pile) can be detected based on other inputs (e.g., from a radar system (not shown)) and a virtual boundary configuration can be determined accordingly (e.g., to enclose an object in a virtual boundary cube).

Generally, the processes noted above can be continued until each relevant boundary has been specified for a desired virtual boundary configuration. In some embodiments, a computing device can prompt an operator for input for one or more virtual boundaries of a virtual boundary configuration (e.g., by presenting an indication on a display). For example, a computing device can cause a display to present a graphic indicative of prompting the user to create a side virtual boundary so that the generation of the side virtual boundary actually corresponds to the side virtual boundary (e.g., and not a different virtual boundary). In some embodiments, a virtual boundary condition can also include non-boundary virtual locations, including target locations for an implement for a dumping or digging operation. Similar, in some embodiments, a virtual boundary condition can include different types of virtual boundaries, including boundaries to restrict movement (e.g., lateral limits on operational space for a lift arm) and boundaries to define automatic operations (e.g., virtual lateral, forward, rearward, and depth boundaries for an automated digging operation, or a virtual ground area for automated tamping, mowing, or other operations).

As generally noted above, a wide variety of virtual boundary configurations can be specified, including virtual boundary configurations with continuous virtual boundary surfaces, discrete and separated virtual boundary surfaces, virtual boundary surfaces that correspond to different operational limitations, etc. As shown in FIG. 17, the virtual boundary configuration 970 can include a front boundary 972, a rear boundary 974, side boundaries 976, 978, an upper boundary 980 (or in other words a ceiling boundary), and a lower boundary 982 (or in other words a floor boundary). While each boundary 972, 974, 976, 978, 980, 982 has been illustrated as being planar and in virtual contact with adjacent boundaries, the boundaries can have other shapes (e.g., being curved), and some of the boundaries may not be in virtual contact with other virtual boundaries. Further, although the lower boundary 982 is shown aligned with to top surface of local terrain for the excavator 200, a lower boundary 982 can sometimes be above or below a ground surface (e.g., to designate a maximum local or overall digging depth).

Generally, the virtual boundary configuration 970 can be referenced to a fixed virtual point, which can be for example, the location of the angle sensor 243 (e.g., that is coupled to the undercarriage) or other known point on the excavator 200. One or more virtual boundaries of a boundary configuration can also generally define one or more virtual zones, as may correspond to certain permitted (or barred) power machine operations or operational parameters (e.g., maximum speeds).

In some cases, each of the virtual boundaries 972, 974, 976, 978, 980, 982 can define a virtual zone on each respective side of a given boundary, with each virtual zone having one or more operational parameters associated therewith. For example, on one side of a relevant boundary (e.g., closer to the excavator 200), movement of the implement may be largely permitted (e.g., according to an operator command). However, on an opposing side of the boundary (e.g., farther away from the excavator 200), the implement may be prevented from moving or may be permitted to move differently than in other boundary zones. For example, some cases, slower movement of an implement may be provided in some virtual zones, including as implemented via adjustments to an operator response curve (see, e.g., FIG. 11). For example, a particular response curve may sometimes provide a lower slope while an implement is positioned on a farther side of a virtual boundary, than when the implement is positioned on a closer side of the virtual boundary.

As a more specific example, the virtual boundary 982 can extend along a side of a building or other structure, so movement of the implement may be allowed within the side of the virtual boundary 976 away from the excavator 200, while a commanded movement of the implement may be prevented when the command would result in a portion of the implement crosses the virtual boundary 976. Other implementations are also possible, however, including as further discussed below. Moreover, in some cases, operations of a power machine can be limited based on the position of other components. For example, in some cases, the virtual boundary configuration 970 can relate to position of any part of the lift arm 230, including so that no part of the lift arm 230 is permitted to cross over one or more of the virtual boundaries (e.g., the virtual boundary 976).

In some embodiments, the virtual boundary configuration 970 can define boundaries for a trench (or hole, etc.). For example, the lower boundary 982 can be positioned below the ground that the excavator 200 is positioned on to define a maximum depth of the trench, while the distance between virtual boundaries 976, 978 can define a maximum width for the trench. In addition, the distance between the virtual boundaries 980, 982 can define a maximum length for the trench. Thus, the boundary configuration 970 can sometimes guide automatic operation of the lift arm 230 to allow a trench to be automatically cut into the ground according to one or more predetermined parameters.

In some embodiments, the boundary configuration 970 can include multiple lower boundaries which can separated from each other and are positioned at different heights. For example, a lowermost lower boundary can define a hard stop (e.g., so that movement of an implement past the lowermost lower boundary in the depth direction is prevented), while the virtual zones between a particular set of lower boundaries can have other associated operational parameters. For example, in each of these virtual zones, different work group speeds, vibration frequencies for an implement, or operator response curves can be automatically implemented, including so as to compensate, for example, for different soil characteristics (e.g., more or less dense soils).

While select examples are presented above, a virtual boundary configuration can be implemented in a variety of other ways. For example, the virtual boundary configuration 970 can define the boundary for a trench, a boundary for a tamping sequence, or a boundary for other automatic digging or dumping operations, etc. In this regard, for example, the bottom virtual boundary 982 can be positioned relative to the ground to define a depth boundary for a trench, a vertical tamping limit for a post or other object, a level for smoothing operations, etc. As another example, the virtual boundary 970 can have various other shapes, including, for example, to provide a virtual a ledge (e.g., with the upper virtual boundary 980 extending beyond the one or more of the virtual boundaries 972, 974, 976, 978), a virtual cylinder, a stacked configuration (e.g., with differently sized or shaped virtual zones at different heights), a multi-zone configuration (e.g., with differently sized or shaped virtual zones at different forward, rearward, or lateral locations), etc.

Still referring to the illustrated example of FIG. 17, the virtual boundaries 974, 976, 978, 980, 982 are shown as collectively defining virtual zones 984, 986. For example, the virtual boundaries 974, 976, 978, 980, 982 can define an enclosed virtual zone 984, and a non-enclosed virtual zone 986 that extends outside of the enclosed virtual zone 984 (and fully surrounds the zone 984, as shown). In some cases, operational parameters can be different for different virtual zones. For example, an operational parameter associated with the virtual zone 984 can permit any (otherwise suitable) movement of the implement within the virtual zone 984, while an operational parameter associated with the virtual zone 986 can prevent (or otherwise moderate) further movement of an implement or other lift arm component into or within the virtual zone 986. In this way, for example, the virtual boundary configuration 970 (and others) can help to guide lift arm movement and can limit or prevent undesirable movement of the implement depending on the relevant requirements of a variety of virtual zones.

In the illustrated example, the boundary configuration 970 can also include multiple virtual boundary formations 988, 990, each of which are spatially separated from each other. For example, the boundaries 972, 974, 976, 978, 980, 982 can define a virtual boundary formation 988 (i.e., corresponding to the virtual zone 984), while a boundary 992 of the virtual boundary configuration 970 can define a virtual boundary formation 990 (e.g., corresponding to a vertical plane of indefinite length or height). Further, a virtual zone 994 can be defined between the virtual boundary formations 988, 990, as can be associated with one or more different operational parameter, as appropriate. For example, operational parameters for the virtual zone 984 may allow unrestricted operation of a lift arm, operational parameters for the virtual zone 994 may permit slowed operation of the lift arm, and operational parameters for a virtual zone 996 on a far side of the virtual boundary formation 990 can fully prevent operation of the lift arm. In this way, for example, movement of the implement on a particular side of the virtual boundary 976 (e.g., a left side) may be allowed, movement of the implement between the virtual boundary formations 988, 990 may allowed but may be more tightly controlled (e.g., may have a reduced maximum allowable speed), and movement of the implement beyond the virtual boundary formation 990 may be prevented.

In some cases, tactile or other feedback can be provided to an operator based on operations relating to particular virtual boundaries. For example, an operator can be provided with a tactile or visual response as an implement or other lift arm component moves closer to a virtual boundary to corresponds to an obstacle or other change in operational parameters (e.g., as the lift arm 230 enters the virtual zone 994 and approaches the virtual boundary 992), as may assist with appropriate modification of input commands for operations within particular real-world zones.

In some embodiments, a virtual boundary configuration can be fixed relative to an absolute reference frame and may thus be virtually stationary despite tractive movement of the relevant power machine. In some cases, the virtual boundary configuration 970 may remain stationary regardless of operation of the track assemblies 240A, 240B, as may help to guide automatic digging of a particular area of terrain, automatic avoidance of or caution within certain real-world zones, etc. For example, movement of either of the traction elements (e.g., the right and left traction elements) can be sensed and received by a computing device (e.g., by rotary encoders), which can move a virtual reference point relative to the boundary configuration 970 but leave the boundary zones 984, 986, 996 in a fixed real-world location. In other cases, however, a boundary configuration can move in real-world space (e.g., translate) based on detected or commanded movement of a power machine. For example, the virtual zone 984 can be configured to move with the excavator 200 as the excavator travels, including as may assist in automatic operation of a lift arm during excavator travel (e.g., for operation of a flail mower).

FIG. 17 also shows a virtual boundary configured as a virtual reference location 998, which can be mapped to a fixed reference location on the excavator 200 in some cases. In some cases, the virtual reference location 998 can be a point, virtual two dimensional shape (e.g., a plane), or a virtual three-dimensional shape. In some cases, a virtual reference location can provide a target location for an implement or other component of a power machine. For example, once the virtual reference location 998 is received by a computing device (e.g., is set by an operator input while the implement is at the location 998), the excavator 200 or a component thereof can be automatically controlled to be reliably returned to that location (or region). For example, the virtual reference location 998 can sometimes correspond to a pile or truck-bed location for repeatedly dumping material during an automatic (or other) digging operation. Accordingly, once the virtual reference location 998 has been specified, a computing device can control one or more actuators of the excavator to move the implement (or other component) to, or relative to, the virtual reference location 998.

In some embodiments, a virtual reference location can be used in combination with other virtual boundaries to execute one or more automatic operations. For example, a boundary zone can be defined to represent a real-world region that is to be avoided, or within which certain operations may be restricted or otherwise modified, as an implement is moved from a current location to the virtual reference location. For example, with the virtual reference location 998 defining a dump location, other virtual boundaries (not shown) may be used to guide movement of the lift arm 230 to dump at the location 998 without, for example, the lift arm 230 contacting a side of a dump truck bed or a base portion of a dump pile.

Figure 18:
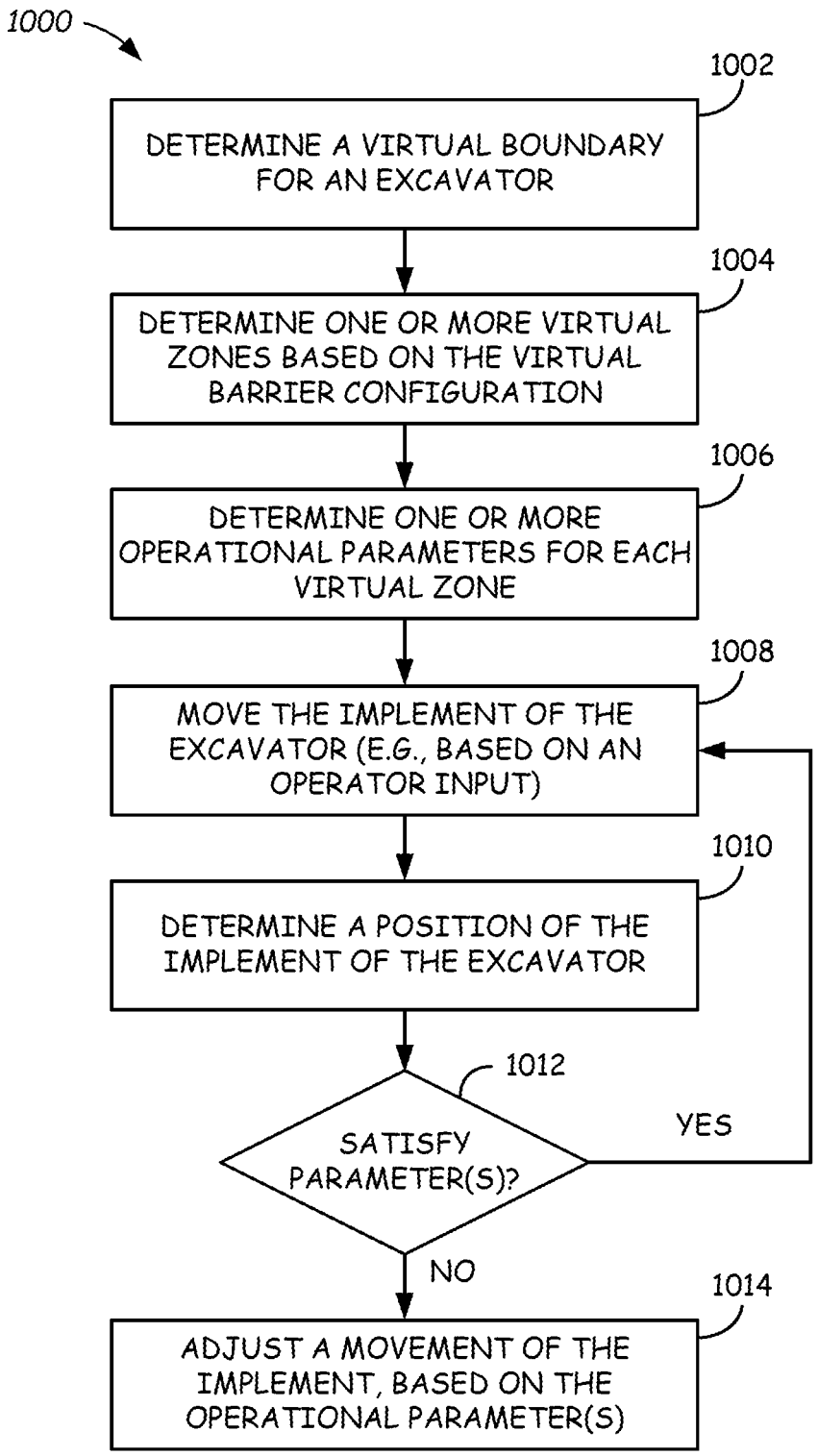
FIG. 18 is a flowchart of a process for operating a power machine according to a virtual boundary configuration.

FIG. 18 shows a flowchart of a process 1000 for operating an excavator (or other power machine) according to a virtual boundary configuration, which can be implemented using one or more computing devices (e.g., the control device 811). At 1002, the process 1000 can include a computing device determining one or more virtual boundaries for an excavator, corresponding to a particular virtual boundary configuration. In some cases, operations at block 1002 can include a computing device determining one or more virtual boundaries or boundary zones, based on corresponding operator input. For example, an operator may specify virtual boundaries via inputs on a touchscreen relative to a representation of actual power machine surroundings, as parameters relating to relative distances from a reference point (e.g., on the power machine), or via indication that a current orientation of an implement or other lift arm component corresponds to a particular virtual boundary. In some cases, a virtual boundary condition can be predetermined (e.g., for particular operational profile) or can be propagated to a power machine from an external control device (e.g., in combination with an external object-tracking system). In some cases, a computing device can determine a virtual boundary configuration that corresponds to a specific task sequence (e.g., a dig sequence, a tamping sequence, etc.) for an excavator, or that corresponds to a particular mode of operation for the excavator (e.g., a digging mode of operation, a traveling mode of operation, a hybrid mode of operation).

At 1004, the process 1000 can include a computing device determining one or more virtual zones based on the one or more virtual boundaries determined at block 1002. In some cases, virtual zones can be inherently determined based on the determination of the virtual boundaries. For example, determined virtual boundary zones can sometimes be correspond simply to opposing sides of planar virtual boundaries or to enclosed or un-enclosed areas defined by one or more virtual boundaries. In some cases, virtual zones can be determined separately from virtual boundaries. For example, once a set of virtual boundaries have been determined, operator (or automated) input may be received to specify any number, shape, or size of virtual zones in relation to the virtual boundaries or otherwise. In some cases, multiple boundaries can collectively define one or more virtual zones, including with a first region (e.g., side) specified by the multiple boundaries defining a first virtual zone and a second region (e.g., side) specified by the multiple boundaries defining a second virtual zone. As also noted above, virtual boundaries or zones can sometimes correspond to floors or other boundaries for digging operations (e.g., maximum digging depths, trench lengths or widths, etc.), virtual barriers for implement movement (e.g., maximum forward, rearward, or lateral extension of an implement, or lift arm as a whole), or virtual target locations for particular operations (e.g., a virtual location specifying a dump location corresponding to a truck bed or dump pile, or a virtual area for a particular operation (e.g., mowing or tamping)).

At 1006, the process 1000 can include a computing device determining one or more operational parameters for each virtual zone. For example, an operational parameter can include applying a particular operator response curve (see, e.g., FIG. 11) or control-function mapping for a virtual zone, preventing movement of an implement altogether within a virtual zone, allowing unrestricted movement within a virtual zone, allowing (or restricting) movement of only certain components within a virtual zone, etc.

At 1008, the process 1000 can include a computing device controlling movement of an implement or other component of the excavator. In some cases, the block 1008 can include controlling movement based on an operator input, or according to an automatic (e.g., automated) sequence. For example, in some cases, a computing device can control a valve assembly to cause one or more actuators of the excavator to move according to operator input (e.g., as modified based on a control-function mapping or response curve) or according to a predetermined path or task for an implement.

At 1010, the process 1000 can include a computing device determining a current position of the implement of the excavator. In some cases, a computing device can receive, from each angle sensor, an angle, and a known geometric distance defined by each angle (e.g., the known length of the component) to determine the position of the implement of the excavator (e.g., by known geometric or kinematic approaches).

At 1012, the process 1000 can include a computing device determining whether or not a current or commanded position (or movement) of an implement or other component satisfies the relevant operational parameter(s). For example, the block 1012 can include receiving data from angle or other sensors to determine a current orientation of a lift arm and implement, as well as receiving commands from an operator input device or automated-sequence module that correspond to a particular commanded movement of the lift arm and implement. The block 1012 can then further include determining whether the current or commanded location (or commanded movement) satisfies a relevant operational parameter that corresponds to a relevant virtual boundary configuration. For example, the block 1012 can include determining whether a current implement position is within a particular virtual zone, or whether a commanded movement would cause an implement (or other component) to approach or enter a particular virtual zone.

As appropriate, once a position or commanded movement has been determined, the position or commanded movement can then be evaluated to assess compliance with the relevant operational parameters, including as may related to restrictions on movement through or into a particular virtual zone. For example, if at the block 1012, a computing device determines that one or more relevant operational parameters have been satisfied (e.g., the implement has not crossed a boundary, the implement is positioned within a virtual zone without restrictions imposed on the implement, etc.), the process 1000 can proceed back to the block 1008 to move (or continue to move) an implement of the excavator as commanded. If, however, at the block 1012, a computing device determines that the one or more operational parameters have not been satisfied (e.g., a portion of the implement has crossed or is expected to cross a particular virtual boundary, a portion of a lift arm is situated in a particular virtual zone, etc.), then the process 1000 can proceed to the block 1014.

At 1014, the process 1000 can include a computing device adjusting a movement of the implement, based on the relevant operational parameter(s). For example, a computing device can cause the one or more actuators to prevent further advancement of an implement in a direction beyond a virtual boundary of a virtual boundary configuration, based on a portion of the implement crossing or being commanded to cross a relevant virtual boundary. As another example, a computing device can cause the one or more actuators to slow down advancement of an implement in a particular direction in accordance with a relevant operational parameter (e.g., by imposing a change in a response curve for an operator input device).

In some implementations, as also generally discussed above, the process 1000 can be used for automatic digging or other operations. For example, referring again to FIG. 17, a boundary zone (e.g., similar to the zone 984) can be determined in order to specify a particular front-to-back and lateral size of a trench, a maximum dig depth, and a maximum ceiling for the lift arm 230 (as applicable). Further, a dump location (e.g., similar to the virtual location 998) can be specified, as may correspond to a dump pile or a location of a dump bed. Based on appropriate feedback (e.g., via angular sensors, as discussed above), the lift arm 230 can then be controlled to automatically execute digging operations, in accordance with the illustrated operations of the process 1000 (see FIG. 18) within the specified boundary zone, and to automatically execute dumping operations, in accordance with the specified dump location (and any intervening virtual zones, as appropriate). In some cases, correspondingly, each subsequent pass through the specified digging zone can be executed with a deeper cut than the previous pass, until the specified maximum depth has been reached. In some cases, multiple locations for a dump pile can be specified, including as may allow different types of dirt from different strata of a worksite to be dumped into different piles.

In a similar manner, the process 1000 can also be used to execute other automatic operations for a power machine. For example, with a virtual zone and corresponding operational parameters having been specified relative to a real-world environment, a power machine may sometimes be controlled to automatically travel over terrain while also selectively implementing other workgroup functionality. For example, the excavator 200 can sometimes be controlled to travel laterally relative to a specified digging zone in order to dig a trench of a particular width, or can be controlled to travel forward over terrain while an implement is simultaneously controlled to executed various operations (e.g., raising to clear an obstacle, oscillating to or mow tamp terrain, etc.).

Figure 19:
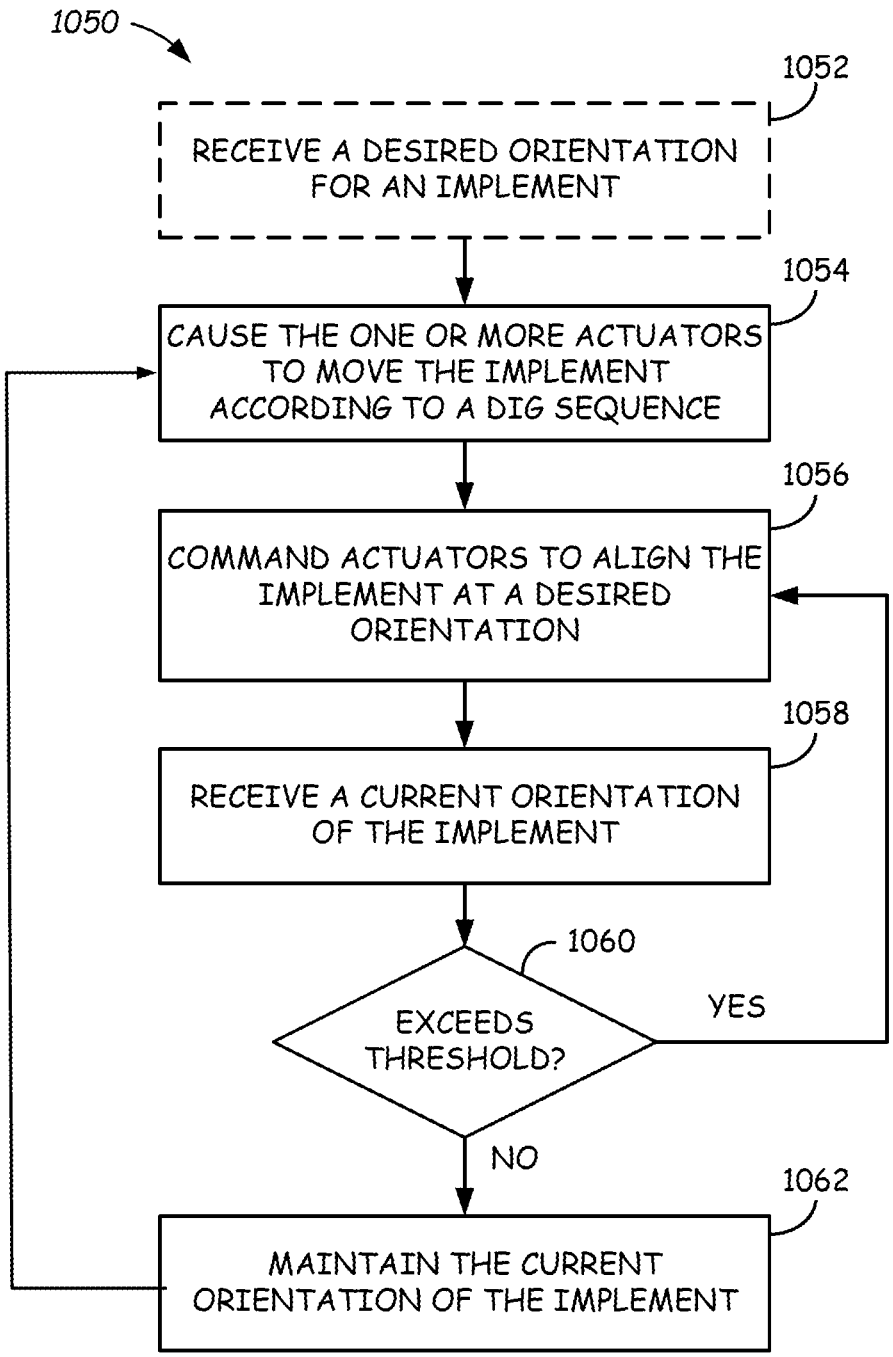
FIG. 19 is a flowchart of a process for performing bucket leveling during a dig sequence (e.g., a flat bottom dig sequence) for a power machine.

Further in this regard, FIG. 19 shows a flowchart of a process 1050 for performing dig sequences for an excavator or other power machine, including flat bottom dig sequences as further discussed below, which can be implemented using one or more computing devices (e.g., the control device 811). Note that while the process 1050 describes performing a flat bottomed—i.e. a zero degree angled—trench, the same process can be used for trench to be dug at a specified, non-zero angle. At 1052, the process 1050 can include a computing device receiving a desired orientation for a bucket of an excavator. In some cases, this can include an operator orienting the bucket to a desired orientation and then actuating an operator input device (e.g., an actuatable button on a joystick) to provide corresponding signals to a computing device. Based on these signals, for example, the computing device can receive a current angle of the implement (e.g., from the angle sensor 239), which can be used as the desired orientation as specified by the operator input. In other cases, a computing device can receive a user input that is otherwise indicative of an orientation, including by an operator entering a desired bucket orientation that may not necessarily correspond to a current bucket orientation.

In some cases, the desired orientation for an implement can correspond to a bucket being angled so that the teeth of the bucket are at an acute angle (e.g., substantially 10 degrees) relative to an axis that is parallel to the ground. In this way, for example, the bucket can appropriable engage the ground, but with the bucket largely traveling parallel to the ground (e.g., to dig a trench that has a flat bottom). In other cases, the desired orientation can correspond to a bucket being angled so that the teeth of the bucket are parallel to the ground. For example, this can occur after the bucket has reached the desired depth of a trench (e.g., as defined by a lower virtual boundary), in which case the next digging pass will be parallel to the floor of the trench (and the lower virtual boundary) so that the bucket scrapes away any relatively loose leftover material.

At 1054, the process 1050 can include a computing device causing the one or more actuators of the excavator to move the bucket according to a dig sequence. For example, the block 1054 can include a computing device actively controlling movement of one or more actuators of the excavator to cause a particular movement of a lift arm. In some cases, a digging sequence implemented at block 1054 can be based on one or more virtual boundaries, as also discussed above. As another example, and as also discussed below, the block 1054 can sometimes include a computing device causing a lift arm to operate in a float condition (e.g., causing a boom actuator to float as described above). For example, a float operation can be implemented according to either of the processes 850, 900 (see FIGS. 14 and 15) to cause an implement to float into contact with the ground, including as expressly described above with regard to the processes 850, 900. Alternatively, a boom can be powered to a position that is sensed by pressure sensors when the boom comes into contract with the ground.

In some cases, as also generally described above, float operation under block 1054 can allow for reliable and automatic placement of an implement into ground contact, as may be particularly beneficial for digging operations in which removal of material in an initial digging cut may not necessarily result in a deterministic depth of a trench for a subsequent digging cut. In such a case, and others, floating operation of a lift arm can thus allow an operator to reliably and automatically ensure that a bucket or other implement is appropriately aligned for each subsequent digging cut, including without active sensing of actual current trench depth or other related parameters. Further digging operations using float functionality are also described relative to FIG. 22.

At 1056, the process 1050 can include a computing device commanding an implement carrier actuator (or other actuators) to extend or retract to align an implement at a desired orientation. For example, block 1056 can generally include a computing device controlling a valve assembly in various known ways to change an orientation of an implement carrier actuator and thereby align a bucket at the desired orientation.

At 1058, the process 1050 can include a computing device receiving a current orientation of an implement. In some cases, a computing device can determine the current orientation of the bucket by receiving, from an angle sensor (e.g., the angle sensor 239), the angle between the arm and the implement interface of the excavator. In some cases, a computing device can determine the current orientation of the bucket by receiving an angular measurement from each angle sensor of a lift arm and kinematically (or otherwise) determining the current orientation of the bucket relative to a reference plane on the basis of those measurements (e.g., determining a current orientation relative to a plane parallel to ground, a plane parallel to a bottom of a trench, a vertical plane that is perpendicular to the ground, etc.).

At 1060, the process 1050 can include a computing device determining whether or not the current orientation of an implement exceeds an angle threshold (or otherwise satisfies relevant orientation criteria). If, for example, a computing device determines at block 1060 that the current orientation of a bucket exceeds an angle threshold (e.g., is outside of a specified angular range), the process 1050 can proceed back to the block 1056 to command the implement carrier actuator (or other actuators) to align the bucket at the desired orientation. If, however, a computing device determines at block 1060 that the current bucket orientation does not exceed an angle threshold (e.g., is within a specified angular range), the process 1050 can proceed to the block 1062 to maintain the current orientation of the bucket and continue the digging sequence under block 1054.

In some embodiments, the blocks 1056, 1058, 1060, 1062 can repeat at intervals during a part (or the entire) task sequence (e.g., a digging sequence) to be completed by the excavator. In this way, the active orientation control of the bucket (e.g., active leveling of the bucket) ensures that, for example, the current digging stroke does not exceed a predetermined desired depth for the trench. For example, as a lift arm is controlled to implement a flat-bottom or other digging operation under block 1054, a control system can periodically sample bucket orientation and execute corrective orientation control accordingly, as needed. In this regard, for example, the process 1050 can be similarly implemented in order to effect particular changes in an orientation of an implement during digging operations. For example, the process 1050 can sometimes include implementing a predetermined change in angular orientation of a bucket during a digging operation (e.g., to better accumulate material during a cut into the ground, or to ensure minimal loss of material during a slew-and-dump operation).

Figure 20:
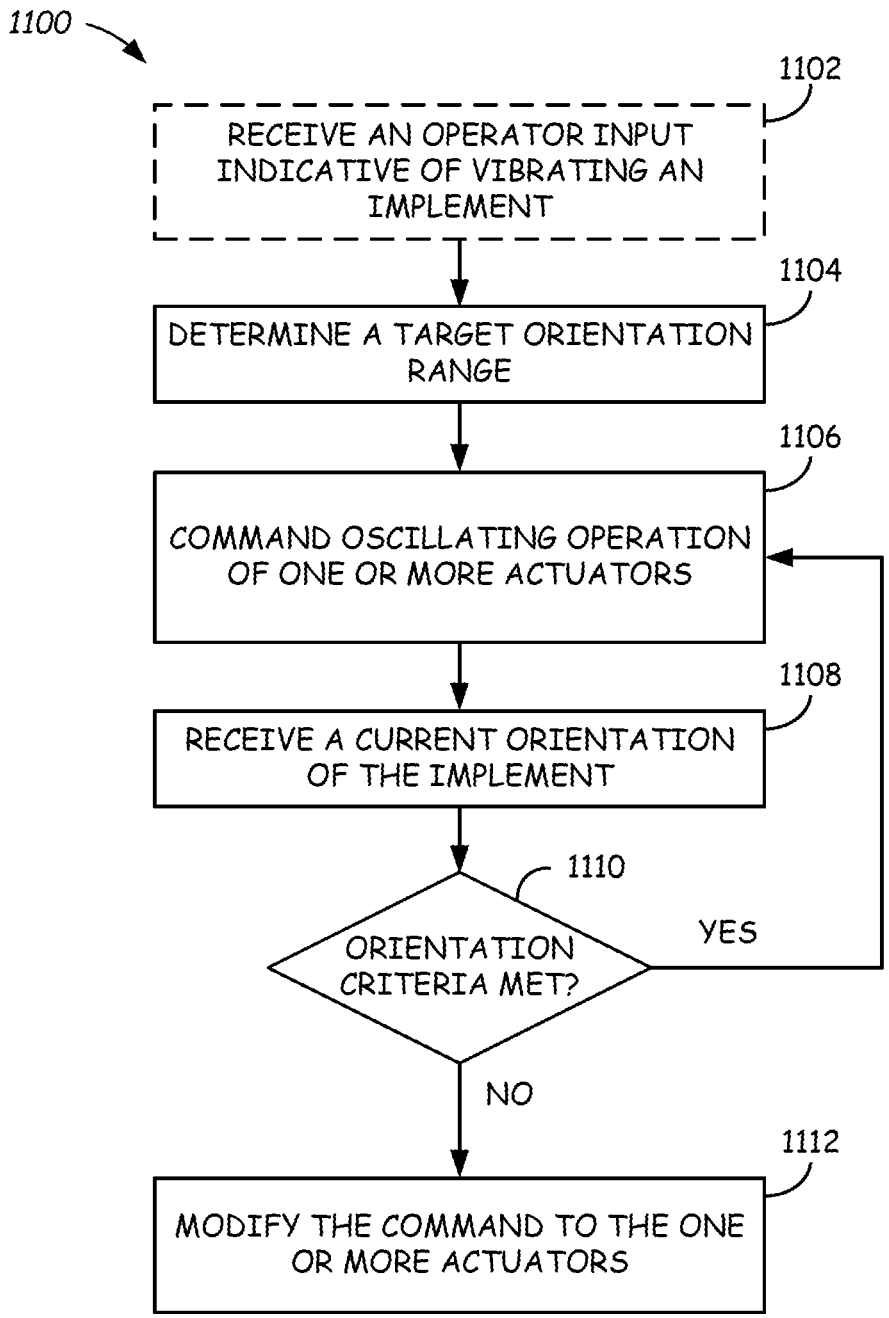
FIGS. 20 and 21 are flowcharts of processes for vibrating an implement of a power machine.

In some embodiments, an implement can be intentionally automatically vibrated (i.e., oscillated) to assist in digging, tamping, or other operations. For example, FIG. 20 shows a flowchart of a process 1100 for causing vibration of an implement (e.g., a bucket) of an excavator or other power machine, which can be implemented using one or more computing devices (e.g., the control device 811). At 1102, the process 1100 can include a computing device receiving an operator input indicative of vibrating the bucket, which can be similar to the blocks 854, 904, 952, 1052 of the processes describe above. For example, a computing device can receive an operator input from an actuatable button of a joystick to indicate that vibration of an implement is currently desired. As another example, a computing device can receive an operator input to indicate that vibration of an implement is enabled, and actual vibration of the implement can be subsequently effected based on other criteria (e.g., automatically, or based on subsequent operator input).

In some implementations, at 1104, the process 1100 can include a computing device determining a target orientation range for an implement. In some cases, operations at block 1104 can include determining an angular range (or window) within which an implement will be allowed to vibrate. In some embodiments, operations at block 1104 can include determining multiple orientations ranges, with different operation properties associated with each (e.g., each range associated with a different vibration frequency, amplitude, etc.).

In some implementations, the process 1100 may not necessarily include expressly determining a target orientation range at block 1104. As further discussed below, for example, use of a target orientation range can help to implement relatively fine control over oscillation of an implement, including as may counteract expected drift of an implement toward one end of its structurally-enabled angular range. However, useful vibration of an implement can also be effected by other approaches, including simply via timed oscillation commands. In this regard, for example, a target orientation range may sometimes not be employed when drift of bucket orientation does not need to be controlled, including for vibrating operations to help remove material from a bucket after digging.

In some embodiments, the block 1104 of the process 1100 can include a computing device determining a target implement orientation. In some cases, a target implement orientation can be inherently determined based on the target implement orientation range. For example, a desired bucket orientation can be the midpoint between respective boundaries provided by a bucket orientation range. In some embodiments, the block 1104 can include a computing device commanding one or more actuators to orient an implement at the desired implement orientation (e.g., prior to vibrating the implement).

At 1106, the process 1100 can include a computing device commanding oscillating operation of one or more actuators (e.g., symmetrically commanded extension and retraction at a particular frequency) to provide oscillating movement of an implement. In some cases, block 1106 can thus include a computing device commanding an implement carrier actuator (or other actuators) to extend and retract at a particular frequency. In some embodiments, a computing device can control a valve assembly to alternately deliver hydraulic fluid to extend an actuator for a period of time according to the relevant frequency, and to retract the actuator for the same period of time and with the same flow rate (i.e., the oscillation commands may be symmetric).

In some cases, the net flow of hydraulic fluid into a respective side of the actuator during a stroke (e.g., extension or retraction) can correspond to the amplitude of the commanded oscillation, which can correspond to an amount of change in implement angle.

Correspondingly, the duration and timing between extension and retraction commands can correspond to the commanded vibration frequency. In this way, a computing device, by controlling a valve assembly can apply (and adjust) vibration frequency and amplitude for commanded vibration of an implement.

In some embodiments, during extended execution of the process 1100, a computing device can change the frequency or amplitude at which the one or more actuators extend and retract, as appropriate. For example, a computing device can receive an operator input (e.g., from an actuatable button on a joystick) indicative of a desired increase in amplitude or frequency for vibration of a bucket, and a control device can update commands to a relevant actuator accordingly. As another example, oscillating commands can sometimes be modified upon receipt of sensor signals (e.g., pressure signals), including as may indicate that digging has stalled, or a load on a bucket has not been released. In this way, for example, a control system can appropriately adjust vibration of an implement when dug material is difficult to remove from the implement, when a digging operation hits a particular compacted region of soil, or in other relevant circumstances.

In some embodiments, movement in opposing directions for an oscillation can be commanded, by default, for equal amounts of time. However, due to inherent variations in system response, drift of an implement toward one end of a range of angular travel may tend to result even when symmetrical oscillation is commanded. Thus, in some embodiments, as further discussed below, the process 1100 may include operations to correct for angular drift. In some embodiments, however, relatively unmodified oscillation may sometimes be appropriate, and the process 1100 may not necessarily include operations under blocks 1104, 1108, 1110, 1112, etc. Indeed, in some cases, oscillation of an implement with angular drift can helpfully result in the implement eventually contacting a stop at an end of travel (e.g., at either end of an overall angular range), which can in some cases further assist in shaking material free from the implement. Similarly, in some cases, non-symmetric oscillating commands can be implemented, in order to intentionally cause an implement angle to drift toward a particular end of a range of travel.

Control of actuators for oscillating movement can be implemented in a variety of ways, including according to generally known approaches for control of linear or other actuators. In some cases, for example, hydraulic flow may be default open to both ends of a hydraulic cylinder and oscillating movement can be obtained by selectively and alternatingly closing the ends of the cylinder to flow. As another example, hydraulic flow may be default closed to both ends of a cylinder, and oscillating movement can then be obtained by selectively and alternatingly opening the ends of the cylinder to flow.

As noted above, in some cases, oscillation of an implement can be controlled in order to maintain the implement within a particular orientation range (e.g., as determined at the block 1104). Correspondingly, at 1108, the process 1100 can include a computing device receiving a current orientation of the bucket, which can be similar to the block 1058 of the process 1050. For example, a computing device can receive signals indicative of one or more angles, from one or more angle sensors of an excavator, and can then employ known kinematic or other techniques to determine the current orientation of the bucket (e.g., relative to a reference plane).

At 1110, the process 1100 can include a computing device determining whether or not one or more criteria for orientation of the implement have been met (e.g., whether an angular orientation of an implement exceeds a target orientation range as determined at block 1104). For example, operations at block 1110 can include a computing device determining whether or not the current bucket orientation has exceeded a desired bucket orientation range or has exceeded a threshold associated with a boundary of the desired bucket orientation range. As another example, operations at block 1110 can include a computing device determining whether or not a time duration for a particular oscillating command has been exceeded, or whether or not a portion of an implement has advanced past a virtual boundary (e.g., as also discussed above).

In some embodiments, if a computing device determines that one or more orientation criteria have not been met, then the process 1100 can proceed to the block 1112, which can include a computing device appropriately modifying an oscillation command for one or more actuators (e.g., reversing a command, or implementing a non-symmetric oscillation approach). If, however, at the block 1112, a computing device determines that the one or more criteria have not been exceeded, then the process 1100 can proceed back to the block 1106, as appropriate, to continue to command the one or more actuators to extend or retract at a relevant frequency.

Still referring to block 1112, for example, if a computing device determines that a current bucket orientation has exceeded a desired bucket angle range, then a computing device can modify the command to the one or more actuators so that bucket is forced back into the current orientation range, which command can in some cases be implemented even while the bucket continues to be vibrated at a target frequency. For example, if a computing device determines that a current bucket orientation is outside a target angular range (e.g., beyond a maximum angle according to a target range determined at block 1104), a computing device can control a valve assembly to provide greater flow of hydraulic fluid to one end of an actuator rod than to another, as may result in a net (oscillating) command that can return the bucket to the target angular range. In this way, the bucket may still oscillate, as appropriate, but can also be moved to compensate for drift (or other misalignment) of bucket orientation over time.

As another example, to command an implement back into a target orientation range, the time period of a retraction command can be selectively decreased relative to the time period of an extension command (or vice versa, as appropriate). For example, if a bucket angle is determined to be greater than a threshold angle, the time period for a retraction stroke can be increased (or the time period for an extension stroke can be decreased), while overall oscillation is still maintained.

As another example, if a computing device determines that the current bucket orientation has exceeded a desired bucket range, the computing device can sometimes stop the vibration of the bucket, move the bucket back to a desired bucket orientation (e.g., within the relevant range), and then, once the bucket is at a desired bucket orientation, resume vibrating the bucket at the frequency. As yet another example, if a computing device determines that a relevant time duration has been exceeded, a computing device can stop vibrating the bucket at the frequency. As still another example, if a computing device determines that a portion of the bucket has advanced past a virtual boundary, a computing device can cause the bucket to stop vibrating at the frequency. Then, similarly to the configuration above, a computing device can move the bucket away from the virtual boundary so that the bucket is positioned within a virtual zone corresponding to appropriately permitted operations of the bucket, and then resume vibration of the bucket, as appropriate.

Figure 21:
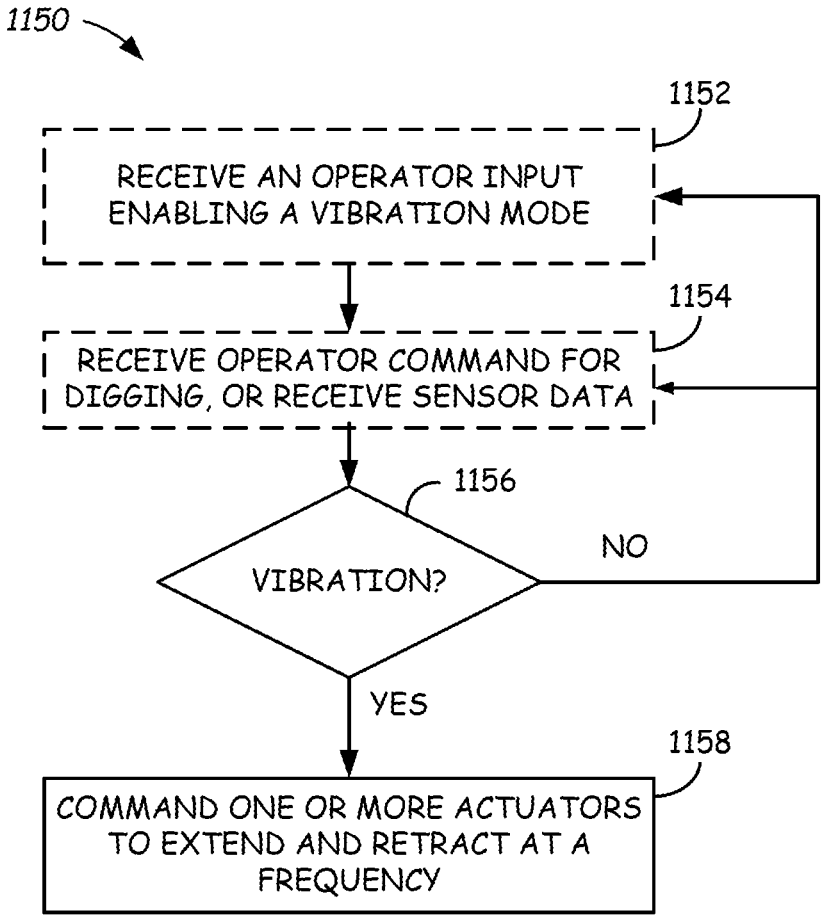

As generally noted above, commanded vibration of an implement can be particularly useful for some digging operations. In this regard, for example, FIG. 21 shows a flowchart of a process 1150 for vibrating a bucket of an excavator (or other power machine) during operation of a digging sequence by the excavator. Generally, the process 1150 can be implemented using one or more computing devices (e.g., the control device 811). Further, although operations of the process 1150 are described below with particular reference to digging operations, similar processes can also be applied to selectively implement vibration of implements during other types of operations.

At 1152, the process 1150 can include a computing device receiving an operator input enabling a vibration mode for a bucket, which can be similar to the blocks 854, 904, 952, 1052 of the processes described above. For example, a computing device can receive an operator input from an actuatable button of a joystick.

At 1154, the process 1150 can include a computing device receiving an operator command for implementing a task sequence, which can be, for example, a command for implementing a digging sequence (e.g., from an operator orienting a joystick of the excavator). In some embodiments, the block 1154 can include a computing device receiving sensor data, which can include one or more angles from the one or more angle sensors of the excavator, pressure data from a pressure sensor in fluid communication with a base of a boom actuator, etc.

At 1156, the process 1150 can include a computing device automatically determining whether or not to vibrate the bucket. If at the block 1156, the computing device determines that the bucket should not be vibrated, the process 1150 can proceed back to the block 1152 to allow removal or cancellation of an operator input indicative of enabling a vibration mode, or alternatively, can proceed back to the block 1154 to receive an operator command for digging (or a different task sequence), or additional sensor data. If, however, at the block 1156, the computing device determines that the bucket should be vibrated, the process 1150 can proceed to the block 1158, which can include a computing device commanding the one or more actuators to extend and retract at a frequency (which can be similar to the block 1106 of the process 1100).

In different embodiments, determining whether or not to vibrate the bucket at the frequency can be based on different criteria. For example, a computing device can determine that the bucket has stalled and can accordingly cause the bucket to begin vibrating (e.g., according to one or more operations of the process 1100 of FIG. 20). In some cases, a computing device can determine that an implement has stalled based on the orientation of the bucket failing to change by a particular amount over a period of time (e.g., indicting the bucket is having difficulty moving through the dirt). In some cases, a computing device can determine that an implement has stalled based on pressure data (e.g., from a pressure sensor in fluid communication with a base of an actuator) failing to change by a particular amount over a period of time (e.g., indicating that the bucket is having difficulty moving through the dirt).

As another example, a computing device can determine that an implement is to be vibrated at the frequency, based on receiving the operator input enabling the vibration mode at the block 1152. In other words, the operator input can provide a signal to a computing device to initiate the vibration of the bucket. In some cases, as long as a computing device continually receives an operator input (e.g., from an operator actuating an operator input device, including an actuatable button on a joystick), the computing device can cause the bucket to vibrate. Alternatively, if a computing device does not receive an operator input (e.g., the operator releases the operator input device), the computing device can stop vibrating the bucket at the frequency. As yet another example, a computing device can determine that the bucket is not to be vibrated, based on, for example, a computing device determining that the current bucket orientation (or the orientation of the arm, boom, etc.) exceeds a threshold, determining that a portion of the bucket is situated on a side of a virtual boundary (e.g., the bucket "intersecting" the virtual boundary), etc.

In some embodiments, a computing device can determine that an implement is to be vibrated based on one or more virtual boundaries, or a position of an implement relative to a particular automatic (or other) operation. For example, required or permitted vibration of an implement can be specified as an operational parameter for some virtual boundary zones (e.g., a starting zone for an automatic digging cut, or a dumping location corresponding to a dump pile or dump bed). In contrast, vibration may not be permitted in some virtual boundary zones (e.g., close to a virtual boundary that corresponds to no permitted operations of a lift arm).

In some embodiments, during execution of either of the processes 1100, 1150, a computing device can cause an implement to stop vibrating based on, for example, a computing device determining that the current implement orientation (or the orientation of the arm, boom, etc.) exceeds a threshold, determining that a portion of the implement is situated on a side of a virtual boundary, a time duration has elapsed, etc. For example, during a dig sequence, a position of the arm or boom can dictate when the work group has completed the digging portion of the dig sequence, and thus a computing device can cause an implement to stop vibrating based on the current orientation of the arm, the boom, or both. In some embodiments, while an implement is vibrating, a computing device can determine that the implement has stalled or is about to stall (e.g., based on pressure measurement) and can correspondingly command a different (e.g., larger) amplitude or a different (e.g., larger) frequency for an oscillation. In this way, for example, oscillations of increased magnitude or frequency can provide additional movement that can help an implement to move more effectively through denser dirt.

In some embodiments, oscillation of an implement can be automatically (or otherwise) implemented only when a commanded movement of an implement is below a particular speed threshold (i.e., only for appropriately slow movements of the implement). In some embodiments, oscillation can be continuously commanded, but may not provide noticeable vibration of an implement once bulk movement of a lift arm exceeds a particular speed (e.g., due to loss of oscillating inputs as noise within overall system response).

Figure 22:
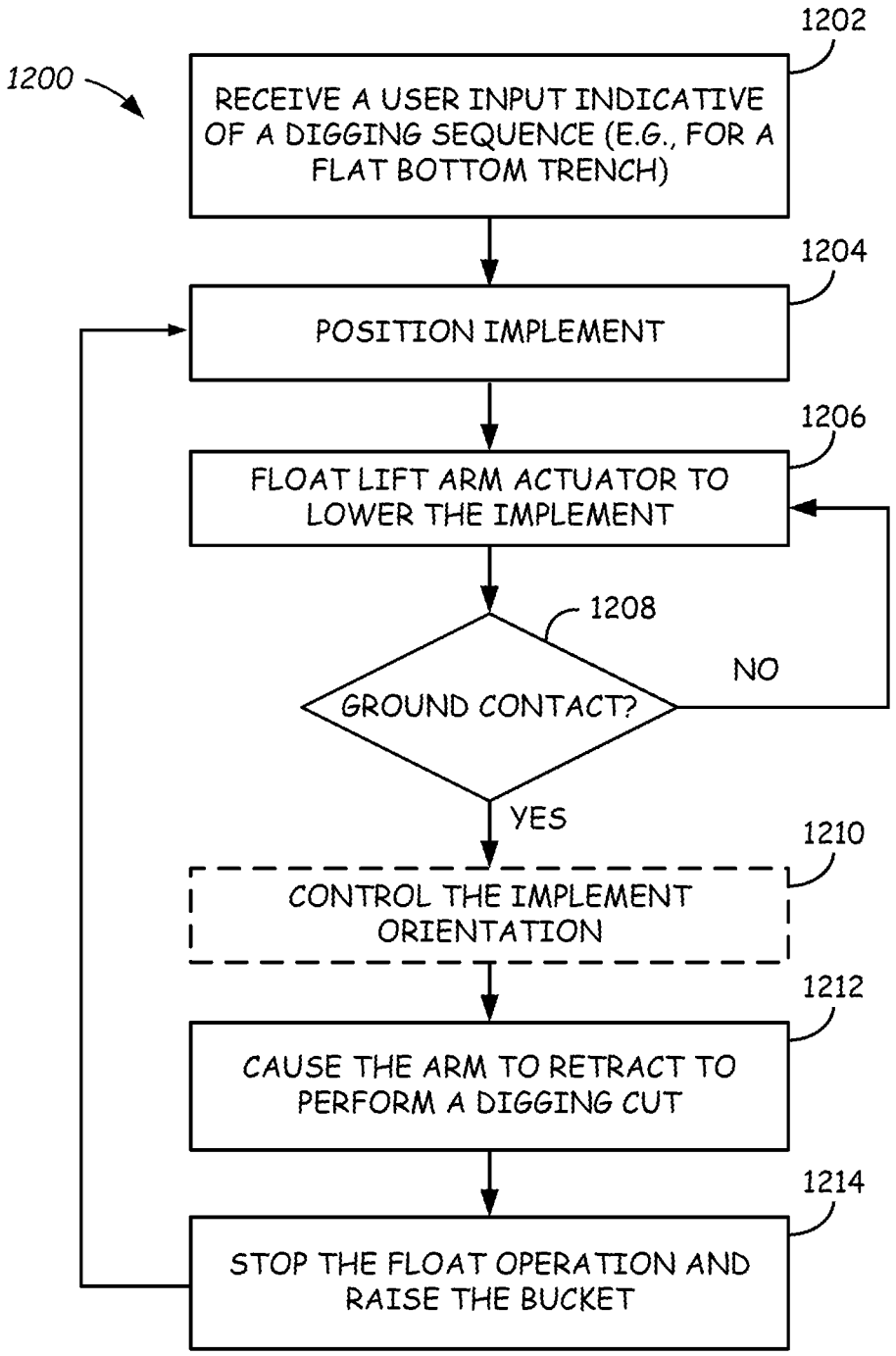
FIGS. 22 and 23 are flowcharts of processes for performing digging sequences with a power machine.

FIG. 22 shows a flowchart of a process 1200 for performing a digging sequence along a dig path with an excavator (or other power machine), with a boom actuator in float operation, which can be implemented using one or more computing devices. In some cases, the process 1200 can be particularly useful for flat bottom digs, in which a trench is to be cut with a substantially level (e.g. horizontal) floor. However, other implementations are also possible. In some cases, the process 1200 can result in a single trench. In some cases, the process 1200 can the can be repeated to increase the depth of an existing trench, or to create a plurality of trenches at different locations (e.g., of various widths, lengths, depths, etc.).

At 1202, the process 1200 can include a computing device receiving a user input indicative of a digging sequence for a flat bottom trench (e.g., a trench with a bottom that is substantially planar), which can be similar to the blocks 854, 904, 952, 1052 of the processes described above. For example, a computing device can receive a user input from an actuatable button on a joystick of the excavator.

At 1204, the process 1200 can include a computing device causing an implement to be positioned appropriately for initiation (or continuation) of a digging operation. In some cases, an initial position for an implement can be specified by an operator, including by the operator commanding the implement to a particular position and then providing an input to indicate that the current position is a starting position for a dig sequence.

Generally, operations at the block 1204 can correspond to any variety of known approaches to command an implement to a particular position, including actuator commands to cause a lift arm to move in various ways or cause a house of an excavator to slew in a particular direction. In some cases, a computing device can automatically command movement of an implement (e.g., via control of one or more lift arm or slew actuators) to cause the implement to reach a target location. In some embodiments, a target location for an implement under block 1204 can be specified by a particular boundary configuration, including as may define a particular front, rear, or lateral boundary for a trench to be dug.

At 1206, the process 1200 can include a computing device causing float operation of a lift arm (e.g., boom) actuator, to lower the relevant implement, including as may be similar to float operations under either of the processes 850, 900. As also discussed above, for example, when the boom actuator is commanded for float operation, externally applied forces on a boom (e.g., due to the overall weight of the workgroup) can result in floating movement the boom actuator, and the lift arm as a whole can thus move accordingly.

Generally, operations at block 1206 can be implemented to cause an implement to contact the ground as part of a digging sequence. Thus, for example, continuing to block 1208, the process 1200 can also include a computing device determining whether or not the bucket has contacted the ground, which can be similar to the other previously described blocks of other processes. For example, a computing device can determine that the bucket has contacted the ground based on a lift arm having operated in a float condition for more a particular elapsed time, based on a determination of a pressure spike at a boom cylinder, etc. Beneficially, use of float operations to cause an implement to contact ground can sometimes help to ensure that an implement does not over-penetrate into the ground, so that a corresponding cut through the ground can reliably provide a relatively flat floor. Correspondingly, active control of float operations (e.g., via pressure control, as described relative to FIGS. 13 and 14) or other operations (e.g., actively commanded lowering of a lift arm by a predetermined amount) can be implemented in some cases to provide for a desired penetration of an implement into the ground at the end of a float operation.

If a computing device determines at the block 1208 that the ground has been contacted, the process 1200 can proceed to the block 1210 (or the block 1212, if for example, the block 1210 is omitted). If, however, at the block 1208, a computing device determines that the ground has not been contacted, the process 1200 can proceed back to the block 1206 to continue floating the boom actuator to lower the implement.

Once an implement has been appropriately positioned (e.g., using float operations under block 1206), a lift arm can then be controlled to move the implement to cut through ground according to relevant virtual boundaries (e.g., trench boundaries) or other parameters, as applicable. In some cases, as further discussed below, float operation for a boom actuator (or other actuators) can be maintained during such a cut. Thus, for example, pressure of the ground on the implement can cause a boom to respond to ground pressure with floating movement (e.g. upwards), as the implement is moved across the ground (e.g., as an arm is pivoted toward the boom), without necessarily requiring active control of the boom. Thus, in some cases, a relatively flat bottom to the cut can be maintained without full kinematic control of a lift arm.

Correspondingly, it may be appropriate in some cases to control an orientation of an implement relative to ground, to ensure that forces from the ground on the implement during a cutting operation do not result in disadvantageous movement of the boom, including due to the ground pulling the implement and boom downward, or pushing the implement and boom upward. In this regard, at 1210, the process 1200 can include a computing device controlling the orientation of an implement, which can be similar to operations under the process 1100, as described above. Thus, generally, a computing device can command one or more actuators of the excavator to cause an implement to align with a target implement orientation. In some cases, an implement can be preferably aligned horizontally (e.g., with a cutting edge of a bucket in a horizontal orientation). In this way, as an implement moves according to a dig sequence (e.g., as further discussed below), the implement can maintain a substantially parallel orientation relative to the bottom of the trench so that the bottom of the trench continues to remain flat after the implement has removed material therefrom.

In some cases, orientation of an implement can be set by an operator, including via manual adjustment of the orientation based on operator commands. In some cases, orientation of an implement can be automatically adjusted, including through a variety of known bucket-leveling (or other) systems. In some cases, an orientation of an implement can be actively controlled under block 1210 (e.g., can be maintained at a target orientation) throughout part of all of one or more subsequent digging operations (e.g., as described below). In some embodiments, active leveling of an implement at the block 1210 can be omitted. For example, with appropriate initial alignment of a bucket by an operator, further adjustments to alignment may not necessarily be required for any particular sequence of digging operations (e.g., during a floating dig, as further described below).

With an implement appropriately oriented (e.g., via float operation and automatic leveling, as described above), the process 1200 can include, at 1212, a computing device causing the arm of the excavator to retract to perform a digging cut. In some cases, the cut can be executed while the one or more actuators (e.g., a boom actuator) is in a float operation. For example, a computing device can automatically retract an arm actuator while a boom actuator is floating, to perform a digging cut with a bucket. In this way, with the boom actuator floating, movement of the arm actuator can largely drive movement of the work group, with the boom actuator automatically responding (e.g., extending and retracting) based on the external forces on the implement that result of the movement of the implement by the arm actuator.

In some cases, including when the bucket orientation is not being actively controlled, the block 1212 can include a computing device causing only the arm actuator to retract to perform a digging cut, with the boom actuator remaining in a float operation. In this way, for example, a digging cut can be performed in a relatively simple manner either by an operator, or by an automatic actuator command, because the digging cut can effectively be driven only by movement of the arm actuator. Further, with an implement orientation having been appropriately established and maintained (e.g., at block 1210), forces from the ground on the implement during digging cuts (e.g., at block 1212) may tend not to pull the bucket excessively into the ground or push the bucket excessively above the desired cutting depth.

At 1214, the process 1200 can include a computing device stopping the float operation of the lift arm (e.g., boom) actuator, as can allow the actuator to be actively commanded to raise the implement. Generally, stopping float operation can be implemented using operations similar to those described relative to the blocks 860, 914 of the processes 850, 900, as presented above. In some cases, a computing device can stop the float operation of a lift arm actuator based on an angle of the arm, boom, etc., being less (or greater) than a threshold value, which can indicate that the digging portion of the dig sequence has been completed. In some cases, a computing device can stop float operation of a lift arm actuator based on determining that an implement has reached an end of a specified cut as specified by a virtual boundary or zone, or otherwise (e.g., based on operator input).

Figure 23:
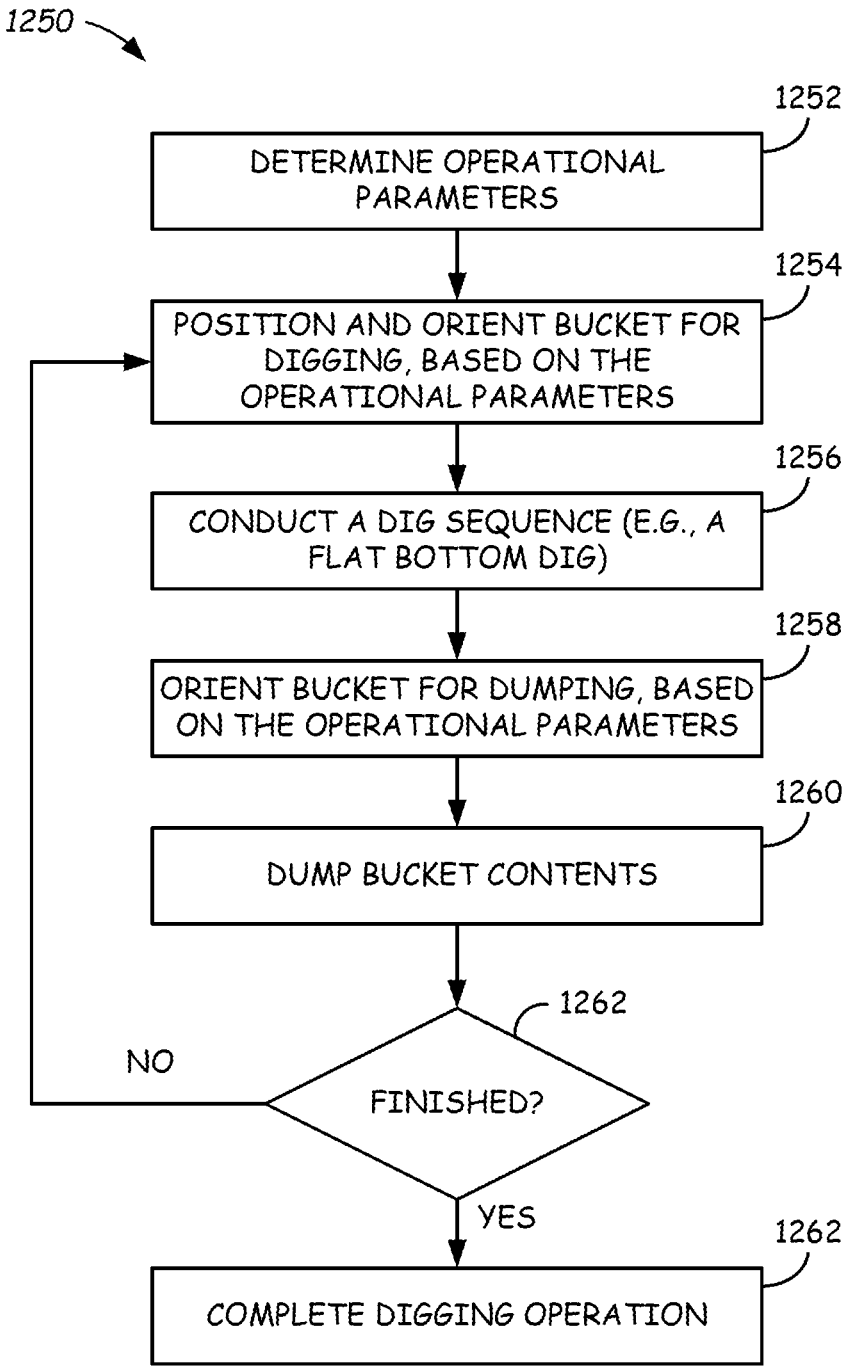

As appropriate, once a current digging cut has been completed under the process 1200, further operations can provide for dumping of material from an implement, including through one or more automatic operations as discussed relative to FIG. 17 (above) and FIG. 23 (below). Thus, in some embodiments, after a computing device has stopped the float operation for a lift arm (e.g., boom) actuator, the computing device can command one or more lift arm actuators to raise the lift arm and, correspondingly, can raise an implement (e.g., bucket) with material deposited therein.

As appropriate, the process 1200 (or parts thereof) can then be repeated to create a trench according to particular (e.g., predetermined) dimensions. In some cases, including when the length of a trench is longer than a maximum allowable sweep of a work group, a computing device can cause an excavator to travel (e.g., backwards) between cuts (e.g., between successive iterations of the process 1200), which can then be repeated, as needed, until the relevant trench reaches the desired dimensions. In this way, for example, particularly in combination with floating operation of the boom actuator, relatively long trenches can be completed in a computationally simpler manner, with corresponding benefits to overall efficiency of operation, at least because substantially level trench floors can be achieved without necessarily requiring computationally extensive processes (e.g., fully kinematic, feedback-based control of the entire work group).

Although floating operations can be useful in some cases, more active control of implement position during digging can also be implemented in some cases. For example, based on sensor input that indicates a current orientation of an implement (and lift arm generally), various lift arm actuators can be actively controlled, including according to known kinematic approaches, to cause a particular dig operation (e.g., a flat bottom dig) to be executed without necessarily implementing float operation for a particular actuator.

In some embodiments, automatic digging operations can be combined with automatic dumping operations, so that relatively little (e.g., no) operator input may be required to substantially complete one or more desired trenches or other features. For example, FIG. 23 shows a flowchart of a process 1250 for digging a trench with an excavator (or other power machine) according to a digging operation, which can be implemented using one or more computing devices. In some cases, the digging operation can include one or more digging sequences, each of which digs a single trench along a dig path.

At 1252, the process 1250 can include a computing device determining (e.g., receiving) operational parameters relevant to one or more digging operations. In some cases, operational parameters can include a virtual boundary configuration (e.g., to define boundaries corresponding to dimensions of a trench, hole, etc., or specify a virtual reference location for dumping), an indication specifying characteristics of the resulting dug feature (e.g., an indication that the digging sequence is a flat bottom dig sequence), an indication that the digging sequence is to be controlled in certain respects by an operator (e.g., via an operator input device) or automatically, a desired bucket orientation (e.g., a starting orientation, or an orientation to be maintained during the digging), etc. In some embodiments, the block 1252 can include determining multiple dig sequences (e.g., as form part of a larger digging operation), each of which can have associated operational parameters (e.g., digging location, whether or not a flat bottom dig is to be used, whether or not a float operation is to be used, etc.).

In some embodiments, the block 1252 can include a computing device determining (e.g., receiving or automatically defining) a digging sequence with associated operational parameters. For example, operational parameters for a particular digging operation can include an initial lift arm orientation, a digging depth, length, or width, or a dump location associated with the digging sequence (e.g., corresponding to a virtual reference location). In addition, the associated operational parameters for the digging sequence can include an initial slew or offset angle, an initial boom position, an initial arm position, an initial bucket angle, etc. In some cases, a computing device can determine a digging operation and associated operational parameters associated with the dig operation, including multiple dig sequences (each with operational parameters associated therewith), an initial lift arm orientation, a digging depth for the trench, a dump location, a digging width for the trench, a digging length for the trench, etc.

At 1254, the process 1250 can include a computing device orienting the bucket for digging, based on the operational parameters. For example, a computing device can slew the house of the excavator until the work group of the excavator reaches a particular location (e.g., a location that corresponds to a virtual reference location, a location that is the next location according to the next dig sequence). In addition, a computing device can, when the work group of the excavator reaches the particular slew (or offset) orientation location, cause the work group to move to a desired position. For example, this can include a computing device extending the lift arm, and otherwise orienting the bucket (e.g., to a target angular orientation).

At 1256, the process 1250 can include a computing device conducting a dig sequence (e.g., a flat bottom dig) according to the relevant determined operational parameters, including controlling a work group to cause an implement to scoop material. In general, lowering the bucket and performing the digging to gather material can utilize any number of digging procedures described herein (or otherwise known), as appropriate for a particular digging sequence, including one or more digging operations discussed relative to the processes 1050, 1200, etc. As a specific example, if a digging sequence specifies that a boom actuator is to float during lowering of the bucket or during a cutting stroke, then a computing device can cause the boom actuator to perform a float operation to lower the bucket and can maintain the float operation as the bucket is moved to scoop material.

In some embodiments, the block 1256 can include a computing device limiting movement of the lift arm based on the lift arm exceeding a predetermined angle threshold (e.g., as sensed by the angle sensor 235), which can provide an indication that a particular cut of a digging sequence has been completed. For example, once the lift arm reaches a particular lift arm angle, then a computing device can determine that the digging portion of the dig sequence is completed and can proceed to the block 1258. In some configurations, if a computing device determines that the lift arm exceeds the predetermined angle, the computing device can move the lift arm so that the angle of the lift arm satisfies a predetermined angle threshold, or the computing device can raise the lift arm and proceed to the block 1258. In some embodiments, the block 1256 can include a computing device limiting movement of the lift arm based on one or more boundaries of a boundary configuration for the excavator.

At 1258, the process 1250 can include a computing device orienting the bucket for dumping (with material deposited therein), based on one or more operational parameters associated with the digging sequence. Generally, block 1258 can thus include operations to raise, appropriately orient, and then dump a bucket. For example, block 1258 can include a computing device commanding a bucket to be raised (e.g., by extending a boom actuator), and then slewing the house of the excavator until the work group reaches a desired location. Generally, any variety of commanded movements can be executed to position a bucket (or other implement) for dumping, including commanded movements with respect to virtual boundaries or zones or virtual reference locations (e.g., a predetermined dumping location), as generally discussed above.

In some embodiments, the process 1250 (e.g., at the block 1256) can include a computing device determining whether or not a particular operation of a dig sequence has been successfully completed. In some cases, however, failure to complete a particular operation may not necessarily result in termination of the process 1250. For example, if a computing device determines that a bucket has stalled during digging, then the process 1250 can proceed to the block 1258, which can include a computing device raising the bucket, and slewing (as needed) to orient the bucket at the dump location. In such a case, however, subsequent operations to position an implement for further digging operations (e.g., at 1254) may sometimes be modified based on the determined prior lack of success. For example, if digging has stalled and a bucket has been raised for dumping prior to completion of a particular cut, the bucket may subsequently be positioned under block 1254 to repeat part or all of the unsuccessful operation. Similarly, in some cases, oscillating operation of a bucket (e.g., as described regarding the processes 1100, 1150) can be implemented as part of the process 1250 (or other processes), as appropriate, including based on a determination that a particular operation (e.g., cut) was not successful.

At 1260, the process 1250 can include a computing device dumping the bucket contents (e.g., at a predetermined pile location, as specified by a virtual reference point or boundary). In some cases, the block 1260 can thus include a computing device extending the arm actuator, extending the implement interface actuator, etc., to dump the contents of a bucket. In some cases, in order to ensure that most (or all) of the contents within a bucket have been dumped, a computing device can vibrate the bucket for a period of time while dumping the contents of the bucket, including as described above with reference to the processes 1100, 1150.

At 1262, the process 1250 can include a computing device determining whether or not a dig operation has been completed (e.g., whether a trench has been finished, as specified) . For example, if a computing device has completed all of the relevant operations according to a digging sequence, then the computing device can determine at 1262 that the digging has been finished and the process 1250 can finish at block 1264. Alternatively, if a computing device has not completed each relevant operation according to a digging sequence, then the computing device can determine that the digging operation has not been finished. If, at the block 1262, a computing device determines that the digging operation has not been finished, the process 1250 can then proceed back to the block 1254 (or block 1252 as appropriate). For example, when the process returns to the block 1254, a computing device can cause the excavator to reposition the bucket according to the next digging sequence (e.g., to extend a length or width of previous cut, or to dig deeper at a particular location).

In some embodiments, different dig sequences can require repositioning of a power machine as a whole. For example, if a specified trench is longer than a maximum allowable sweeping motion of a work group, or is wider than a relevant bucket width, an excavator can be repositioned accordingly between subsequent digging sequences. In some cases, a computing device can reposition an excavator as part of the process 1250, including as part of operations under block 1254, which can include the computing device causing one or more traction elements to move as needed.

In some embodiments, the block 1262 can include a computing device determining whether or not the current dig sequence has failed (or succeeded). For example, if the current dig sequence has failed (e.g., a cutting operation has stalled, as can be determined at the block 1256), the process can proceed back to the block 1254 to repeat the current dig sequence according to the associated operational parameters. In some cases, a computing device can correspondingly modify one or more operational parameters for a dig sequence, including to increase or decreases the depth at which a bucket is to engage the ground, increase or decrease an oscillation of the bucket during digging, increase or decrease commanded speed of a work group (e.g., how quickly the arm actuator retracts), etc. In this way, for example, when a computing device repeats an unsuccessful dig sequence, the repeated dig sequence can have a higher likelihood of succeeding. In some embodiments, if a current dig sequence (e.g., which can be modified after every failed attempt) continually fails for greater than a threshold number of attempts (e.g., three attempts), the digging operation can stop. In this way, for example, if a particularly difficult obstruction (e.g., buried concrete block) is present, appropriate remedial operations can be taken, as needed.

Figure 24:
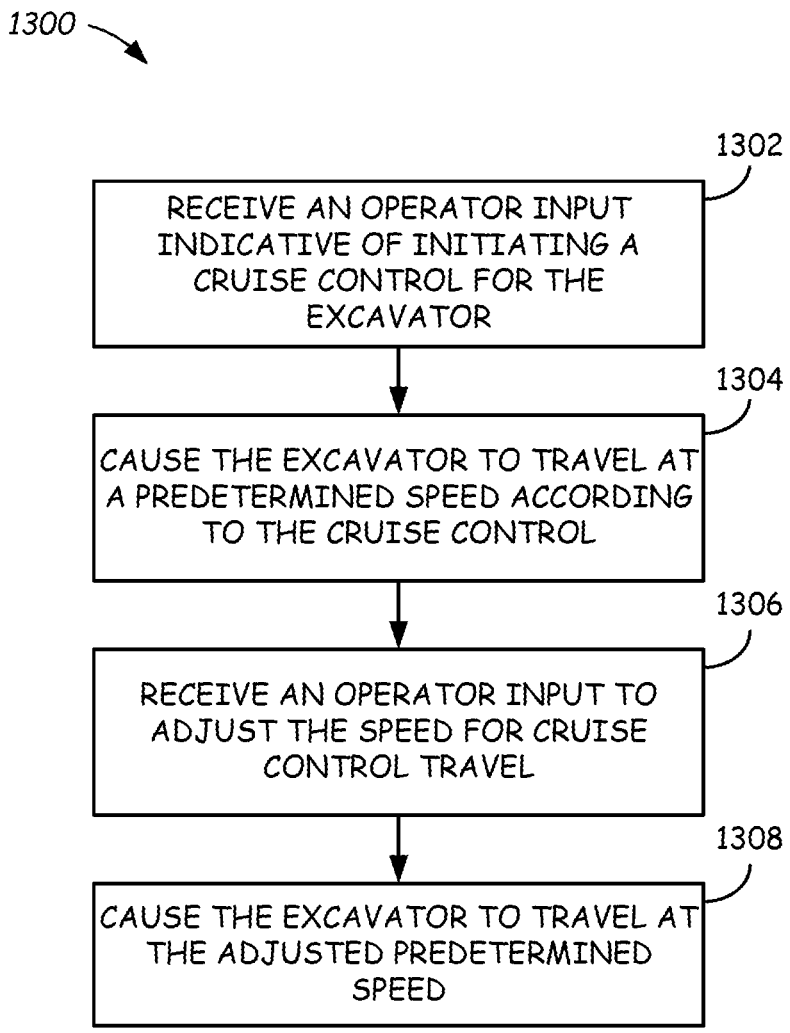
FIG. 24 is a flowchart of a process for controlling travel of a power machine over terrain.

In some embodiments, control systems disclosed herein can also (or alternatively) allow for other automatic operations. For example, in some embodiments, an operator can adjust a travel speed of a power machine during sustained-speed travel operation, including via input at one or more operator input devices during travel of the power machine. In this regard, for example, FIG. 24 shows a flowchart of a process 1300 for operating an excavator (or other power machine), which can be implemented using one or more computing devices (e.g., the control device 811). At 1302, the process 1300 can include a computing device receiving an operator input indicative of initiating a sustained-speed travel mode for the excavator. For example, the block 1302 can include receiving an operator input (or series of different operator inputs) from one or more operator input devices (e.g., actuatable buttons on a joystick), including as variously described above relative to FIGS. 5-7.

At 1304, the process 1300 can include a computing device causing the excavator to begin traveling at a predetermined speed, based on receiving the operator input at the block 1302. In some cases, this can include a computing device commanding sustained-speed travel of the excavator at the predetermined (or other) set speed (e.g., via commanded operation of one or more tractive elements.

At 1306, the process 1300 can include a computing device receiving an operator input to adjust the predetermined speed for sustained-speed control (e.g., a predetermined speed as previously set by an operator). For example, a user can actuate a button on a joystick to indicate a commanded increase or decrease relative the predetermined speed, including during travel of the power machine at the previous predetermined speed. In some cases, similar user input can also (or alternatively) be utilized to increase or decrease speed for each traction element of the excavator and thus cause adjustments to machine direction during sustained-speed travel operation. For example, a computing device can receive a first operator input that specifies a desired change from the predetermined speed for the left traction element of the excavator, while a computing device can receive a second operator input that specifies a desired change from the predetermined speed for the right traction element.

At 1308, the process 1300 can include a computing device causing the excavator to travel at the adjusted predetermined speed, based on the one or more received operator inputs at the block 1306. In some cases, block 1308 can thus include a computing device commanding sustained-speed travel of the excavator at the adjusted predetermined speed. For example, a computing device can command sustained-speed travel at each respective predetermined speed for each traction device. In this way, velocity of an excavator during sustained-speed travel can be updated by an operator in real time, as appropriate.

In some examples, during operation in a sustained-speed travel mode, speed of particular drive motors can be separately controlled to provide improved travel characteristics. For example, a control system can be configured in some cases to determine that a first drive motor (e.g., a left-side motor) is operating at a higher speed than a second drive motor (e.g., a right-side motor). Correspondingly, and particularly when the higher speed corresponds to the relevant sustained-speed mode set speed, the control system can command the second (slower) motor to increase in speed to match the first (faster) motor to ensure appropriately straight at (or near) the relevant set speed. In some cases, a slider on a touchscreen or another type of operator input interface can be provided to allow an operator to adjust a speed balance between laterally opposite drive motors in a sustained-speed travel mode (e.g., to compensate for imbalances in a control system or an operating context).

In some examples, during a turning operation, a control system can command one drive motor to maintain a present speed and decrease the speed of another drive motor. Thus, for example, a laterally outer (e.g., right-side) drive motor can be controlled to maintain the set ground speed along the outer radius of the turn, whereas a laterally inner (e.g., left-side) drive motor can be controlled to operate a lower speed and thereby cause the power machine to turn.

In some embodiments, a computing device can cause the excavator to continue traveling under sustained-speed travel mode, at a predetermined speed (or adjusted predetermined speed) even if a mode of operation of the excavator is changed (e.g., by an operator). For example, a computing device can receive an operator input indicative of changing a control mode of the excavator from a first control mode of the excavator to a second control mode of the excavator (e.g., as also discussed above), and the computing device can nonetheless continue commanding the excavator to travel at the relevant (e.g., adjusted) predetermined speed. In some embodiments, operator input for further adjustment of a sustained-speed travel control speed can be received from different operator input devices for different control modes, including as indicated generally discussed relative to FIGS. 5-7 above.

Figure 25:
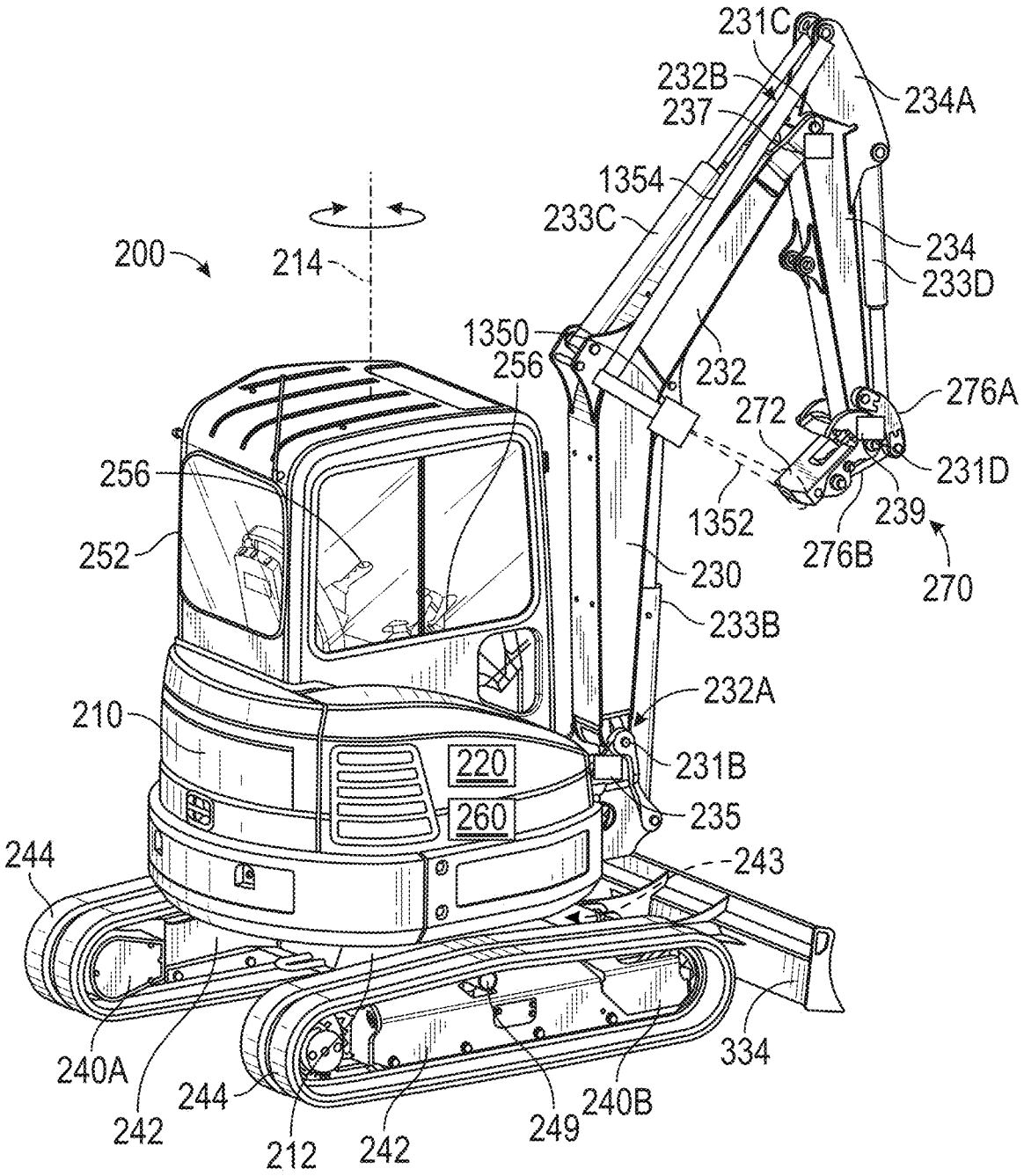
FIG. 25 is a rear right perspective view of another example configuration of the excavator of FIG. 2.

In some embodiments, a material sensor for a power machine can be arranged to monitor material quantity or movement relative to an implement, to allow corresponding control of power machine operations. Referring to FIG. 25, for example, another configuration of the excavator 200 is shown with a material sensor 1350. Generally, the material sensor 1350 can be configured to monitor an amount of material (e.g., dirt) that is on or in a bucket or other implement, or an amount of material that is moving into (or out of) a bucket or other implement, so that corresponding control of the implement for relevant operations can be appropriately managed. In some embodiments, a material sensor can be a radar sensor and the sensor 1350 is shown in particular as a narrow-band radar sensor that is configured to project a monitor material relative to a projected field of view (FOV) 1352. In other embodiments, however, other types of sensors are possible. In addition, cameras can be similarly used to sense material in some embodiments.

In the illustrated embodiment, the sensor 1350 is configured to monitor material relative to an implement (not shown) that is attached to the implement carrier 272. For example, through analysis of signals from the sensor 1350, the control device 260 can determine how much material is present in or on an implement attached to the implement carrier 272, or a depth of material at a reference point for an implement attached to the implement carrier 272 (e.g., a depth of dirt above a cutting edge of a bucket (not shown)). Correspondingly, the control device 260 can also be configured to determine a flow rate of material relative to an implement. For example, by monitoring changes over time of a depth of dirt at a cutting edge of a bucket (or at another location), the control device 260 can determine a rate of material flow into or out of the bucket (or otherwise) during a particular operation.

Relatedly, in some cases, operations of a power machine (e.g., movement of the lift arm 230) can be controlled based on the presence or movement of material relative to an implement. For example, during a digging operation, signals from the sensor 1350 can be analyzed to determine a rate of flow of material into a bucket (not shown) that is attached to the implement carrier 272. Based directly on the determined flow rate (e.g., in cubic feet per second), or based on other quantities derived from the determined flow rate (e.g., total bucket contents, or change in flow rate over time), an attitude of the bucket or other configuration of the lift arm 230 generally can then be controlled in order to accomplish a desired goal. In some cases, control based on signals from a material sensor (e.g., the sensor 1350) can be combined with other operations, including to control bucket angle during flat bottomed trenching (e.g., as further discussed above) or otherwise. For example, an attitude of a bucket can sometimes be controlled to maintain a flow rate into a bucket within a particular range during a particular operation.

In some embodiments, an orientation of a material sensor can be automatically adjusted based on movement of other components of a power machine, including through electronic control, mechanical linkages, or other systems. As illustrated in FIG. 25, for example, the sensor 1350 is pivotally attached to the boom 232, and a linkage 1354 (e.g., a single-bar linkage, as shown) extends to the sensor 1350 from a pivotal connection at the first end 234A of the arm 234. Accordingly, as the arm 234 is pivoted relative to the boom 232 the linkage 1354 causes the sensor 1350 to pivot relative to the boom 232 and thereby helps to ensure that the FOV 1352 remains appropriately aligned with the implement carrier 272. Thus, for example, the control device 260 may be able to more reliably monitor material relative to a particular location on an implement (e.g., at a cutting edge of a bucket) regardless of the overall orientation of the lift arm 230.

In other cases, similar arrangements can provide similar functionality, but with a material sensor otherwise located or oriented. For example, in some embodiments, a material sensor similar to the sensor 1350 can be pivotally attached to the arm 234 to monitor material at or in an implement. In some cases, a sensor thus arranged can be automatically adjusted to track movement of an implement, including with a linkage that is similar to the linkage 1354 but has a generally reversed orientation.

Consistent with the discussion above, some embodiments can include a method for controlling a lift arm of a power machine based on signals from a material sensor. For example, referring to FIG. 26, a method 1400 can include, at block 1402, receiving one or more signals from a material sensor (e.g., the sensor 1350 of FIG. 25). In some embodiments, signals received from the material sensor can be indicative of a quantity of material at a reference point for an implement of the lift arm. For example, a radar sensor or other material sensor (e.g., a camera configured to capture images of a relevant field of view) can be configured to detect a quantity (e.g., depth) of material at a reference point of a bucket (e.g., at a cutting edge, within a main cavity, etc.), or a flow rate of material past a reference point on the bucket.

In some cases, determining a quantity or flow rate of material can also be based on signals from other sensors. For example, for the excavator 200, signals from one or more of the sensors 235, 237, 239, or other sensors of various known types, can be analyzed in combination with known dimensional data for the lift arm 230 or other components in order to determine a current spatial posture for a reference location (e.g., cutting edge) of a bucket or other implement attached to the implement carrier 272. Signals from the sensor 1350 can then be analyzed in combination with the determined spatial posture for the reference location and, for example, a difference between a material location measured by the sensor 1350 and the determined spatial posture of the reference location can be identified to indicate a depth of material relative to the bucket or other implement at the reference location. In other cases, however, other approaches are possible, including analysis of material density differences or other parameters to determine material depth or flow rate.

Figure 26:
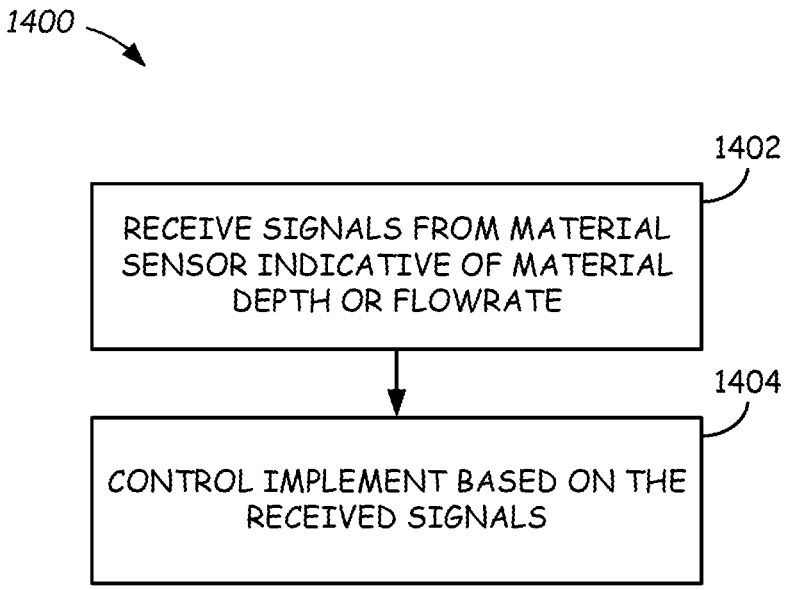
FIG. 26 is a flowchart of a process for controlling operations of a power machine based on material sensing.

Continuing with reference to FIG. 26, block 1404 can include controlling the implement of the power machine based on the sensor signals received at block 1402. In some cases, an attitude or other orientation of a bucket of a lift arm can be controlled by a control device (e.g., the device 260) based on a flow rate or depth of material at a cutting edge of a bucket, to try to maintain a particular characteristic for a digging operation. For example, for a flat bottomed digging operation, a cutting angle of a bucket relative to a reference frame (e.g., relative to horizontal or relative to an arm of a lift arm) can be controlled to attempt to maintain a constant flow rate of material into the bucket, or to otherwise manage one or more characteristics of the digging operation. Alternatively or in addition, the depth of cut can be controlled by controlling the boom cylinder.

In some cases, a control device can be configured to automatically control an implement at block 1404 based on signals from a material sensor, including for any of the various operations discussed above. In some cases, a control device can be configured to provide indicators of material quantity or flow rate to an operator (e.g., via a touchscreen display) and can then control operation of a lift arm based on operator input provided in response to the provided indicators.

While many examples described above are presented relative to buckets for an excavator, it should be understood that the disclosed systems and processes can generally be utilized for other implements as appropriate, including, for example, implements configured as mowers, forks, cutters, stamps, tree scoops, etc.

Thus, some embodiments of the disclosure can provide improved control of power machines, including via customizable or otherwise improved interoperation of operator input devices and electronically controlled actuators.

In some embodiments, aspects of the invention, including computerized implementations of methods according to the invention, can be implemented as a system, method, apparatus, or article of manufacture using standard programming or engineering techniques to produce software, firmware, hardware, or any combination thereof to control a processor device (e.g., a serial or parallel general purpose or specialized processor chip, a single- or multi-core chip, a microprocessor, a field programmable gate array, any variety of combinations of a control unit, arithmetic logic unit, and processor register, and so on), a computer (e.g., a processor device operatively coupled to a memory), or another electronically operated controller to implement aspects detailed herein. Accordingly, for example, embodiments of the invention can be implemented as a set of instructions, tangibly embodied on a non-transitory computer-readable media, such that a processor device can implement the instructions based upon reading the instructions from the computer-readable media. Some embodiments of the invention can include (or utilize) a control device such as an automation device, a special purpose or general purpose computer including various computer hardware, software, firmware, and so on, consistent with the discussion below. As specific examples, a control device can include a processor, a microcontroller, a field-programmable gate array, a programmable logic controller, logic gates etc., and other typical components that are known in the art for implementation of appropriate functionality (e.g., memory, communication systems, power sources, user interfaces and other inputs, etc.).

The term "article of manufacture" as used herein is intended to encompass a computer program accessible from any computer-readable device, carrier (e.g., non-transitory signals), or media (e.g., non-transitory media). For example, computer-readable media can include but are not limited to magnetic storage devices (e.g., hard disk, floppy disk, magnetic strips, and so on), optical disks (e.g., compact disk (CD), digital versatile disk (DVD), and so on), smart cards, and flash memory devices (e.g., card, stick, and so on). Additionally, it should be appreciated that a carrier wave can be employed to carry computer-readable electronic data such as those used in transmitting and receiving electronic mail or in accessing a network such as the Internet or a local area network (LAN). Those skilled in the art will recognize that many modifications may be made to these configurations without departing from the scope or spirit of the claimed subject matter.

Certain operations of methods according to the invention, or of systems executing those methods, may be represented schematically in the FIGs. or otherwise discussed herein. Unless otherwise specified or limited, representation in the FIGs. of particular operations in particular spatial order may not necessarily require those operations to be executed in a particular sequence corresponding to the particular spatial order. Correspondingly, certain operations represented in the FIGs., or otherwise disclosed herein, can be executed in different orders than are expressly illustrated or described, as appropriate for particular embodiments of the invention. Further, in some embodiments, certain operations can be executed in parallel, including by dedicated parallel processing devices, or separate computing devices configured to interoperate as part of a large system.

As used herein in the context of computer implementation, unless otherwise specified or limited, the terms "component," "system," "module," "block," and the like are intended to encompass part or all of computer-related systems that include hardware, software, a combination of hardware and software, or software in execution. For example, a component may be, but is not limited to being, a processor device, a process being executed (or executable) by a processor device, an object, an executable, a thread of execution, a computer program, or a computer. By way of illustration, both an application running on a computer and the computer can be a component. One or more components (or system, module, and so on) may reside within a process or thread of execution, may be localized on one computer, may be distributed between two or more computers or other processor devices, or may be included within another component (or system, module, and so on).

Although the present invention has been described by referring to preferred embodiments, workers skilled in the art will recognize that changes may be made in form and detail without departing from the scope of the discussion.

What is claimed is:

1. A power machine comprising:

a main frame;

a work element supported by the main frame, the work element comprising a lift arm moveably secured to the main frame, and an implement interface movably secured to the lift arm;

one or more actuators configured to move one or more components of the power machine;

an operator input device configured to receive operator inputs to control movement of the one or more actuators;

a control system that includes an electronic controller in electronic communication with the operator input device and the one or more actuators, the electronic controller being configured to:

identify a plurality of response curves for the operator input device, each of which specifies a respective relationship between input signals from the operator input device and control signals for the one or more actuators;

select a first selected response curve of the plurality of response curves;

receive, from the operator input device, an operator input that commands movement of the one or more actuators;

generate a command output, to control of the one or more actuators, based on the received operator input and the first selected response curve; and modify one or more characteristics of one or more of the response curves based on operator input so as to provide differently modified command outputs based on the one or more of the response curves.

2. The power machine of claim 1, wherein the electronic controller is further configured to:

after generating the command output based on the first selected response curve, select a different second selected response curve of the plurality of response curves;

receive, from the operator input device, a second operator input that commands movement of the one or more actuators; and generate a second command output, to control of the one or more actuators, based on the received second operator input and the second selected response curve.

3. The power machine of claim 1, wherein the power machine is configured as an excavator and the lift arm includes a boom pivotally secured to the main frame and an arm pivotally secured to the boom.

4. The power machine of claim 3, wherein the first selected response curve is non-linear.

5. The power machine of claim 1, wherein the first selected response curve specifies a substantially non-zero initial command output corresponding to an initial movement of the operator input device.

6. The power machine of claim 5, wherein the first selected response curve specifies a maximum command output to be provided based on receiving, from the operator input device, less than a maximum possible operator input from the operator input device.

7. The power machine of claim 1, wherein the control system is configured to store a plurality of operator-customized response curves as at least part of the plurality of response curves.

8. The power machine of claim 1, wherein the electronic controller is configured to modify the one or more characteristics of the one or more of the response curves to reduce a maximum commanded speed of the one or more actuators.

9. The power machine of claim 1, wherein the response curves include a plurality of operating-mode response curves, including a default-mode response curve and one or more of:

a drive-mode response curve; or one or more of a trenching-mode response curve, a digging-mode response curve, or a grading-mode response curve.

10. The power machine of claim 1, wherein the response curves include a default response curve and a trenching-mode response curve; and wherein the trenching-mode response curve exhibits increased maximum actuator speed and reduced response as compared to the default response curve.

11. The power machine of claim 10, wherein the response curves further include a digging-mode response curve; and wherein the digging-mode response curve exhibits increased maximum actuator speed and reduced response as compared to the trenching-mode response curve.

12. The power machine of claim 1, wherein the response curves include a default response curve and a grading-mode response curve; and wherein the grading-mode response curve exhibits decreased maximum actuator speed and increased response as compared to the default response curve.

13. A control system for a power machine, comprising:

a controller in electronic communication with an operator input device and an actuator of the power machine, the controller to:

select a response curve from a plurality of response curves, each response curve specifying a respective relationship between input signals from the operator input device and control signals for the actuator, the plurality of response curves including:

a first response curve that provides a first output command to the actuator in response to a first input signal from the operator input device; and a second response curve that provides a second output command to the actuator, different from the first output command in response to the first input signal from the operator input device, the second response curve based on operator input to provide differently modified command outputs based on the first response curve; and control the actuator in response to the first input signal from the operator input device, based on the selected response curve.

* * * * *